US005376752A

United States Patent [19]

Limberis et al.

[11] Patent Number: 5,376,752

[45] Date of Patent: Dec. 27, 1994

[54] OPEN ARCHITECTURE MUSIC SYNTHESIZER WITH DYNAMIC VOICE ALLOCATION

[75] Inventors: Alexander J. Limberis, San Jose; Joseph W. Bryan, Sunnyvale; Joanne F. Ottney, Los Altos; Steven S. O'Connell, Scott Valley; Marcus K. Bryan, Jr., Sunnyvale, all of Calif.

[73] Assignee: Korg, Inc., Tokyo, Japan

[21] Appl. No.: 16,865

[22] Filed: Feb. 10, 1993

[51] Int. Cl.[5] ..... G10H 1/06; G10H 7/00

[52] U.S. Cl. ..... 84/622; 84/645

[58] Field of Search ..... 84/601, 602, 622, 623, 84/645

[56] References Cited

U.S. PATENT DOCUMENTS

| | | | |
|---|---|---|---|
| 4,984,276 | 1/1991 | Smith . | |
| 5,208,421 | 5/1993 | Lisle et al. | 84/645 |
| 5,225,618 | 7/1993 | Wadhams | 84/645 |

OTHER PUBLICATIONS

Synergy Owner's Manual, Copyright 1983, Digital Keyboards, Inc., all pages.

ESQ-1 Musician's Manual, Copyright 1986-1993, Ensoniq Corp, all pages.

Korg Wavestation, Copyright 1990, Peter L. Exenander Publishing, Inc., pp. 9-22.

*Primary Examiner*—Stanley J. Witkowski

*Assistant Examiner*—H. Kim

*Attorney, Agent, or Firm*—Haynes & Davis

[57] ABSTRACT

An architecture for a synthesizer of music or other sounds which comprises an input device which supplies real time input signals indicating selected voices, a voice program memory which stores voice programs for respective voices, and a sound processing module including an array of digital signal processors, which is coupled to the input device and the voice program memory, and responsive to real time input signals to execute a group of voice programs in the voice program memory to generate selective voices in real time. Resources coupled to the input device and the voice program memory dynamically assign voice programs for selected voices to the group of voice programs in response to the real time input signals. Further, resources are available for replacing a particular voice program in the group with a voice program for a selected voice in response to the real time input signals. The voice program memory includes a first memory which stores a plurality of voice programs, and a second memory which is coupled to the sound processing module and the first memory, which stores the group of voice programs for execution by the sound processing module. The resources for dynamically assigning a voice program to the group includes a system for transferring a selected voice program from the first memory to the second memory in real time. An audio output device, including a speaker, is coupled to the digital signal processor for producing sound in response to the sound data.

56 Claims, 22 Drawing Sheets

Addr $00:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| DTC | CNT | SI | | | | M9 | M8 | M7 | M6 | M5 | M4 | M3 | M2 | M1 | |

FIG.5C

Addr $02:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| DTC | CNT | SI | | | | M9 | M8 | M7 | M6 | M5 | M4 | M3 | M2 | M1 | |

FIG.5D

Addr $04:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| | | | | | | | | | | | | ST | TD | MAI | DAI |

FIG.5E

Addr $06:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| A15 | A14 | A13 | A12 | A11 | A10 | A9 | A8 | A7 | A6 | A5 | A4 | A3 | A2 | A1 | A0 |

FIG.5F

Addr $08:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| | | | | | | | | | (1) | (1) | (0) | A19 | A18 | A17 | A16 |

FIG.5G

Addr $0A:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| A15 | A14 | A13 | A12 | A11 | A10 | A9 | A8 | A7 | A6 | A5 | A4 | A3 | A2 | A1 | (0) |

FIG.5H

Addr $0C:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| | | | | | | | | | | | | | D18 | D17 | D16 |

FIG.5I

Addr $0E:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| D15 | D14 | D13 | D12 | D11 | D10 | D9 | D8 | D7 | D6 | D5 | D4 | D3 | D2 | D1 | D0 |

FIG.5J

Addr $10:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| | | | | | | M9 | M8 | M7 | M6 | M5 | M4 | M3 | M2 | M1 | |

FIG.5K

Addr $12:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| | | | | | | M9 | M8 | M7 | M6 | M5 | M4 | M3 | M2 | M1 | |

FIG.5L

Addr $14:

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| | | | | | | | | D7 | D6 | D5 | D4 | D3 | D2 | D1 | D0 |

FIG.5M

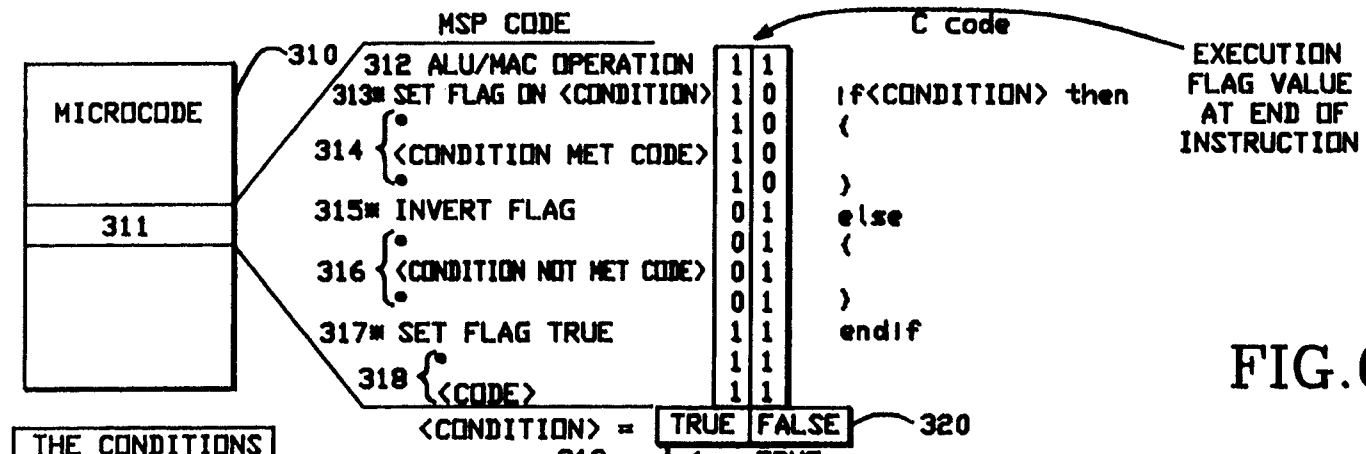

FIG.6B

THE CONDITIONS SUPPORTED ARE:

| | | |
|---|---|---|
| MAC OUTPUT > ZERO | ALU OUTPUT > ZERO | MAC CLIPPED = 1 |
| MAC OUTPUT >= ZERO | ALU OUTPUT >= ZERO | MAC CLIPPED = 0 |
| MAC OUTPUT < ZERO | ALU OUTPUT < ZERO | MAC EXTENDED = 1 |
| MAC OUTPUT <= ZERO | ALU OUTPUT <= ZERO | MAC EXTENDED = 0 |
| MAC OUTPUT = ZERO | ALU OUTPUT = ZERO | |
| MAC OUTPUT <> ZERO | ALU OUTPUT <> ZERO | ALU CARRY = 1 |
| MAC OUTPUT ALMOST EQUAL T | ALU OUTPUT ALMOST EQUAL T | ALU CARRY = 0 |
| MAC OUTPUT NOT ALMOST EQUAL T | ALU OUTPUT NOT ALMOST EQUAL T | ALU LATCHED OVERFLOW = 1 |
| MAC OUTPUT ALMOST EQUAL S | ALU OUTPUT ALMOST EQUAL S | ALU LATCHED OVERFLOW = 0 |
| MAC OUTPUT NOT ALMOST EQUAL S | ALU OUTPUT NOT ALMOST EQUAL S | |
| MAC OUTPUT > S | ALU OUTPUT > S | EXTERNAL CONDITION BIT = 1 |
| MAC OUTPUT >= S | ALU OUTPUT >= S | EXTERNAL CONDITION BIT = 0 |
| MAC OUTPUT < S | ALU OUTPUT < S | CPU CONDITION BIT = 1 |
| MAC OUTPUT <= S | ALU OUTPUT <= S | CPU CONDITION BIT = 0 |
| MAC OUTPUT = S | ALU OUTPUT = S | |
| MAC OUTPUT <> S | ALU OUTPUT <> S | TRUE |
| MAC OUTPUT > T | ALU OUTPUT > T | FALSE |
| MAC OUTPUT >= T | ALU OUTPUT >= T | ELSE |
| MAC OUTPUT < T | ALU OUTPUT < T | |
| MAC OUTPUT <= T | ALU OUTPUT <= T | |
| MAC OUTPUT = T | ALU OUTPUT = T | |
| MAC OUTPUT <> T | ALU OUTPUT <> T | |

OPEN ARCHITECTURE MUSIC SYNTHESIZER WITH DYNAMIC VOICE ALLOCATION

BACKGROUND OF THE INVENTION

1. Field of the Invention

The present invention relates to audio signal processors; and more particularly to synthesizers based on digital signal processing in response to sound generating programs, called herein voice programs.

2. Description of Related Art

There are a number of music synthesizer architectures in common use. These include subtractive synthesis, wave table synthesis, F/M synthesis, and additive synthesis. A brief discussion of these common synthesis formats is provided in Walker, *Korg Wavestation*, Peter L. Alexander Publishing Inc., Newbury Park, Calif., 1990, pages 9 through 22. All of these four common synthesis types rely on playing back packaged waveforms, which may be manipulated in real time by the user to generate voices of the synthesizer. The packaged waveforms may consist of simple sine waves, as in the subtractive and FM synthesis formats, or on tables of actual recorded music from real instruments. The tables are typically stored in a compressed format known as Pulse Code Modulation (PCM) on memory chips in the synthesizer circuitry.

The prior art synthesizers based on playback techniques have somewhat limited range of voices that may be created by the instrument. To change the voices available on a given instrument, new sampling hardware must be added, in the form of new PCM tables, or the like.

There is a growing trend in the music synthesizer industry to synthesize sounds using sound generating programs executed by digital signal processors (DSPs). Since programming can be conducted by individual programmers who may not have access to the hardware resources necessary to update a sampling based synthesizer, users of the DSP synthesizers have much greater flexibility in the voices that may be played by their instrument.

These sound generating programs, called voice programs, are based on computational models of musical instruments, the human voice or other sound source. Thus the developer of a sound generating program typically first defines a computational model of the sound source he or she desires to create, and then writes a computer program to execute the model. Prior art examples of such sound generating programs are described in U.S. Pat. No. 4,984,276, invented by Julius O. Smith, entitled "DIGITAL SIGNAL PROCESSING USING WAVEGUIDE NETWORKS."

Dynamic voice allocation in an electronic musical instrument implies the ability to activate an arbitrary sound using whatever sound generation resources (e.g. memory, processors, bus cycles, etc.) are required, regardless of whether or not the resources are currently available. This means if resources are available, they are used immediately, and if resources are not available, they must be "stolen" from whatever voice is currently using them and reallocated to the new voice.

In typical playback based synthesizers, dynamic voice allocation is made possible by restricting the variation of the voice resource requirements to a very limited set that can be changed within a small time interval. Typically this is accomplished by making every voice use the same algorithm (which is usually built into dedicated hardware), share the same PCM data, use the same amounts of memory, and connect to the output using a fixed configuration audio bus. In this scenario, the only differences between voices are a few data values that can be initialized and changed quickly. If resources are not available, they can be made available using "voice stealing" that shuts down an active voice to allow resources allocated to it to be used by a new voice. One prior art system, known as the DPM-3, manufactured by Peavy, uses a DSP engine to execute a voice program. To dynamically change the voice, coefficients used by the single voice program are changed in real time. However, the instructions of the voice program itself cannot be changed in real time, which limits the flexibility of the system.

More recently, variable algorithm DSP systems have been added to some of these playback synthesizers that allow different audio effects processing to be applied to the signals generated by the fixed architecture voice system. However, the effects processing cannot be changed in real time because of the time it takes to make all the necessary changes in the DSP system to ready it for the new algorithm(s).

Synthesizers designed to execute voice programs utilize powerful digital signal processors to execute in real time. The real time systems have been limited in the number of voices that may be executed in real time, by the resources of the digital signal processor. All the real time voices have to be preloaded in the digital signal processor instruction space. If a voice that was not preloaded needed to be played in real time, an audible interruption of the executing program would occur so that the time consuming process of clearing delay lines, updating tables, initializing coefficients, and supplying the program itself could be carried out. Further, this process was required to displace a voice program already loaded in the instruction space of the DSP, which could cause further audible interruptions or clicks in the output of the machine.

Therefore, prior art DSP based systems have been unable to provide for dynamic voice allocation to the output channels of the synthesizer, as available in sampling or playback based systems.

Accordingly, there is a need to provide for dynamic voice allocation in digital signal processing based music synthesizer systems.

SUMMARY OF THE INVENTION

The present invention provides for dynamic voice allocation in a digital signal processing based music synthesizer or other audio signal processor. According to the present invention, an architecture for an audio signal processor comprises an input device which supplies real time input signals indicating selected voices, a voice program memory which stores voice programs for respective voices, and a sound processing module which is coupled to the input device and the voice program memory, and responsive to real time input signals, to execute a group of voice programs in the voice program memory to generate selected voices in real time. Resources coupled to the input device and the voice program memory dynamically allocate voice programs for selected voices to the group of voice programs in response to the real time input signals. Further, resources are available for replacing a particular voice program in the group with a voice program for a selected voice in response to the real time input signals.

The voice program memory according to one aspect of the invention includes a first memory which stores a plurality of voice programs, and a second memory which is coupled to the sound processing module and the first memory, which stores the group of voice programs for execution by the sound processing module. The resources for dynamically allocating a voice program to the group includes a system for transferring a selected voice program from the first memory to the second memory in real time.

The sound processing module according to the present invention includes at least one digital signal processor, which executes voice programs in the voice program memory to generate sound data representing the selected voices. An audio output device, including digital to analog converters and a speaker, is coupled to the digital signal processor for producing sound in response to the sound data.

The voice programs include instructions, initializing coefficients, tables, and delay lines. The memory which is connected to the sound processing module includes instruction memory coupled to at least one digital signal processor to store instructions for the group of voice programs, a delay line memory coupled to at least one digital signal processor to store delay lines for the group of voice programs, and a table memory coupled to at least one digital signal processor to store table data for the group of voice programs.

The resources for dynamically allocating voices include apparatus for transferring instructions and delay line parameters of a selected voice program from the first memory to the instruction memory and the delay line memory respectively in real time. In order to replace a particular voice program in a group, the instruction storage locations for the particular voice program are temporarily masked in the instruction memory from execution by the digital signal processor without affecting execution of other voice programs in the group. The instructions for the selected voice program are transferred into the temporarily masked instruction storage location for dynamic allocation of the selected voice program.

The resources for replacing a particular voice program also include a mechanism for clearing a delay line of a particular voice program in the delay line memory and setting up a delay line for the selected voice program in the delay line memory in response to the delay line parameters in real time.

Accordingly, another aspect of the invention, the sound processing module includes an input device, a host processing system, which includes resources for supplying voice programs for generation of corresponding voices, and a storage unit for storing a group of voice programs. A plurality of digital signal processors is coupled to the storage unit and the input device for executing selected voices from the group of voice programs in response to real time input data. An audio data bus is coupled to the plurality digital signal processors for communicating sound data among the digital signal processors, and an audio output structure, including a digital to analog converter, produces sound in response to the sound data on the bus. Resources for dynamically allocating voice programs for selected voices to the group stored in the storage unit in response to the real time input signals are provided as described above.

The storage unit includes a plurality of memory modules coupled to corresponding digital signal processors. Each memory module includes an instruction memory, a delay line memory, and a table memory for the corresponding digital signal processor.

According to another aspect, the host processing system includes a program for composing a set of voice programs for real time execution. The set of voice programs are stored in a set memory in a format which facilitates the dynamic allocation of voices to the storage unit coupled to the plurality digital signal processors. In this system, the table memory in each memory module of the storage unit stores table data for the entire set of voice programs. Instructions for dynamically allocated voice programs are loaded using the temporary masking technique described above. Delay line memory for the dynamically allocated voices are also updated using the real time clearing mentioned above.

The host system according to another aspect of the invention is optimized for dynamic allocation of voice programs to the sound processing module. In this aspect, the host system includes a CPU with main memory, and a isolated memory. The isolated memory is coupled to the CPU with an interface that allows the host independent transfer of data from the isolated memory to the sound processing module for dynamic allocation of voices. The host system composes a set of voice programs by storing them in a format optimized for transfers to the sound processing module into the isolated memory. In response to real time input signals indicating a selected voice from the set of voice programs, the interface chip through automatic DMA transfers assigns the selected voice program to a memory module in the sound processing module.

The present invention provides a digital signal processing based synthesizer/audio processing system having the unique capability of being able to reconfigure itself extremely quickly in order to generate musical signals in response to real time control information from a keyboard, modulation controllers, standard MIDI inputs etc. The system is designed around an array of digital signal processors with both hardware and software enhancements which allow it to work in real time. The system enables dynamic voice allocation in a digital signal processing based electronic music synthesizer, between voices requiring differing digital signal processing algorithms for execution.

Other aspects and advantages of the present invention can be seen upon review of the figures, the detailed description and the claims which follow.

BRIEF DESCRIPTION OF THE FIGURES

FIGS. 5-1 and 5-2 are a functional block diagram of the system integration chip of FIG. 2.

FIGS. 5A through 5K illustrate register configurations for the system integration chip of FIGS. 5-1 and 5-2.

FIG. 6B is a chart illustrating the MSP conditional execution scheme.

DETAILED DESCRIPTION

Figure 1:
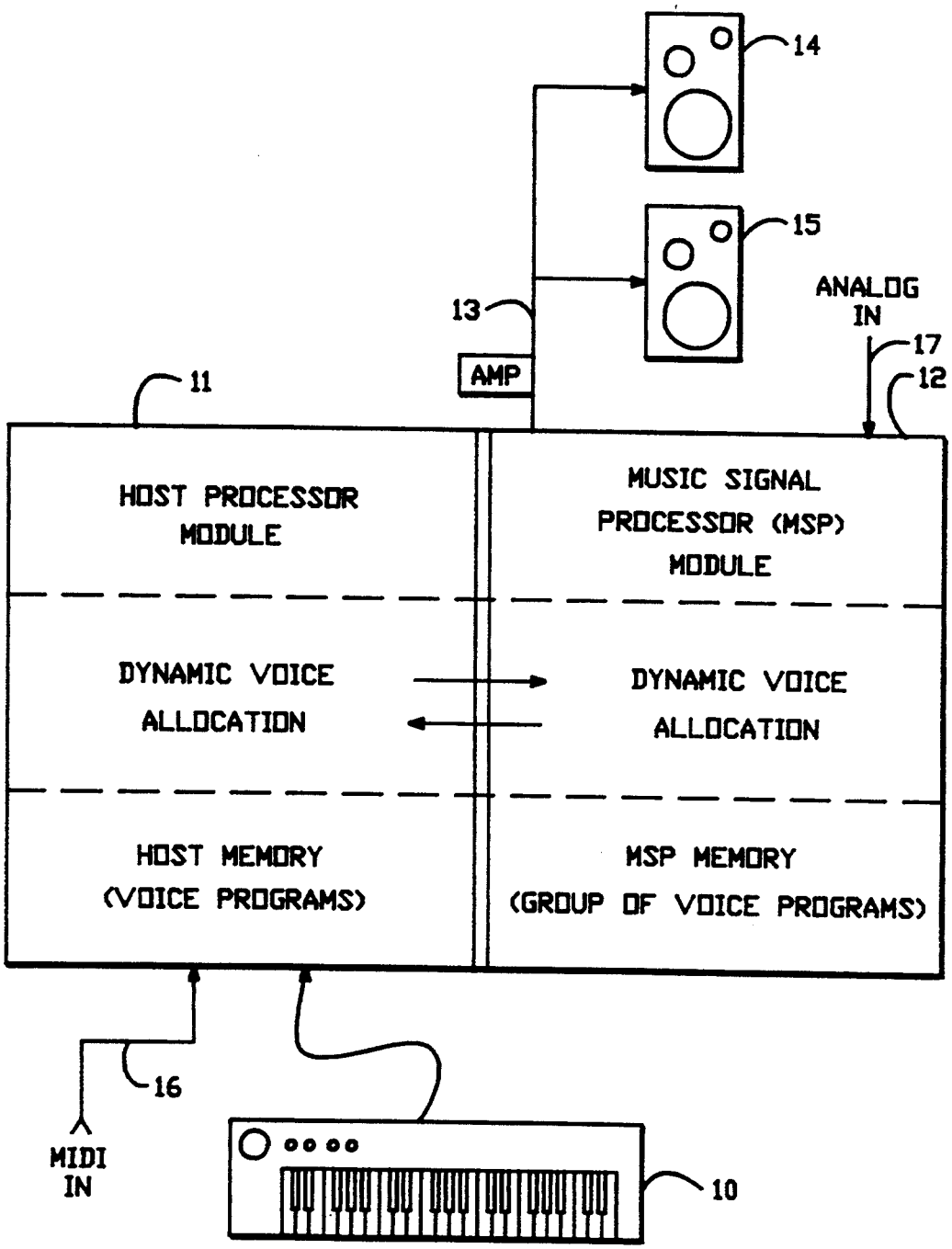
FIG. 1 is a conceptual block diagram of a music synthesizer according to the present invention.

A detailed description of the preferred embodiments of the present invention is provided with respect to the Figs. FIG. 1 provides a heuristic overview of the present invention. FIGS. 2 through 6, and 6A through 6E illustrate a specific hardware implementation of the synthesizer. FIGS. 7 through 20 illustrate the operation of dynamic voice allocation according to the present invention.

I. Overview (FIG. 1)

FIG. 1 provides an overview block diagram of a music synthesizer with dynamic voice allocation according to the present invention. The invention may also be applied to other audio signal processors, like mixers or effects processors. The synthesizer includes an input device 10, a host processor module 11 including host memory and dynamic voice allocation resources, and a music signal processor module 12 which includes MSP memory and dynamic voice allocation resources. The music signal processor 12 generates an analog output on line 13 which is supplied through amplifier 21 to speakers 14 and 15 to generate real time sound. Besides analog sound signals, other audio signal types, such as digital sound data, in standard or non-standard formats may be used as well. The input device 10 may be a music keyboard or other device as known in the art. Other input signals may be supplied from a variety of sources, such as the MIDI standard format for musical instruments on line 16. The system also provides for accepting analog input signals on line 17 for digitizing and supply to the music signal processor module 12.

The host processor module 11 provides a plurality of voice programs stored in the host memory. Also, the host processor module 11 accepts input signals from the input device 10 or from the input channel 16 for controlling allocation and production of voices in the music signal processor module 12.

In the music signal processor module, MSP memory stores a group of voice programs for active execution by the module. This group of voice programs utilizes the memory resources of the music signal processor 12 for instructions, delay lines, tables, coefficients and the like for active programs. The dynamic voice allocation resources in the host processor module 11 and the MSP processor module 12 provide for allocation and de-allocation of voice programs to the music signal processor module 12 in response to input signals supplied by the keyboard 10 or by the MIDI input channel 16 or by host programs.

The music signal processor module 12 may have a plurality of output channels, e.g., 32, corresponding to particular voices being executed at the same time. If a new voice must be allocated in response to an input signal to one of the available channels, each channel is updated with digital signal data at an audio rate, combined with the output of other channels, and supplied to a digital to analog converter to generate analog output sound on line 13 for supply to the speakers 14 and 15.

Each channel actively utilizes a set of instructions in the instruction memory associated with the music signal processor module for supplying the output data. When a new voice is to be allocated to one of the channels, the instructions, coefficients, tables and delay lines in the music signal processor for the selected voice must be moved into the music signal processor, and any particular voice program which is being replaced by the selected voice program must be de-allocated—delay lines cleared, coefficients overwritten, instructions masked and the like—without causing an audible glitch in the output signal. Each channel can be considered the result of a corresponding voice program. Thus for a 32 channel system, 32 voice programs may be allocated to the group of voice programs which are actively being executed at a given time.

To dynamically allocate a voice, a voice program must be moved from host memory in the host processor module to the MSP memory in the MSP module 12 in real time, and without significant glitch in the audio output. For the purposes of this application, real time is considered limited by the perception of the user of the input device 10. Thus, such user must strike a key to select a voice, the selected voice must be allocated to the group of voice programs in the MSP memory, and the music signal processor must execute the voice without a perceptible delay or other distortion in the audio output.

The primary hardware modules in a synthesizer for accomplishing dynamic voice allocation include the host processor module 11, the music signal processor module 12 and the input device 10. A preferred implementation of these systems is provided below with respect to FIGS. 2 through 6.

II. Hardware System (FIGS. 2–4)

Figure 2:
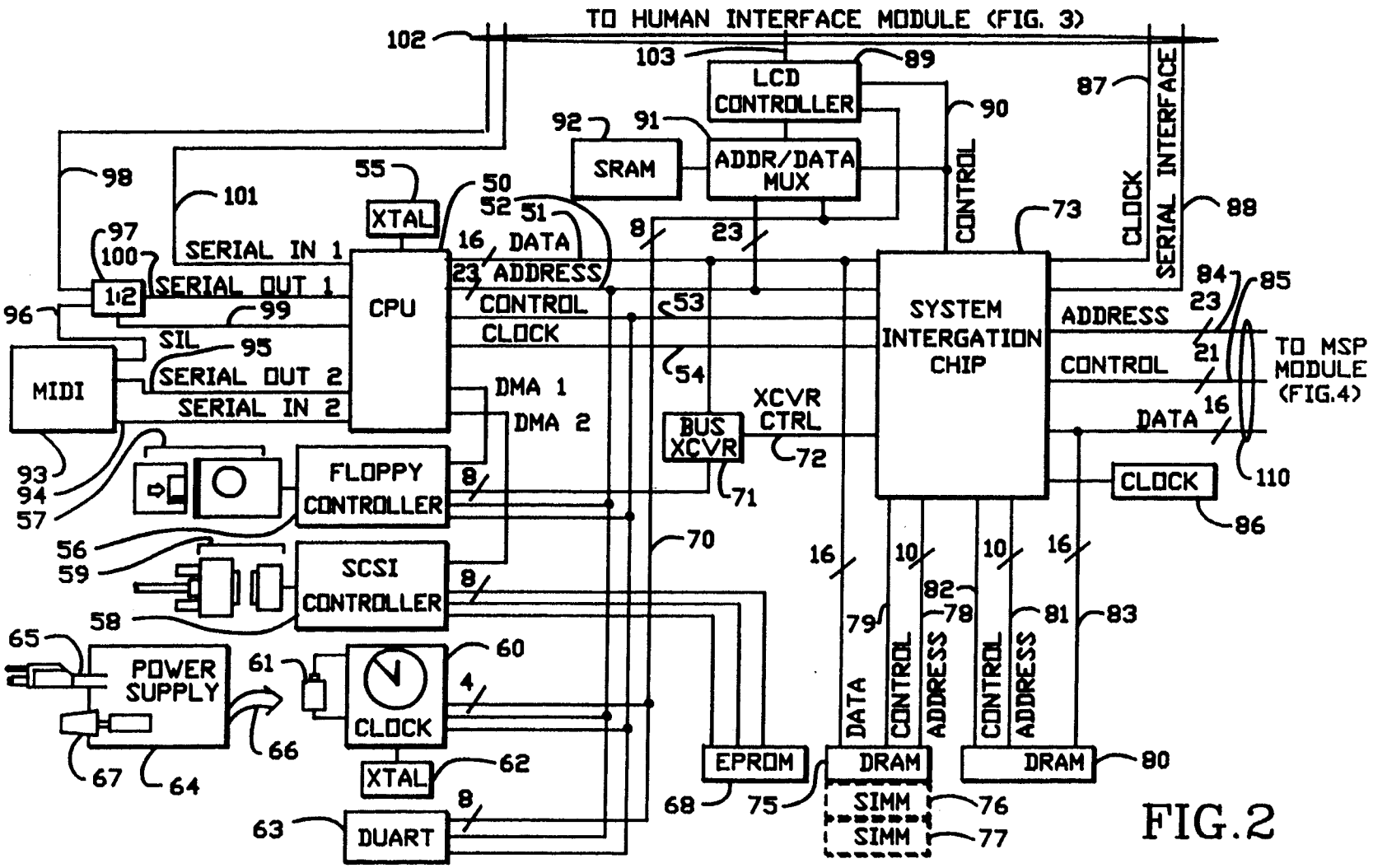
FIG. 2 is a hardware block diagram of a main central processing unit block for a system shown in FIG. 1.
Figure 3:
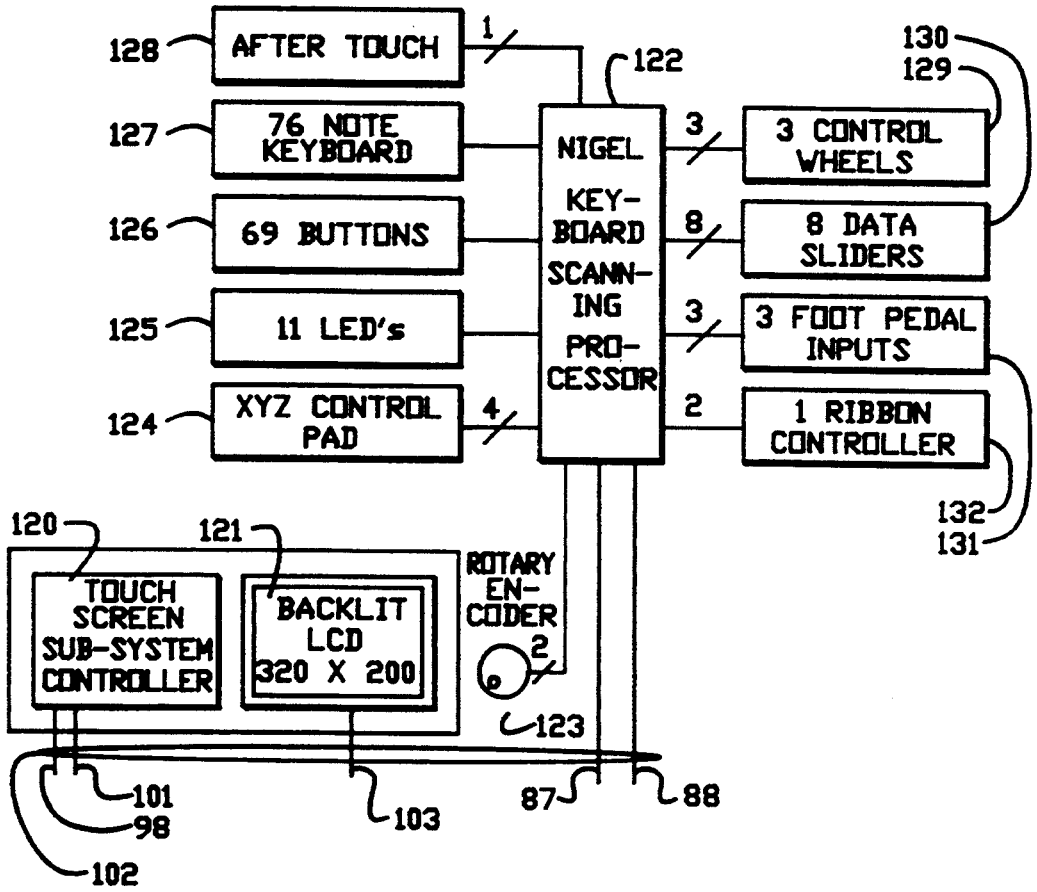
FIG. 3 is a hardware block diagram for a human interface block for use with the CPU shown in FIG. 2.
Figure 4:
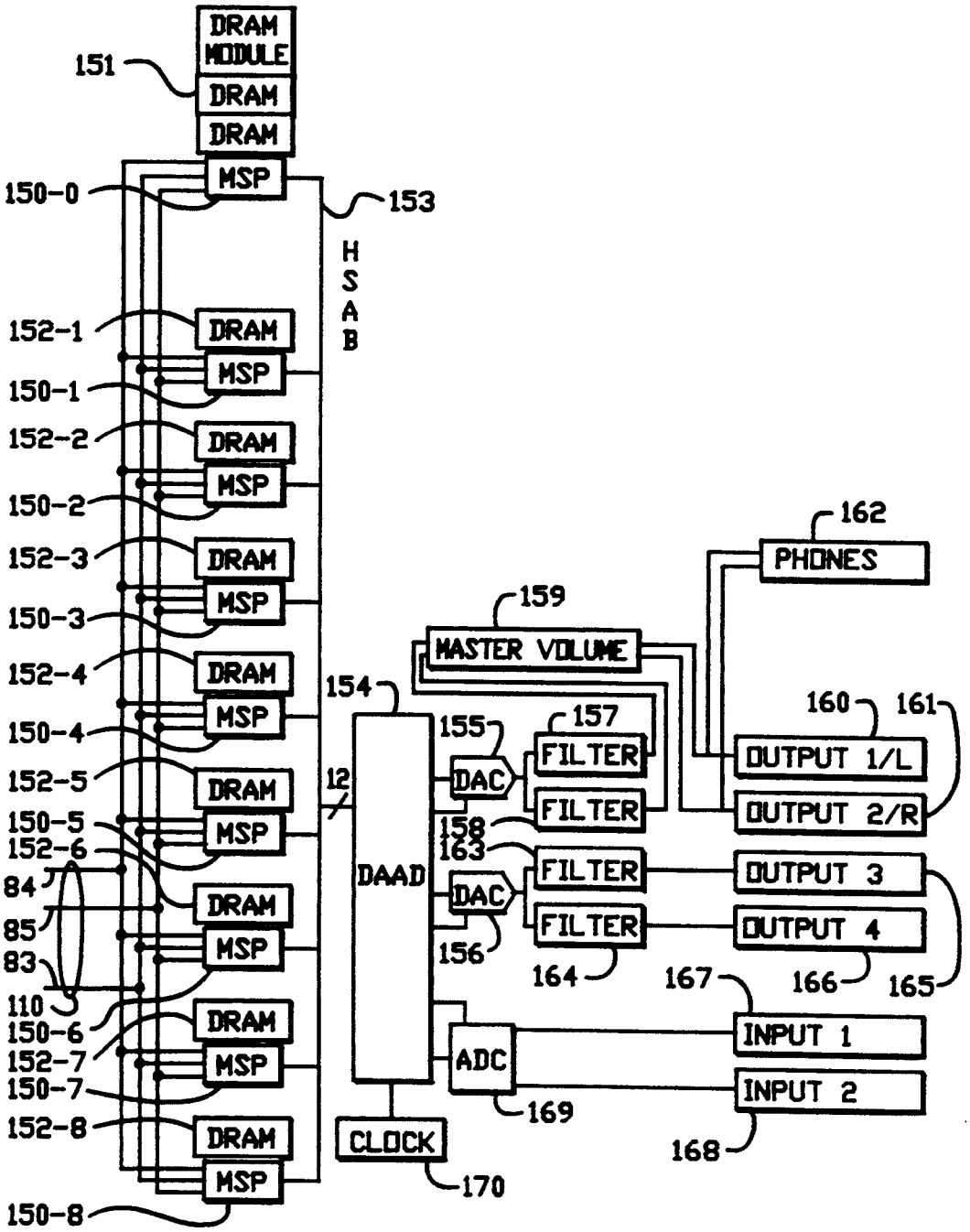
FIG. 4 is a hardware block diagram of a music signal processing (MSP) module and output structure for use with the system of FIGS. 2 and 3.

The host processor module 11, input device 10, and music signal processor module 12 of a preferred hardware system are described in detail with respect to FIGS. 2, 3 and 4, respectively.

FIG. 2 is schematic diagram of the host processor module with resources for dynamic voice allocation according to the present invention. The main CPU system consists of a microprocessor 50 such as a Motorola 68340 coupled to a 16 bit data bus 51 and a 23 bit address bus 52. Also control signals on line 53 and clock signals on line 54 are driven by the CPU 50. A crystal oscillator 55 is coupled to the CPU for providing reference for the clock signal 54.

The address, control, and data buses 51, 52, 53 are coupled to a floppy controller 56 and a floppy disk drive 57, to a SCSI interface controller 58 and a SCSI interface 59 and to a time of day clock chip 60. Time of day clock is connected to a battery 61 and a crystal 62 for providing clock reference. A DUART interface 63 is coupled to secondary data bus 70, the control bus 53 and the address bus 52 for use in as a debug interface.

Data line 51 is coupled to bus transceiver 71, which drives the secondary bus 70 for peripheral devices coupled to the main CPU 50. Transceiver control is supplied on line 72 from a system integration chip 73.

The system integration chip 73 also provides addressing logic, decoding logic, DRAM control, MSP windowing logic, interrupt management, MSP DMA logic, and LCD control to integrate the system as described in more detail with reference to FIG. 5.

A power supply 64 coupled to a wall outlet across line 65 supplies power throughout the system as necessary as indicated by arrow 66. Also an on/off switch 67 is coupled to the power supply. A program store 68 consisting of EPROM is also coupled to bus 70, control lines 52 and address lines 52 for use by the CPU 50.

A main system memory 75 consists of from 1 to 5 megabytes of DRAM with such expansion slots 76 and 77 as desired. The system memory 75 is coupled to the data bus 51, and to an address 78 and a control bus 79 which are driven by the system integration chip 73. An isolated memory bank 80 consisting of DRAM is also coupled to the system integration chip 73 by means of address lines 81 and control lines 82. Data is supplied on line 83 to the isolated memory 80 from the system integration chip 73. System integration chip 73 also generates address information on lines 84 and control information on lines 85 for supply together with data on line 83, to the MSP module of FIG. 4. Thus, a host interface 110 to the MSP module of FIG. 4 includes address lines 84, control lines 85 and data lines 83.

The system integration chip 73 is also coupled to a independent clock 66. System integration chip 73 also generates a clock signal on line 87 and drives a serial interface 88 providing for communication to the human interface module FIG. 3.

The main CPU block also includes hardware for serving the human interface module through connections 102. This hardware includes an LCD controller 89 which receives control information from the system integration chip 73 across line 90 and data from bus 70. The output of an address/data multiplexer 91 is supplied to the LCD controller 89. The inputs to the address-/data multiplexer 91 include the address bus 52 and the data bus 70. Also, the address and data multiplexer 91 is coupled to an SRAM 92 for use in driving the LCD controller 89. The LCD display memory on the human interface block is time multiplexed between the LCD controller 89 and the CPU 50. The LCD controller has priority over the CPU. If the CPU tries to access the LCD SRAM 92 at the same time as the LCD controller, the control logic generates wait states for CPU.

The CPU memory organization provides for main memory 75 and isolated memory 80. The isolated memory 80 is used for data that will be written to the MSPs using the DMA logic on the system integration chip 73. This data can be transferred to the MSPs while the main memory 75 is being accessed by the CPU 50. This memory access pipeline speeds up the initialization and downloading of voice programs to the MSPs.

The CPU 50 is also coupled to a MIDI port 93 across serial input line 94 and serial output line 95. An additional serial output line 96 is coupled to a 1 to 2 multiplexer 97 which drives a serial output line 98 or serial output line 96 with data from line 100 in response to a selection control signal line 99. The data on line 100 is driven by the CPU 50. Serial input line 101 is received by the CPU 50 from the human interface module of FIG. 3.

As can be see, an interface 102 to the human interface module of FIG. 3 includes a serial output line 98, a serial input line 101, an LCD control signal on line 103 from LCD controller 89, a clock signal on line 87, and a 4 bit serial interface on line 88.

FIG. 3 shows the human interface module coupled to the interface 102 of FIG. 2. The serial output on line 98 and serial input on line 101 are coupled to a touch screen sub-system controller 120 which overlays a backlit LCD array 121. The backlit LCD array 121 is driven by signals on line 103 from the LCD controller 89. Clock signals on line 87 are coupled to a keyboard scanning processor 122. Also, the keyboard scanning processor 122 drives serial interface 88. A number of input devices are coupled to the scanning processor 122 including a rotary encoder 123, an XYZ control pad 124, an array of LEDs 125, an array of buttons 126, a music keyboard such as a 76 note keyboard 127, an after touch detector 128, a set of control wheels 129, a set of data sliders 130, a number of foot peddle inputs 131, and a ribbon controller 132. The keyboard scanning processor performs all keyboard, front panel button, analog controller, and rotary encoder scanning. It also drives LEDs coupled with the buttons and a serial interface 88 to the system integration chip 73 in the main CPU block.

FIG. 4 illustrates the music signal processor module for use with the system of FIG. 2. The system includes an array of digital signal processors 150-0 through 150-8. Thus, there are 9 digital signal processors in the system described in FIG. 4. This configuration may be expanded or reduced as suits the needs of a particular application.

Each of the digital signal processors according to the preferred implementation of the present invention is a music signal processor MSP implemented as described with reference to FIG. 6 below. The MSP is a digital signal processor which has certain enhancements to support the dynamic allocation of voice programs according to the present invention.

The array of digital signal processors 150-0 through 150-8 are all coupled in parallel to the address lines 84, control lines 85 and data lines 83 on the host system interface 110.

Also coupled to each MSP 150-0 through 150-8 is a memory module. MSP 150-0 includes expanded memory module 151. MSPs 150-1 through 150-8 include standard memory modules 152-1 through 152-8. The plurality of MSPs 150-0 through 150-8 in the array are coupled to a high speed audio bus 153. The high speed audio bus is coupled to digital to analog and analog to digital interface 154. Outputs from the bus are supplied to one of two digital to analog converters 155 or 156. The output of digital to analog converter 155 is supplied to respective left and right filters 157, 158 through master volume control 159 to output jacks 160 for the left and 161 for the right. Also, a headphone jack 162 is provided at the output of the master volume control 159. The digital to analog converter 156 drives left and right outputs thought filters 163 and 164 to auxiliary outputs 165 and 166 respectively. Analog input signals are supplied on inputs 167 and 168 through an analog to digital converter 169 to the bus interface chip 154, for transmission on the bus 153 to a target MSP. Clock 170 drives the interface chip 154.

As can be seen, in the system including a main CPU block of FIG. 2, the human interface block of FIG. 3, and the music signal processing block of FIG. 4 provide a digital signal processor based music synthesizer which executes a group of voice programs stored in instruction memory of MSPs 150-0 to 150-8 and the memory modules 151 and 152-1 through 152-8 in real time. A set of voice programs are composed and stored in the isolated memory 80 which may be dynamically allocated to the memory modules in the MSP array of FIG. 4. The host CPU is used to compose voice programs or receive them from external sources, and load them into the isolated memory 80 for dynamic allocation. The host processing system also provides such support processing as necessary to handle MIDI standard interfaces, and control functions for the human interface block.

III. The System Integration Chip (SIC) (FIG. 5-1 and 5-2)

FIG. 5-1 and 5-2 provide a functional block diagram of the system integration chip SIC. The system integration chip has a host CPU interface generally at 500, a main non-isolated DRAM interface generally 501, an isolated DRAM interface generally 502, an MSP interface generally 503, a peripheral control interface generally 504, a serial interface generally 505, and receives error signals and interrupt signals generally 506 from the MSP array. It also generates clocks generally 507 for use in the system.

The CPU interface 500 is primarily coupled to CPU interface control block 508. Also, data from the CPU interface 500 is supplied on line 509 to transceivers 510 and to serial interface control and registers 511. The data is also supplied to DMA control registers 513. The chip includes address multiplexers 514 and non-isolated DRAM control 515 for the non-isolated DRAM interface 501. Also, address multiplexers 516 isolated DRAM control 517 and transceivers 510 supply such control, address and data as necessary for the isolated DRAM interface 502. Address multiplexers 518, MSP bus interface control logic 519 and MSP window register 520 are used to supply such address and control information as is necessary for the MSP interface 503. The SIC chip also generates an interrupt signal on line 512 for the CPU interface 500.

The MSP data from the isolated DRAM interface 502 is also coupled directly to the MSP interface 503 as illustrated in FIG. 2.

The SIC chip further provides peripheral bus control 521. A clock generation block 522 is responsive to the host system clock to generate the clock signals 507. An MSP interrupt register 523 receives interrupt data from the MSP array and supplies SIC interrupt logic 524 which drives the SIC interrupt signal 512. An SIC mask register 525 is used to mask unused interrupts. A refresh request logic 526 is used for refresh control of the DRAMs. The MSP-DRAM DMA controller 527 is coupled to the isolated DRAM control 517 and the MSP bus interface 519 for controlling DMA transfers into the isolated DRAM, and into the MSP interface. The DMA controller 527 is coupled to the DMA control registers 513 to generate CPU DRAM addresses for supply to the address multiplexers 516 for the isolated DRAM interface, and MSP addresses for supply to the address multiplexers 516 for the isolated DRAM interface, and MSP addresses for supply to the address multiplexers 518 for supply to the MSP interface 503. Also, mapped addresses are supplied by the CPU interface control to the address multiplexers 514, 516, and 518.

More details concerning the function of elements of the SIC are provided below.

A. The CPU Interface Control Block 508

The CPU interface control block 508 provides address decoding, external bus transceiver control, chip select generation, wait state generation, DSACK generation for the host CPU, address inversion for the chip select area 3 as described below, and bus error generation. It also provides control signals for the non-isolated DRAM control 515, the isolated DRAM control 517, the MSP bus interface control, and the peripheral bus interface control.

B. CPU Address Space Decoding

The SIC and the 68340 CPU chip select registers determine the system memory map. The CPU Interface Control 508 decodes the 68340 address bus using the ASL and CS0L–CS3L signals, and generates chip select and control signals for the DRAM and peripherals.

Each DRAM is tied to one of the four chip-select (CS) regions. That is, both the CS signal and the address bus must be active for the address to be decoded and the cycle to be performed by the SIC.

After system initialization, the system logical memory space is divided into four regions: read-only (CS2L), read/write (CS1L), virtual page (CS0L), and fast negative RAM (CS3L). The operations of these regions are controlled by registers in the 68340. For example, the read-only action is programmed in the 68350, and not in the SIC. The same is true for the virtual page areas, explained below.

Wait states for the peripheral devices are generated when necessary by the SIC based on the address decode.

1. BERRL (Bus Error) Signal Generation

The BERRL signal will be asserted by CAU interface control 508 in two situations: the ASL line is asserted and none of the CS0L–CS3L lines are asserted, or the CS1L line is asserted with improper address.

2. Chip Select Area Zero Operation

The 68340 global chip select, CS0L, is used for either the EPROM 68 or the virtual page chip select. When the 68340 begins fetching after reset; CS0L is asserted for every address until the module base address register is accessed. The 68340 signal PORTA0 and the PA0 signal input to the SIC determine which is selected. After reset, the PORTA0 signal is configured as an input pin. An external pull-down resistor on the PORTA0 pin will pull the signal low, selecting the EPROM. After system initialization is complete, the PORTA0 pin will be high to disable the EPROM and enable the virtual page chip select. See below concerning virtual page operation. When the EPROM is selected, the SIC responds with DSACKs for an 8-bit area. When the EPROM is selected, the SIC responds with DSACKs for an 8-bit area. When the virtual page mode is operating, the SIC responds to byte and word accesses.

3. Chip Select Area One Operation

This region is activated by the CS1L signal, and is assigned to the entire physical RAM and the area of physical memory used for hardware I/O operations. This includes the Floppy Controller 56, the SCSI bus controller 58, the Real time clock 60, the DUART 63, the LCD controller 89 and LCD display RAM 92, the individual MSPs and the MSP window area (in DRAM 80).

This region also contains the address decoding for most of the isolated and non-isolated DRAM within the system. A small, variable amount of the physical RAM is assigned to the CS2L region, explained below.

4. Chip Select Area Two Operation

This area is activated by the CS2L signal from the 68340 CPU. It contains the fast-negative RAM area, which can be accessed quickly due to the way the 68340 (and other processors) calculate indirect memory accesses. There is no logic in the SIC which makes the bus cycle "fast" or "negative". The time saved is only in the 68340's address calculations.

5. Virtual Page Operation

The virtual pages are to be used to implement a simple but effective overlay manager. The overlays are compiled to operate in one of the page regions in the 68340's logical address space. The overlays will each be coded to appear in one of the 64 KB logical page spaces, but are loaded from disk into the same physical space.

When the program tries to call a function/procedure/subroutine in an overlay not currently loaded, the address will be in some other (logical) page area. The SIC will assert the BERRL line, and the overlay manager software in the 68340 will be alerted.

The overlay manager will then remap the physical area to the needed logical page area by moving the address decode area for the CS0L signal. The new overlay is then retrieved from disk onto the page area, and the original program continues. This occurs each time a "page fault" occurs, and each time a (currently unloaded) overlay is needed.

C. CPU Bus Control

The CPU Interface Control 508 determines the port size and controls the termination of all 68340 external bus cycles. During a transfer cycle, the SIC signals the port size and indicates completion of the bus cycle to the 68340 through the use of the DSACK0L and DSACK1L outputs. Refer to the MC68340 Integrated Processor User's Manual and Technical Summary for more details on the 68340 bus operation.

1. Bus Transceiver Control

The CPU Interface control 508 generates control signals for the external bus transceiver 71 that can be connected between the 68340's primary data bus and the peripheral data bus.

D. CPU Interrupt Control

The SIC Interrupt Logic 524 provides one active-low, level sensitive hardware interrupt on line 512 to the 68340. The SIC also provides 9 external MSP interrupt request inputs to register 523, and three internal interrupt request sources. All are software maskable by the Interrupt Mask Register 525. The SIC provides internal pull-up resistors on the MSP interrupt request inputs. Following one or more interrupt requests, the SIC issues the SIC_IRQL signal to the 68340. The CPU determines the source of the interrupt by reading the SIC Interrupt Status Register. The MSP interrupt requests can only be cleared by reading the MSP status registers in the MSPs. The rest of the SIC interrupt requests are cleared by reading the SIC status register. SIC_IRQL remains asserted until all interrupt requests have been cleared.

E. EPROM Support

The 32K×8 CPU EPROM 68 interfaces directly to the 68340 address bus, global chip select (CS0L), and PORTA0 pin. When the EPROM is selected, the SIC returns DSACK0L within two wait states, providing a five-clock bus cycle access. The 68340 global chip select, CS0L, is used for both the EPROM and the virtual page chip selects.

F. DRAM Support

The SIC provides access and refresh control for the two areas of system DRAM 75, 80. The basic configuration consists of 1 MB DRAM for CPU operating system code (non-Isolated DRAM 175) and 1 MB for MSP programs and data storage (isolated DRAM 80). The SIC provides for expansion of the non-isolated DRAM for a total of 5 MB. The SIC provides separate control, and address buses for each of the two areas of system DRAM. The SIC DMA controller 527 provides DMA transfers from the system isolated DRAM to the MSP internal and DRAM areas. This allows the CPU to operate at full speed during downloads to the MSPs.

1. Non-Isolated DRAM Controller

The Non-Isolated DRAM controller 515 supports both CPU and refresh cycles. The SIC provides all control signals required for the 68340 CPU to read or write data with zero wait states (three-clock bus cycle). The SIC supports both 8 and 16-bit CPU accesses to the system DRAM.

DRAM refresh is accomplished by means of a CAS before RAS refresh cycle, refreshing all three rows of non-isolated DRAM simultaneously. The DRAM controller executes a refresh cycle after any current bus access once a request is generated by the DRAM refresh counter. In the non-isolated memory area, refresh has the highest priority. If a CPU cycle is in progress when a refresh request is generated, the refresh controller will wait until the current cycle is finished. The refresh cycle will then be performed. If the CPU requests access to the non-isolated RAM while the refresh cycle is operating, it must wait until the refresh cycle is finished.

2. Isolated DRAM Controller 517

The isolated DRAM controller 517 supports CPU, refresh, and DRAM-to-MSP DMA cycles.

A CPU access to the isolated DRAM is identical to an access to the non-isolated DRAM. The MGC provides all control signals required for the 68340 CPU to read or write data with zero wait states (three-clock bus cycle). The MGC supports both 8 and 16-bit CPU accesses to the system DRAM.

DRAM refresh is accomplished by means of a CAS before RAS refresh cycle. The DRAM controller executes a refresh cycle when a refresh request is generated by the DRAM refresh counter. In the isolated memory area, refresh has the highest priority. If a CPU or DMA cycle is in progress when a refresh request is generated, the refresh controller will wait until the current cycle is finished. The refresh cycle will then be performed. If the CPU or DMA requests access to the isolated RAM while the refresh cycle is operating, it must wait until the refresh cycle is completed.

The isolated DRAM controller also provides access to the isolated DRAM by the MGC's DMA controller. CPU bus requests have priority over DMA controller bus requests.

G. DRAM Refresh Control 526

DRAM refresh generation logic 526 uses a CAS before RAS refresh cycle. The MGC DRAM refresh controller 526 consists of a counter that requests refresh cycles. The RAM must receive 1024 refresh cycles in no more than 16 milliseconds. The non-isolated and isolated DRAM controllers service the request by performing a refresh cycle. It is suggested that the refresh requests should be staggered so that isolated DRAM refresh cycles and non-isolated DRAM refresh cycles do not occur simultaneously.

H. MSP Bus Interface 503

The MSP bus interface 503 is driven by address multiplexer 518, control 519, and the MSP window register 520, to provide CPU and DMA access to up to 9 MSPs. The SIC decodes the 68340 address, control, and chip select signals, and generates the MSP address, chip enables and command strobes to the MSPs. The MSPs insert wait states into the bus cycle by asserting their $MSP_{13}$ WAITL signals. The MGC terminates the 68340 bus cycle by asserting the DSACK1L signal after all the MSP WAITL signals go high, or after a specified number of clocks (16 MHZ) if no $MSP_{13}$ WAITLs are asserted. The MGC supports only 16-bit accesses to the MSPs. Because the MSP data bus is isolated from the 68340 and peripheral buses, the CPU is able to access the non-isolated DRAM and peripherals during DMA transfers to/from the MSPs.

The CPU has higher priority when requesting bus access and can preempt DMA transfers to access the MSPs. The $DMA_{13}$ CPUL signal is provided for easy transition between DMA and CPU accesses to the MSP internal areas.

I. MSP Windowing

The SIC windowing function provides simultaneous write access to multiple MSPs. For each MSP a corresponding bit in the CPU-MSP Window Register 520 or the DMA-MSP Window Register 520 determines if that MSP is to be accessed. When the CPU or DMA controller accesses the MSP "window area" the corresponding chip enable is asserted for each bit set in the CPU- or SMA-MSP window register 520.

A bus cycle to multiple MSPs is completed after all MSPs have completed the write, and release the wired-or $MSP_{13}$ WAITL signals. The MSP "windo area" is write only. If a read access is attempted, all zeroes are returned.

J. Isolated DRAM-to-MSP DMA Controller 527

The SIC DMA control 527 supports DMA transfers between the 68340 Isolated DRAM 80 and the MSPs' DRAM and internal memory and register space. The MSP windowing function is also supported for multiple MSP write accesses. DMA reads from the MSP "window" (section H. above) are not supported, but DMA reads from a single MSP are. The DRAM and MSP address buses are separated, so that a complete DMA transfer only takes one bus cycle to complete. The DRAM read (write) and MSP write (read) occur simultaneously. The SIC DMA controller only supports 16-bit word transfers.

DMA transfer operation is determined by the DMA controller Registers 513 as defined below. Before starting a DMA transfer, the CPU must initialize the DRAM Address Register, MSP Address Register, Word Transfer Count Register, the DMA Control Register, and the appropriate pointer registers in the MSP. The DMA transfer is started by setting the ST bit in the DMA Control Register. DMA requests are generated internally whenever the word transfer count is greater than zero. No external requests are required or supported. The cycle length is extended by the $MSP_{13}$ WAITL input to the SIC. When the DMA transfer is complete (word transfer count equals zero), the SIC clears the ST bit in the DMA Control Register and sets the DTC bit in the SIC Interrupt Status Register, and if enabled, asserts the SIC_IRQL signal to the 68340. This interrupt is software maskable by the SIC Interrupt Enable Register.

The DMA controller 527 can be programmed to perform auto-increment or constant-address movements. The DRAM address can increment or remain constant, and the MSP address can increment or remain constant. During DMA transfers, the flow of data can be preempted for CPU access or refresh. The refresh has highest priority. That is, if a refresh cycle is requested, it will begin first, and the DMA and/or CPU will be made to wait until it is finished. The next lower level or priority is given to the CPU. That is, if the CPU is requesting access to the isolated DRAM or an MSP, the next available (no refresh) bus cycle will be given to it in preference over any DMA accesses being requested.

K. Peripheral Support

The Peripheral Bus Control 521 provides chip select and read and write strobes for the peripheral devices that operate on the CPU bus.

L. Clock Generation 522

The clock generation logic 512 generates 16 MHz, 8 MHz, 4 MHz, and 500 KHz square-wave clock outputs from a 32 MHz oscillator input. The SIC provides the 68340 CPU and TC8569AF (R) Floppy Disk controller with a 16 MHz clock input. The 8 MHz clock is provided for the keyboard processor in the user interface module and the SCSI controller, and the 4 MHz clock is provided for the LCD controller. The SIC also provides a 500 KHz clock output for the 68340 serial clock input to generate the MIDI clock. All clocks are generated synchronously to avoid system problems with clock skew between the various peripherals receiving them.

M. Serial Data Interface 511

The serial interface and registers 511 provide a four-wire serial data interface for communicating with the keyboard processor.

N. SIC Register Definitions

1. SIC Interrupt Status Register

Figure 5A:
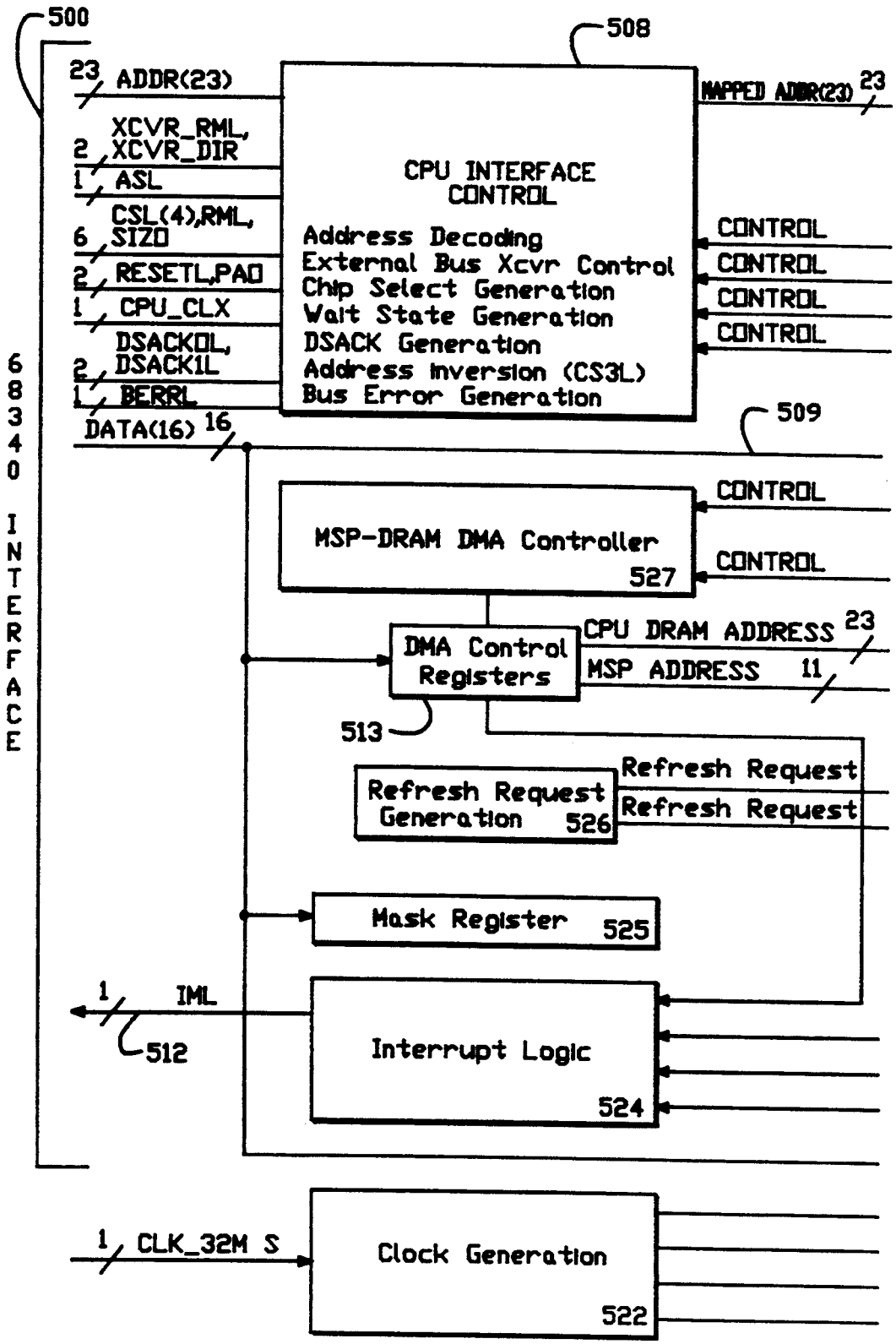

The SIC Interrupt Status Register shown in FIGS. 5A provides the status for all MSPs, HSAB contention, serial interface and DMA interrupt sources. The bits of this register are masked by the SIC Interrupt Enable Register for generation of SIC_IRQL signal to the 68340. If a bit in the SIC Interrupt Status Register is set, and the corresponding bit in the SIC Interrupt Enable Register is set, then the SIC_IRQL output is asserted. The SIC Interrupt Enable Register does not mask the reading of this register. SI, CNT, and DTC are latched, and are cleared by a CPU read of this register. All Mn bits reflect the state of the MSP_INTL(9 . . . 1) pins, and can only be cleared by clearing the Interrupt status registers in the MSPs. (Addr $00).

Mn-MSP #n Interrupt bit
- 1=MSP #n interrupt was received.
- 0=MSP #n interrupt was not received.

SI-Serial Interface
- 1=Serial Interface data transfer request was received.
- 0=Serial Interface data transfer was not requested.

CNT-HSAB Contention Error
- 1=HSAB Contention detected.
- 0=HSAB Contention not detected.

DTC-DMA Transfer Complete
- 1=DMA Transfer completed successfully.
- 0=DMA Transfer not completed.

Each of the interrupt sources has the same priority. Any of the enabled sources will generate an interrupt.

2. SIC Interrupt Enable Mask Register 525

Figure 5B:
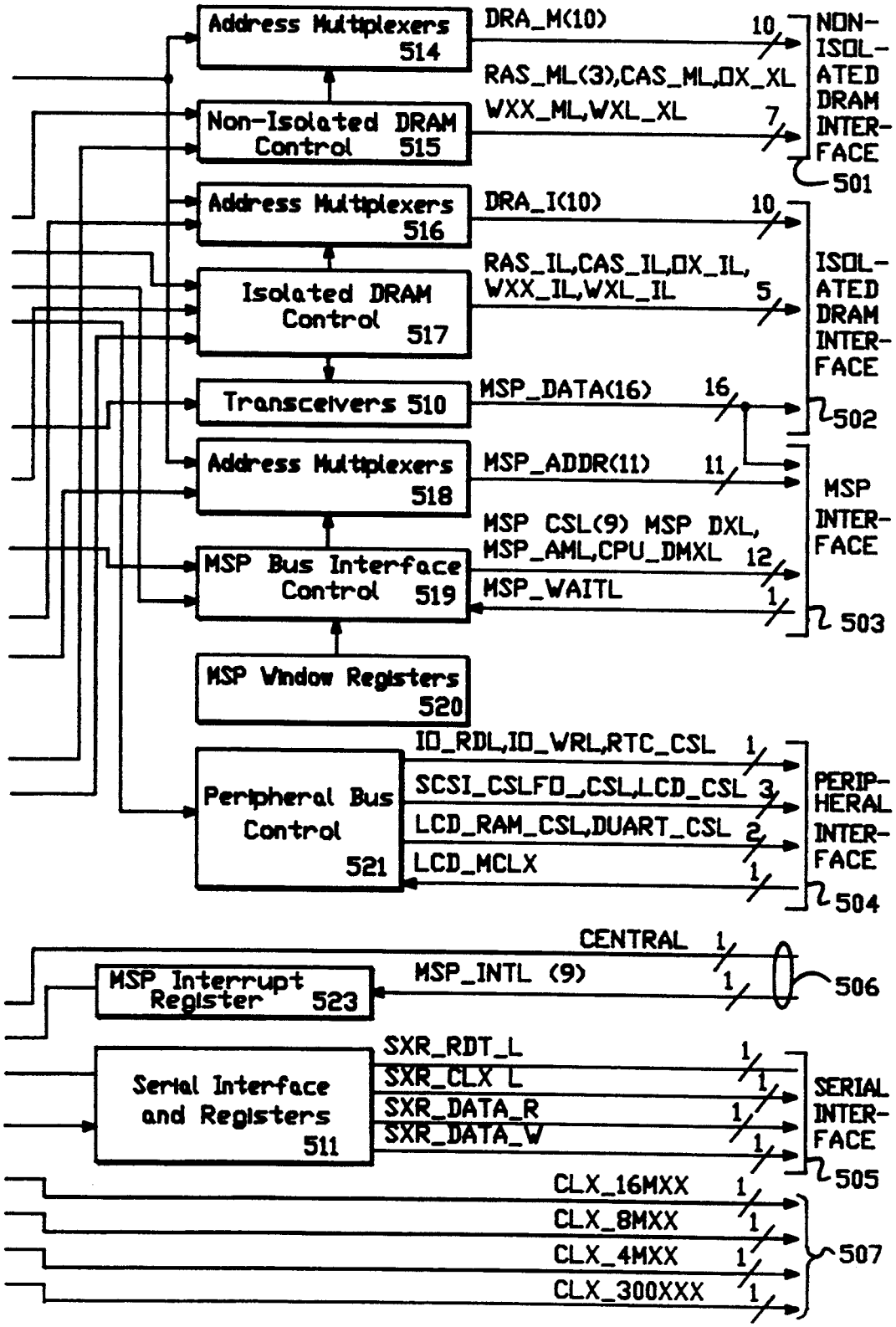

The SIC Interrupt Enable Register shown in FIG. 5B selects the corresponding bits in the SIC Interrupt Status Register that cause an interrupt (SIC_IRQL) to the CPU. If one of the bits in the SIC Interrupt Status Register is set, and the corresponding bit in the SIC Interrupt Register is set, then the SIC_IRQL output is asserted. If a bit in the SIC Interrupt Enable Register is cleared, then the state of the corresponding bit in the SIC Interrupt Status Register does not effect the SIC_IRQL output. (Addr $02).

Mn-MSP #n Interrupt Enable bit
- 1=MSP #n interrupt enabled.
- 0=MSP #n interrupt disabled.

SI-Serial Interface Interrupt Enable bit
- 1=Serial Interface interrupt enabled.
- 0=Serial Interface interrupt disabled.

DTC-DMA Transfer Complete Interrupt Enable bit
- 1=DMA Transfer Complete interrupt enabled.
- 0=DMA Transfer Complete interrupt disabled.

3. DMA Control Register 513

The DMA Controller Register shown in FIG. 5C determines the operation of the SIC's DMA controller. (Addr $04:).

DAI-DRAM Address Increment/Constant Bits
- 1=The DRAM Address Register is incremented by 2 after 16-bit word transfer.
- 0=The DRAM Address Register is not incremented after a transfer. The DRAM address that is written into the DMA DRAM Address Register is used for the complete DMA transfer.

MAI-MSP Address Increment/Constant Bit
- 1=the MSP Address Register is incremented by 2 after each 16-bit word transfer.
- 0=The MSP Address Register is not incremented during operand transfer. The address that is written into the DMA MSP Address Register is used for the complete data transfer.

4. DMA MSP Address Register

The DMA MSP Address Register as shown in FIG. 5D contains the address of the MSP operand used by the DMA to access the MSP areas. The 16-bit address specified is the offset from the MSP space base address ($780000). This register can be programmed to increment or remain constant after each operand transfer. (Addr #06).

5. DMA DRAM Address Registers

The DMA DRAM Address Registers shown in FIGS. 5E and 5F contain the 23-bit address of the DRAM operand used by the DMA to access the isolated DRAM. These two 16-bit registers can be programmed to increment (by two) or remain constant after each operand transfer. (Addr $08 and Addr $0A). Address bit A[0] is not needed since it is always 0, and since the valid address range for DMA DRAM addresses is $60 0000 to $6F FFFF, address bits A[20 . . . 22] are always binary 110, and are also not needed. The unneeded bits should be hardwired internally to their fixed values as indicated in FIGS. 5E and 5F.

6. DMA Word Transfer Count Registers

The DMA Word Transfer Count Registers shown in FIGS. 5G and 5H contain the 19-bit number of 16 bit words to transfer using DMA. This 32 bit register field is decremented by one after each word transfer. When the DMA Word Transfer Count register becomes zero, the DTC bit in the SIC Interrupt Status Register is set, and the transfer is considered "complete." If enabled, the SIC_IRQL input to the 68340 is asserted. When read, this register contains the count for the next access. When the most significant word is read (address $0C), the least significant word (address $0E) is latched. (Addr $0C and Addr $0E).

7. CPU-MSP Window Register 520

The CPU-MSP Window Register shown in FIG. 51 determines the MSPs accessed when the CPU accesses the MSP "windo area". (Addr #10).

Mn-Select MSP #n bit
- 1=MSP #n selected.
- 0=MSP #n not selected.

8. DMA-MSP Window Register 520

The DMA-MSP window register shown in FIG. 5J determines the MSPs accessed when the DMA controller accesses the MSP "window." (Addr #12).

Mn-Select MSP #n bit
1=MSP #n selected.
0=MSP #n not selected.

9. Serial Data Register 511

The Serial Data register shown in FIG. 5K stores the data received and transmitted on the serial interface. D<0 . . . 7> are the data bits. (Addr $14).

IV. The Music Signal Processor (MSP) (FIGS. 6 and 6A–6E)

Figure 6:
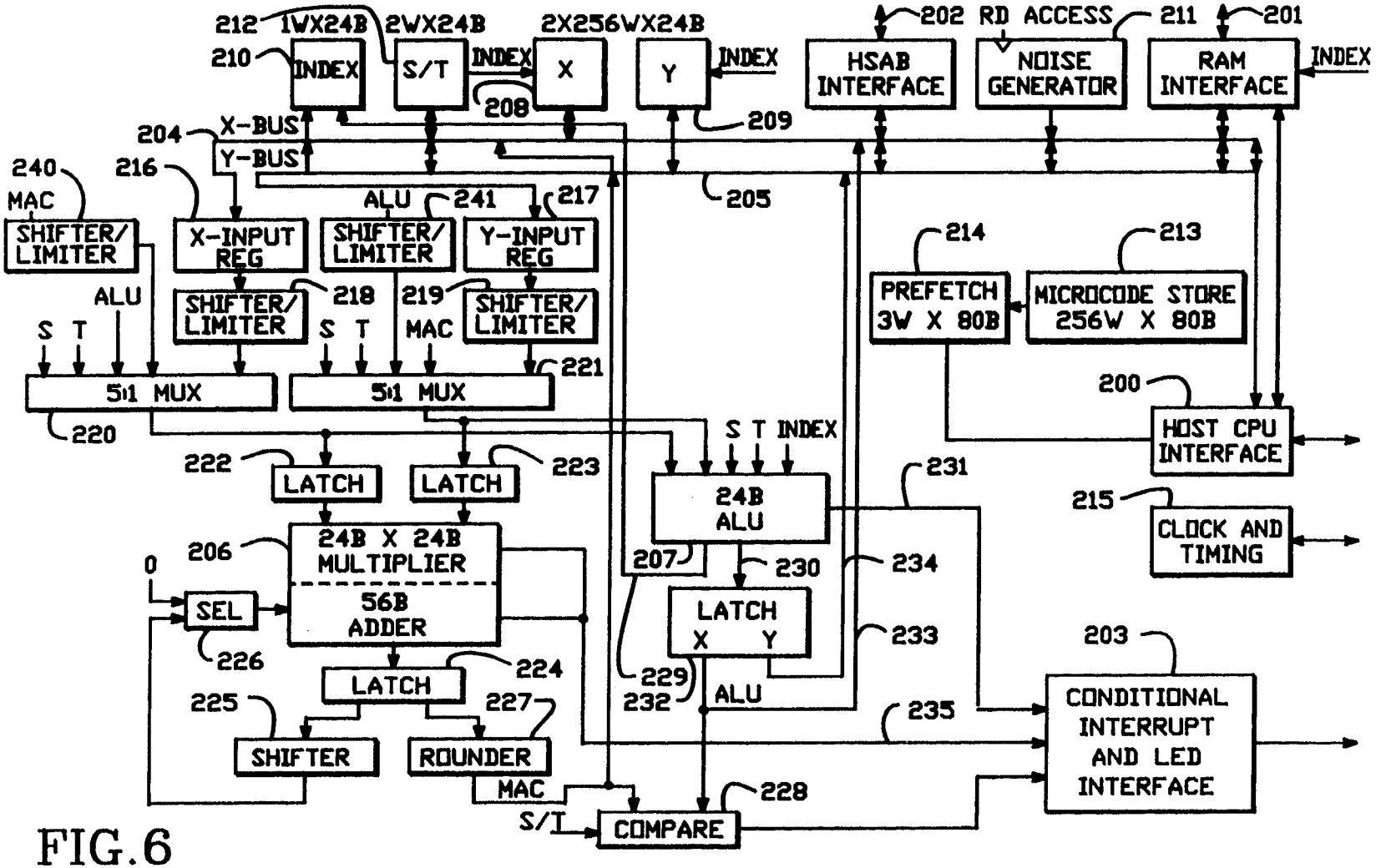
FIG. 6 is a functional block diagram of an individual music signal processor in the system of FIG. 4.

FIG. 6 illustrates a functional block diagram of the music signal processor MSP. FIGS. 6A through 6E illustrate respective functional aspects of the MSP.

The MSP as shown in FIG. 6 operates in a host programmed environment, with multiple MSPs performing multitimbral music synthesis. The MSP contains specialized interfaces, including a host interface 200 a local RAM interface 201, and a high speed audio bus HSAB interface 202.

The host interface block 200 supports access to all internal areas of the MSP chip, that is the host can read and/or write all internal configuration, status and data registers transparent to the MSP's operation. The MSP also contains a conditional interrupt and LED interface 203 which includes at least two interrupt registers identifying which of a set of 32 possible interrupts require processing.

The RAM interface 201 supports dynamic RAM of up to 16 mega words of 24 bits. The high speed audio bus interface 202 provides 128 channels of transparent data flow among the MSPs, and allow algorithms to be spread across multiple MSPs for higher processing power.

The system includes two basic internal buses, including the X bus 204 and the Y bus 205. The primary processing resources include a 24×24 bit multiplier merged with a 56 bit accumulator (MAC 206), and an arithmetic logic unit ALU 207. The MAC 206 and ALU 207 share input latches, shifters, limiters and multiplexers which provide the inputs to the processing resources as described in more detail below.

The chip also includes two internal memory arrays referred to as the X memory 208 and the Y memory 209. Each the X memory 208 and Y memory 209 are 256 words of 24 bits each consisting of single port static RAMs. The X memory bank is a linearly indexed register array, while the Y memory bank includes segments using linear or circular addressing schemes.

The high speed audio bus interface 202 includes a register array of 64 words of 24 bits each implemented with static RAM. The host programs the mapping registers in the highspeed audio bus interface 202 to indicate which of the 128 times lots the local MSP will utilize on the high speed audio bus 202.

The system also includes an index register 210 which provides for indirect addressing into the X and Y memory spaces and into the RAM space provided the RAM interface 201.

Other components of the MSP includes a noise generator 211 which is coupled to the X bus 204 and the Y bus 205, and S/T register 212 also coupled to the X bus 204 and Y bus 205.

A microcode store 213 which is readable and writable by the host, and a prefetch buffer 214 coupled to the microcode store 213 and to the host CPU interface 200 are included. General chip clock and timing control 215 are integrated on the chip.

The data paths for MAC 206 and ALU 207 include an X input register 216 coupled to the X bus and a Y input register 217 coupled to the Y bus. The output of the X input register 216 and Y input register 217 are supplied to respective shifter/limiters 218, 219. The outputs of the shifter/limiters 218, 219 are supplied as inputs to 5 to 1 multiplexers 220 and 221 respectively. The other inputs to the 5 to 1 multiplexers include the value in the S register 212, the value in the T register 212, the output of the ALU 207, the output of the MAC 206. The MAC signal at the input of multiplexer 220 is supplied through shifter limiter 240. The ALU signal at the input of multiplexer 221 is supplied through shifter limiter 241. The outputs of the 5 to 1 multiplexers 220 and 221 are supplied into MAC input latches 222 and 223 respectively and directly as inputs the ALU 207. The output of the MAC input latches 222 and 223 are supplied into the MAC 206. The output of the MAC 206 is supplied to latch 224. The output of latch 224 is supplied to shifter 225 which is fed back through selector 226 to the MAC 206. The lower bits of latch 224 supplied to rounder 227. The output of the rounder 227 is coupled to the X and Y buses 204, 205, and to a comparator 228. Inputs to the comparator also include the values in the S and T registers 212.

The ALU 207, in addition to receiving the output of multiplexers 220 and 221, receives the value of the S register 212, the T register 212 and the index 210 as inputs. The ALU 207 generates an index output on line 229, and logic output on line 230, and a control output on line 231. The logic output on line 230 is supplied to latch 232, which drives the X bus on line 233 and the Y bus on line 234. The value on the X ALU output bus 233 is also supplied to the comparator 228.

The output of the comparator 228, control output on line 235 from the MAC 206, and the control output on line 231 from the ALU 207 are also supplied to the conditional interrupt and LED interface 203.

The X bus 204 and Y bus 205 carry operands among the data storage and processing blocks within the MSP. The buses are logically continuous, but there are pass transistors isolating some of the I/O functions from the main register bank, ALU, MAC buses.

A. Internal Timing Allocation

Timing of the MSP and the system it operates in are derived from the sample rate of the audio outputs. The MSP is intended to operate in a system operating a 48 KHz sampling rate, providing 512 microcode steps per system cycle. Each instruction cycle can include one register access on each of the X and Y buses and either a MAC or ALU operation. The ALU and MAC are separate, and can operate on independent data. They share the X and Y buses and the input multiplexers, so that only one MAC or ALU operation may be started per instruction cycle. The microcode must coordinate data movement among the register blocks, the HSAB, RAM, etc.

The microcode decode (not shown) includes a normal decode and special decode. The normal decode allows one register access on each of the X and Y buses to occur simultaneously with an ALU 207 or MAC 206 operation in one instruction cycle. The special decodes include the CONDITIONAL INTERRUPT and LED opcodes for interface 203. When a special decode instruction is executed, register accesses may not occur during the same instruction cycle because the input select field and the address fields are used for decoding the special decode instructions.

The ALU 207 can perform one calculation per instruction, and the MAC 206 can perform one calculation every two instruction cycles. Since the ALU 207 and MAC 208 both can receive inputs from themselves or each other, it is not always necessary to write the results into a register or RAM. In fact, write-back requires a separate instruction to be performed. Those instructions that result in an idle X or y bus can be utilized by Host Accesses through interface 200.

B. Clock and Timing

The clock and timing block 215 is responsible for generating the current microcode address, and updating it according to the current operational mode. The MSP can be halted, single stepped or allowed to free run. The Host can start the MSP at any time, but execution does not actually begin until the next synchronization pulse is received through the HSAB interface.

The MSP can be halted and single-stepped through software or hardware. There is a bit in the configuration register that controls that the run/halt state of the MSP, and there is a pin on the MSP package that also controls this. When the external signal is low, the MSP will be halted regardless of the register bit. When the external signal is high, the MSP will begin running after the register bit is set to one. When the external signal is high, if the register bit is cleared, the MSP will be halted. The register bit is reset (0) after hardware reset. Once the external signal and the register bit are both high, the MSP will begin execution on the first SYNC pulse received. When the MSP is halted, it continues to operate the high speed audio bus interface 202 and the CPU can read and write registers or the Ram areas memory interface 200.

When the MSP is halted by either internal or external means, the single step pin and register bit allow it to single-step for debugging purposes. A rising edge on the external step pin will cause the MSP to move one instruction further. This will only occur at the appropriate time. For instance, if the MSP is halted, pending execution of instruction number 95 when it receives a single-step command, it will wait until the time in the cycle that normally would have executed the step number 95. That single instruction will then be executed. After execution, the single step register bit will be reset to zero.

The CPU (FIG. 2) under normal operating (running) conditions must access the RAM area and internal X- and Y-buses in competition with the MSP. Since RAM access occur over more than one MSP instruction time, and internal cycles occur in less time than one CPU cycle, the MSP must be able to determine when there is sufficient time for the CPU to perform its access. To accomplish this, the MSP has a six-instruction prefetch queue 214. To fill this queue the CPU must allow at least 20 microseconds between when it loads the microcode at location zero and when it sets the run/halt bit. This will allow the MSP to fill its prefetch queue with the new instructions, and be ready to begin execution on the next SYNC pulse. This is also the case during single-stepping.

The program counter (PC) of the MSP is a synchronous 9-bit counter. There are actually two counters (one 9 bits, one 8 bits). The main (9 bit)) counter indicates which microcode step is actually executing. This is used for single-step triggering, and other functions which must know the exact instruction number. The second (8 bit) counter generates the addresses required for the microcode RAM to be read into the prefetch queue.

When the MSP is halted, the MSP does not perform any X or Y bus accesses, so the CPU can access the MSP's internal registers without wait-states. Before the Host sets the RUN/HALT bit, or single-steps the MSP, all host accesses should be completed i.e., if a host DMA RAM access is started, and the MSP's RUN/-HALT bit is set before the access is completed, the results of the MSP's operation and the DMA operation are indeterminate.

C. Host CPU Interface

The host interface 200 allows the host processor to read and/or modify the internal registers of the MSP, and control its operation and configuration. It is the primary interface for setting the interrupt and control registers, as well using the RAM port 201, the HSAB port, and all the internal MSP registers. The Host interface 200 must contend for the X and Y buses 204, 205 with the ALU 207 and other internal blocks. For this reason, the host interface 208 inserts wait states into a CPU cycle until the desired action can be accomplished. For example, a write to the X register area 208 that begins while the ALU 207 is using that area will generate host wait states until the write by the host can be accomplished.

The host does not have to poll a 'ready' bit, and the bus arbitration inside the MSP is done transparent to the Host CPU access, allowing faster and simpler access to internal data. The control and configuration registers don't generate wait states to the host, nor do several other conditions of reading and writing. With this method of wait state generation, it is possible to write to multiple MSPs with the same CPU bus cycle. This is done by wire-or'ing the wait state signals together, and generating simultaneous chip select signals. This is actually a function of the system integration.

Figure 6A:
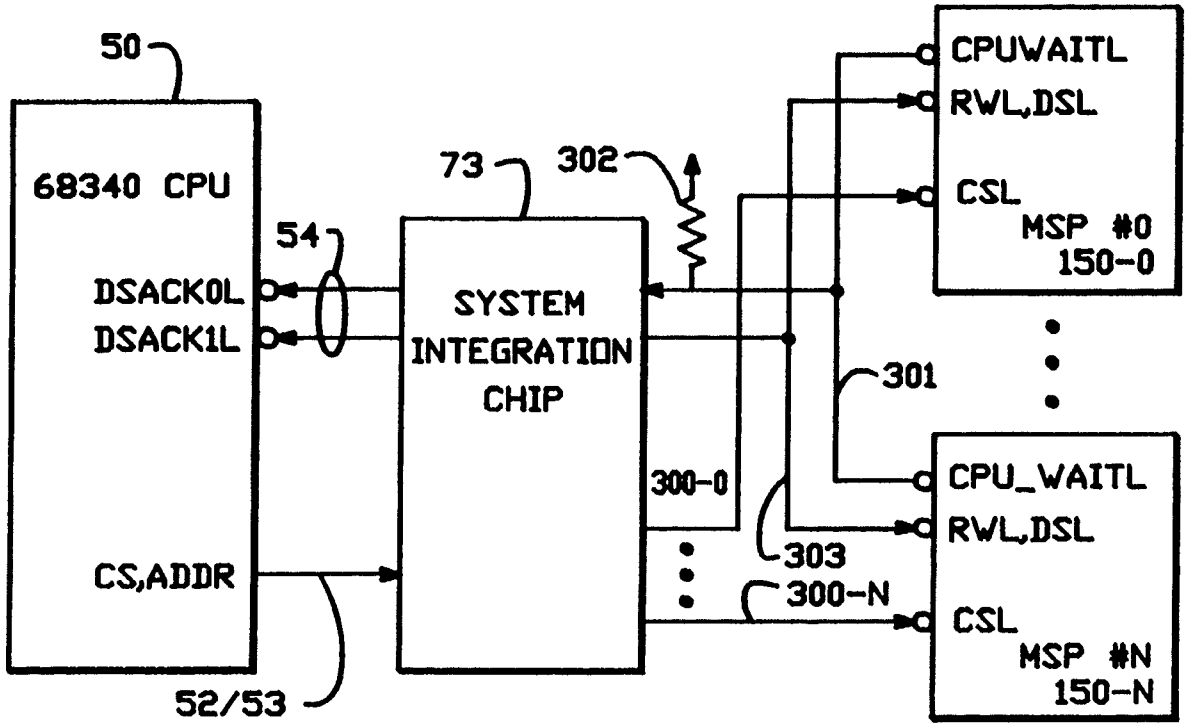
FIG. 6A is a block diagram showing the MSP windowing scheme.

FIG. 6A illustrates the MSP windowing scheme which allows writing the multiple MSPs in parallel. Thus, FIG. 6A shows the host CPU 50, coupled to the system integration chip 73. System integration chip 73 receives chip select and address signals across lines 52/53, and receives control signals from the system integration chip 73 including the acknowledge signals 54. The system integration chip 73 drives a plurality of chips select signals 300-0 through 300-N to respective MSPs, MSP 150-0 through MSP 150-N.

The MSPs generate CPU wait states on active low line 301 having a passive pull-up 302. Also, the CPU supplies the read, write, and data strobe signals in parallel on active low line 303. This configuration causes transfers of data to the MSP data bus to be loaded in parallel to all MSPs having asserted chip select signals.

The CPU interface appears to the CPU as a 16-bit space of addresses, 2K words long. This entire space is not used, but the mapping allocates the full 2K. The Host interface block 200 performs all the packing and unpacking of MSP-sized words (16, 24, 56 and 80 bits) into one or more 16 bit words for the CPU to access. The data is latched internally when read or written.

This allows the CPU to encounter to wait state only for the first word read, or the last word written in an access. The host CPU interface also performs all of the access decoding within the MSP for access to internal registers and ports.

The BIGENDIAN input pin determines the operation of the host-word to MSP-word data packing/unpacking. When this pin is a logic 1, the MSP registers are mapped as in a Big-Endian architecture, i.e., the lower addressed word of a double word is the most significant word. When this pin is a logic 0, the MSP registers are mapped as in a Little-Endian architecture, i.e., the lower addressed word of a double word is the least significant word.

The main components required to accomplished the host interface 200 include:

Host Read/write port
Host-Word to MSP-Word data packing/unpacking
Host Address decoding
Host Wait State Generator
Host write- and read-through control & timing D. Conditional & Interrupt Interface 203

There is always a need to alert the host processor that some condition requires its attention, and there is always a need for conditional execution of program code. The MSP provides both through interrupts and execution flags. Execution flags are further divided into normal if-then-else operation, and a special no-op function most often used when downloading microcode blocks.

The MSP chip is designed to provide up to 32 sources of interrupts to the host CPU. These can be generated by any of the 512 MSP instructions. The Host CPU is alerted to an interrupt when any of the non-masked interrupts are triggered. This occurs when an INT (#, <condition>) instruction is executed, if the condition indicated is true, the interrupt bit # specified is set. If this bit is not masked, the interrupt signal is set low. The host then reads the interrupt request registers to determine which of them require processing. When an interrupt request registers to determine which of them require processing. When an interrupt request register is read by the CPU, all the triggered interrupts in that register are cleared. An interrupt (#, <condition>) instruction, where the condition is one of the latched bits (ALU LATCHED OVERFLOW, MAC CLIPPED), also clears the corresponded latched bit. The host can mask any of the interrupts writing to the interrupt mask registers. All interrupts can be disabled and cleared by writing a "1" to the corresponding bit in the interrupt request registers. At reset, all interrupts are masked.

The MSP also provides a method for conditional code execution. There are two execution flags in the MSP: the if-then-else flag, and the no-op flag. The flags' states can be either true or false. The if-then-else flag's state is affected by three sources. When code is operating in the MSP, if this flag is set false, all instructions to be executed while the flag is false are prevented from writing any results back to RAM or any other destination. This continues until something resets the if-then-else flag. This allows the MSP to maintain synchronization with the rest of the system while providing conditional code execution.

The if-then-else flag can be set by the state of conditions within the ALU or MAC. FIG. 6B illustrates the operation the if-then-else flag. The figure schematically illustrates the MSP microcode 310. A segment of the MSP Code 311 includes a sequence of instructions 312 through 318. The execution flag value at the end of each instruction takes the state indicated in column 319 if the condition is true, and takes the state indicated in column 320 if the condition is false. "C" code for instructions 313 through 317 is provided on the outside of the column 320 for reference.

The MSP code 311 includes a first operation in line 312. For this operation, the state of the execution flag will be true independent of any conditions. For a conditional routine, which is illustrated in the C code "if <condition> then", the first instruction is provided on line 313 which sets the execution flag on satisfaction of the condition. Thus, if the condition is true, as indicated in column 319, the execution flag will remain true. If the condition is false as indicated in column 320, the execution flag will be reset false. This results an execution of the condition met code 314 if the condition was true, or no execution of the condition met code if the condition was false as indicated in column 320. At the end of the condition met code 314, an invert flag instruction is provided on line 315. This results in resetting the execution flag to false if the condition were true, and setting the execution flag to true if the condition were false as indicated in columns 319 and 320. This results in no execution of the condition not met code 316 if the condition were true, and execution of the condition not met code 316 if the condition were false. At the end of the condition not met code 316, a set flag true instruction if provided on line 317. This results in setting the execution flag true for the subsequent code 318 independent of conditions.

FIG. 6B also provides a table of conditions supported using the execution flag. The chip also includes an external condition input pin as one of the conditions supported. Thus, a microcode instruction may test the input signal of the external condition bit, and operate the if-then-else flag on the condition being true.

The second flag, the no-op flag, is set when the host programs the NOP count register to a non-zero value. This is used during microcode download, and causes the indicated number of instructions to be ignored, regardless of their effect on any flags. There is no opcode to reset the no-op flag. The intent is that when a portion of microcode is being replaced, the CPU initializes the NOP start and NOP count registers and then writes the microcode block. The CPU then resets the no-op flag by writing zero to the NOP count register. This provides a simple and safe method for code downloading while the MSP is still operating.

The main pieces that make up block 203 are:

Conditional State control & storage
NOP instruction counter, NOP start, NOP count registers
Data Read & Writeback control
Interrupt Mask/Request Registers.
Interrupt Request Signal generator E. High Speed Audio Bus (HSAB) Interface The MSP is equipped with facilities in the HSAB interface 202 to communicate between other MSPs, so that signal synthesis and processing can be accomplished on more than one chip. This is a high speed serial-parallel audio data bus (HSAB). The bus carries 128 independent channels of 24-bit audio information. Each channel can be assigned to one or more MSPs by host programming. Data is passed along the bus from a transmitter to all receivers in two 12-bit half-words.

The DAAD chip 154 (FIG. 4) is the bus master for this bus, and provides timing and synchronization for it and the MSP as a whole.

Figure 6C:
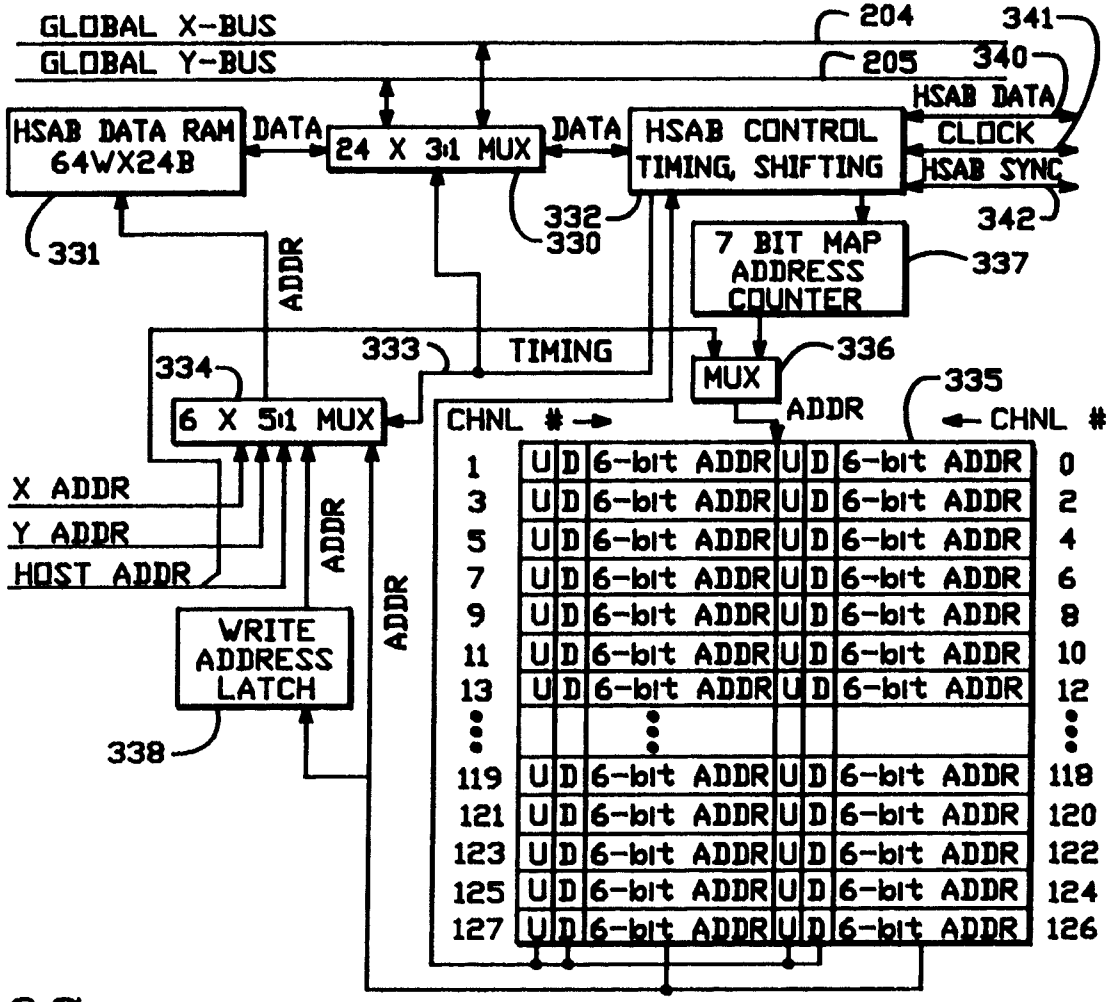
FIG. 6C is a block diagram of the high speed audio bus interface HSAB of the MSP.

FIG. 6C provides a schematic block diagram of the HSAB interface 202. The interface includes a 24 bit wide multiplexer 330 coupled to the X-bus 204, Y bus 205, and a 64 word buffer RAM 331. The multiplexer 330 receives data from the X bus 204, Y bus 205, or the HSAB data RAM for supply to the HSAB control block 332. This block drives HSAB data on line 340, and generates HSAB control signals such as the clock and sync signals on lines 341 and 342 respectively. Also, data received from the bus is driven as input to the multiplexer 330 for supply to any one of the X bus 204, Y bus 204, or HSAB data RAM 331. Control of multiplexer 330 is supplied by timing line 333 from the control and timing block 332. This also controls a multiplexer 334 which supplies address information to the data buffer RAM 331. A bus mapping RAM 335 is provided which is used to map up to 64 of the available 128 channels on the HSAB to the local MSP. Addresses for the mapping RAM 335 are supplied by multiplexer 336 at the output of a map address counter 337, which is controlled by the control timing block 332. A second input to multiplexer 336 is the host address. The mapping registers 335 provide read and write address information to the multiplexer 334, with a write address latch 338 providing write timing.

The multiplexer 334 receives addresses from the mapping registers 335, the host address, the X-address or the Y-address which is provided from the instruction decode.

The MSP HSAB map RAM 335 provides fully programmable I/O channel-to-HSAB data RAM mapping. Because there are 64 words of data buffer RAM 331, each MSP is capable of using up to 64 channels of I/O. The map RAM 335 indicates which of the channels receive data from the bus, and which of the channels transmit data from the local MSP onto the bus. By configuring the map registers 335 in plurality of MSPs, point to point communication on the HSAB is defined. This provides for writing into MSP accessible register space in each of the MSPs in the array, or to the audio output structure as necessary for particular voice programs being executed.

The MSP provides the ability to use up to 64 HSAB channels in each chip. The MSP contains a RAM space 331 of 64 Words×24 Bits for HSAB data. The HSAB MAP RAM 335 allows the host to program which channels are to be transmitted on, received from, or not used at all by this MSP. In the map RAM, for each of the 128 I/O channels, there is a usage enable bit U, a direction bit D and a 6-bit address which maps the 10 channel to one of the 64 locations in the SAAB data RAM.

In normal operation, only one MSP or DAAD 154 will be enabled for transmitting on any given channel. However, during system integration and debug, there is a possibility that two or more MSPs may be programmed to transmit at the same time. The DAAD 54 provides contention detection logic which is used to prevent multiple MSPs from driving the HSAB simultaneously. Each MSP asserts its HSABOEL signal on I/O slot prior to when it will transmit. The DAAD receives the HSABOEL signal from each MSP and DAAD, and if two or more HSABOEL signals are asserted at the same time, the HSABCNTERRL signal is asserted. The MSPs then disable transmitting on the HSAB during the next I/O time slot.

The HSAB data RAM 331 is a single-port RAM. There are therefore some software restrictions which must be placed on its access. An HSAB channel word is transmitted across the bus every four MSP microcode instructions. At the end of the second half-word's transmission (when enabled), the next HSAB data word must be read. During the first part of the first half-word's transmission for the next channel, the received data from the previous channel's time slot must be written to the data RAM. These activities require that two of the four MSP microcode cycles be reserved for this use. The MSP microcode compiler must understand and obey this requirement, and not attempt to access the HSAB data RAM during these instruction times. Should this happen, the error bit, HSAB ACCESS ERROR will be set and latched in the CPU status register.

The HSAB is enabled/disabled by the HSAB_ENABLE bit in the MSP Configuration register. After RESET, the HSAB is disabled. When the host has programmed the configuration and map registers, it sets the HSAB_ENABLE bit to "1". The MSP waits for the next synchronization mechanism. After power-on reset, all MSPs are in the halted state. A synchronization signal is sent by the DAAD chip at the 48 KHz system rate after the end of the RESET signal. When the host has programmed all the internal registers, microcode, RAM, and configuration registers, etc., it sets all the MSPs to the run mode. The MSPs each wait for the next synchronization signal from the I/O control block. This pulse causes the MSPs to reset their internal microcode pointer to the first instruction and begin operation. This insures that the MSPs are always in synchronization, even in single step mode.

The major functions included in the High Speed Audio Bus Interface 202 are:

HSAB Data RAM
HSAB MAP RAM
HSAB MAP Counter
HSAB timing & control generator

F. RAM Interface

The MSP's RAM interface 201 provides access to a large area of memory. The MSP provides 24 bits of address range or 16 MW×24 bits. The physical RAM space is broken into eight areas by the DRAM RAS signals. The address bus is folded in half to support dynamic RAM.

Figure 6D:
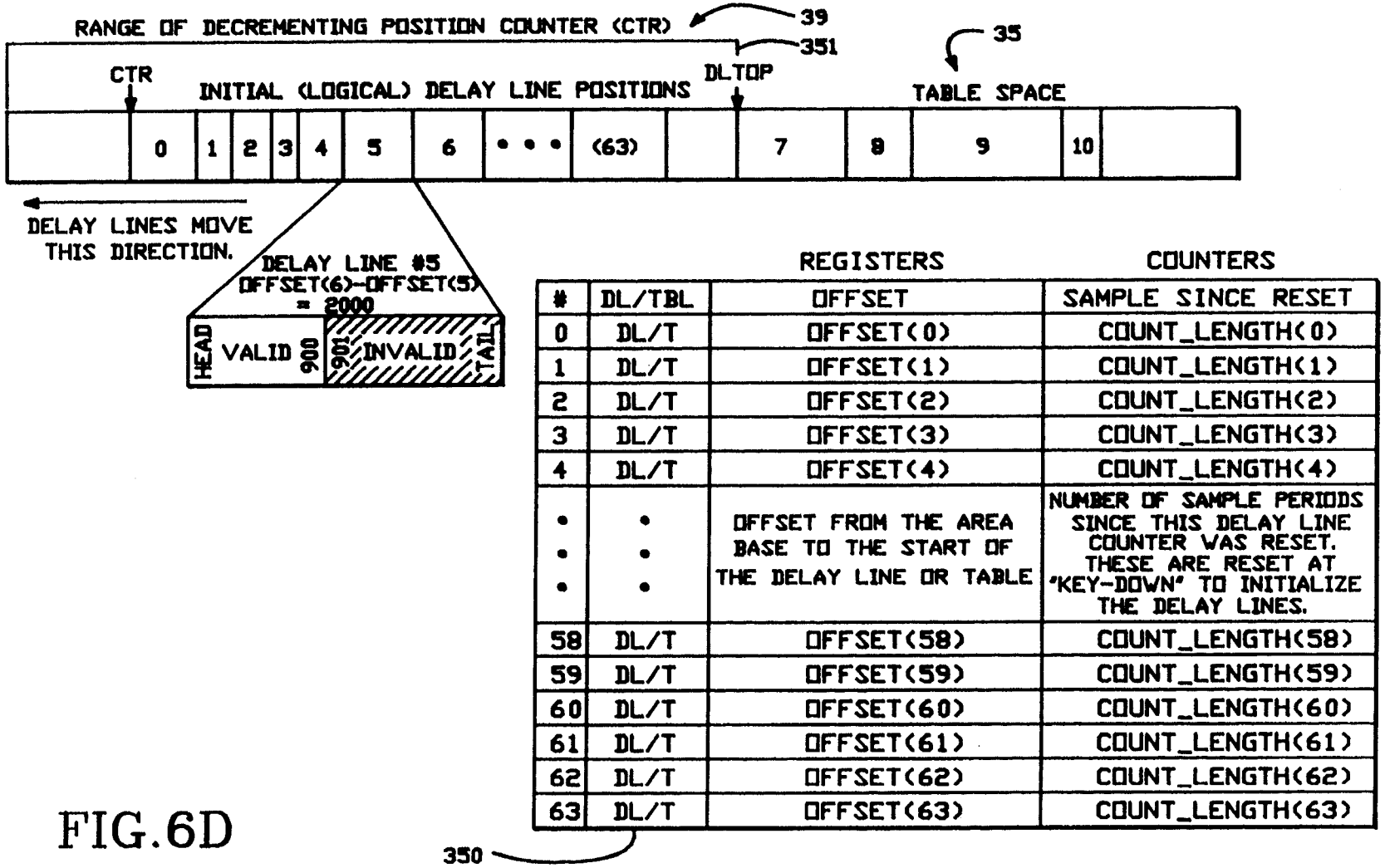
FIG. 6D is a chart illustrating the MSP delay line and table management scheme.
Figure 6E:
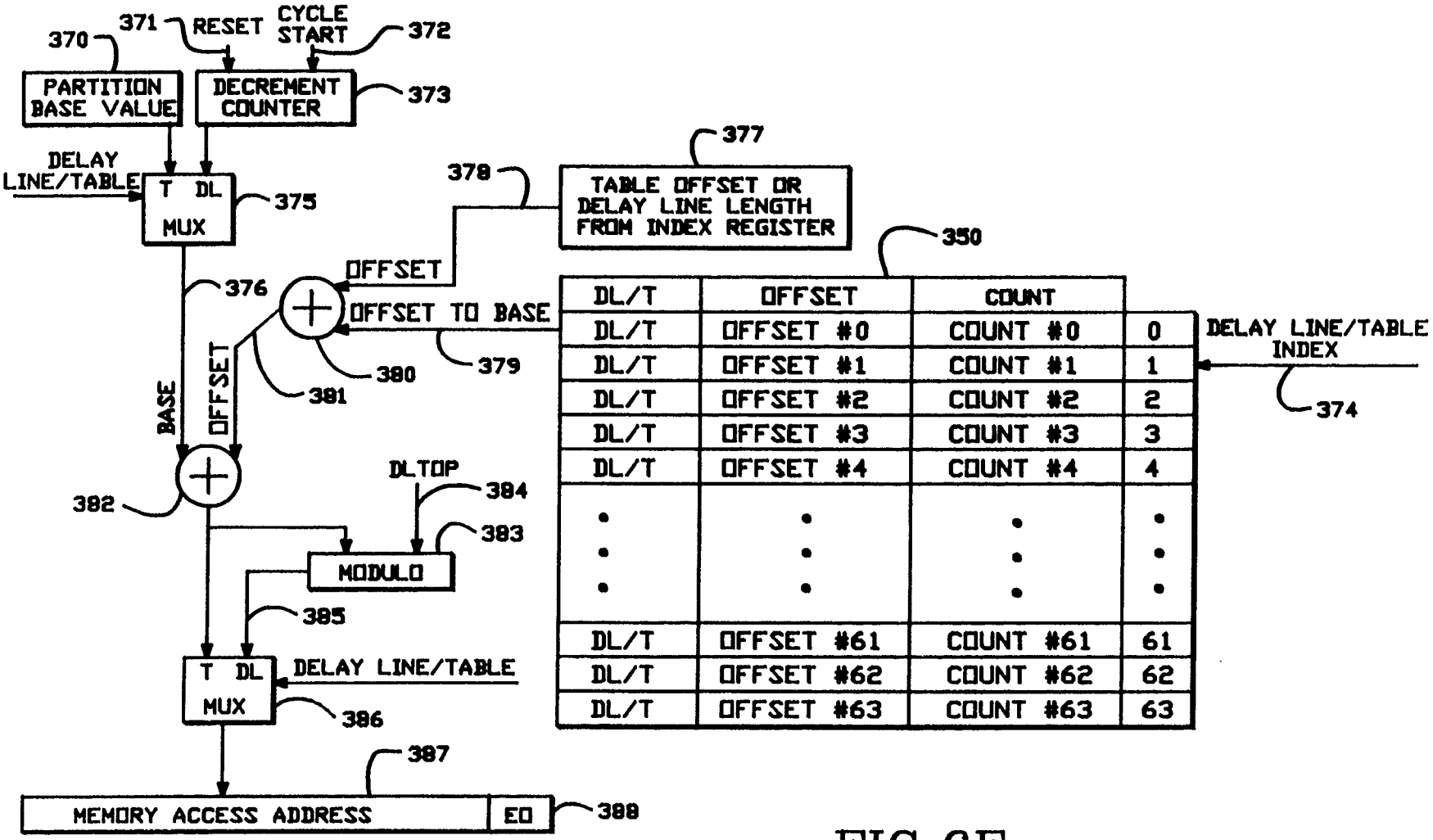
FIG. 6E is a logic diagram of the RAM addressing block of the MSP.

The writable RAM space is allocated into two parts, in which the addressing methods are different. The first area is addressed circularly, and is used for delay lines. The second area allows standard linear and table-lookup space for samples, envelope tables, etc. These two addressing methods are depicted in FIGS. 6D and 6E, respectively. The tables and delay line definitions are set with 64 dual-use configuration register set 350, shown in FIGS. 6D and 6E.

FIG. 6D logically illustrates the mapping of the delay line/table memory coupled to MSP. It includes a delay line area 349 and table space 350. The delay line area is limited by the range of the decrementing position counter in the RAM interface indicated as DLTOP 351. There are up to 64 logical delay line positions 0 through 63, and a number of table spaces 352.

The difference between the offset for slot 6 and the offset for slot 5 defines the number of samples in delay line 5. In the example, this difference may be 2000. If the delay line 5 is limited to 2000 samples long, and only 900 have been written, those samples delayed beyond 900 cycles are invalid. In the case that 900 have been written since the last reset, the count length in the delay line 5 will be equal to 900. The write address for the delay line is calculated by adding the offset for the selected delay line number to the value of the decrementing position counter (Modulo DLTOP).

A read address for the delay line, if the delay line is less than or equal to the count length in the register file 350 for the delay line, is equal to the value of the decrementing position counter plus the offset plus the delay for the sample to be read (Modulo DLTOP). A table address for a given table number and index from MSP bus is equal to the DLTOP value plus the offset for the table in the register file 350 plus the index.

The logic for generating the address is shown in FIG. 6E. The inputs include a partition base value 370 from the register file, a decrement counter reset signal 371 and a cycle start signal 372 from the MSP. Also, a delay line/table index signal 374 is supplied. A decrement counter 373 receives reset signal 371 and the cycle start signal 372. The partition base value and decrement counter outputs are supplied to a multiplexer 375. The output of the multiplexer 375 provides a base address on line 376 in response to the DL/T bit in register file 350. Offset values can be provided from the table offset or delay line length from the index register 377 in the MSP 77 across line 378. Also, the offset value from the register file 350 is supplied on line 379. The values on lines 378 and 379 are added by adder 380 to supply an offset value on line 381. The base value in line 376 and offset value in line 381 are added by adder 382. The output of the adder 382 is used directly as a table address, and supplied to modulo logic 383 which receives the DLTOP reference on line 384. The output of the modulo logic 383 as supplied as the delay line address on line 385. Multiplexer 386 controlled by the DL/T bit in the register file 350 supplies the memory access address to register 387. An even/odd half word select bit 388 is supplied from the host.

Each delay line/table configuration entry consists of three parts: a base offset, a count, and a bit DL/T indicating whether the record is a delay line or table. The base offset always indicates the start of the particular delay line or table. The count's use depends upon the setting of the DL/T bit. When the DL/T bit is set for tables, the count register of the configuration entry does nothing, and has no effect on accesses. When this bit is set for a delay line, the count is used to gate data on delay line reads. After a delay line has been initialized by setting this count to zero, each write to the delay line increments the counter. When a read of the delay line is requested, if the delay line length requested is longer than the number of samples actually stored since the count was initialized, the value zero will be returned for the read. If the delay line length is less that the count, the actual data stored in memory will be returned. The count stops when it reaches $FFFF, after which any delay line length will be accepted, and the data value at the address will be provided. This allows delay lines to be initialized without having to actually fill memory with zeroes.

In a delay line, writing usually occurs at the head of the delay line, and reading usually occurs on some sample stored earlier. For writing, the address is composed of the partition base value, the offset value for that delay line, and the output of a decrement counter. The decrement counter moves all the delay lines through the circular addressing area as system cycles pass. When reading, the delay line length from the index register is added to the decrement counter and base offset for that delay line to get the desired address.

The CPU, under normal operating (running) conditions must access the RAM area in competition with the MSP's accesses. Since RAM accesses occur over more than one MSP instruction time, the MSP must be able to determine if there will be sufficient time for the CPU to perform its access. To accomplish this, the MSP has a six-instruction prefetch queue.

The CPU downloads data to RAM at a single-word register in the MSP register map. The address where downloaded data is written to (or read from) by the CPU is determined by the settings of the two RAM pointers. One pointer is used when the CPU accesses the RAM port directly. The second is used when the system integration chip is performing a DMA transfer. Which of these are used is determined by the setting of the CPUDMAL input signal's value at the start of the access.

The functional blocks required to implement the RAM control block 201 are:

RAM Address Folding Multiplexer
RAM access address latches
RAM access data latches
RAS, CAS, WE timing generators
RAM configuration registers
RAM circular/linear split register
Circular addressing counter
RAM address calculator
RAM Data Packing / Unpacking logic

G. Pseudo Random Noise Generator

The pseudo random noise generator 211 provides 24 bit numbers to either the X or the Y Internal data bus. The noise generator output is defined as: $N_n=5*N_{n-1}+1$. A filtered noise generator output is also provided and defined as: $FN_n=(N_n+N_{n-1})/2$. The noise register is clocked each time a read as indicated by RD ACCESS is performed by the MSP or CPU. The Host CPU can read the pseudo random noise generator through the X- or Y-bus to provide it with a pseudo random noise generator. The CPU can also seed the random number generator by writing to it. The noise and filtered noise registers are mapped at the top of the HSAB data memory.

H. Microcode Storage Block & Prefetch Block

The microcode storage block 213 and prefetch block 214 are implanted with a single-port static RAM with separate I/Os. There are 512 microcode steps of 40 bits each, stored as 256 words of 80 bits. The microcode contains information about the current operation. This is prefetched three full words (six instructions) ahead, so the MSP can determine when an internal bus phase, or RAM are access will be available for the host CPU.

The CPU downloads microcode in full 80 bit blocks, which require five 16 bit word writes to assemble. The location where the assembled word is placed is determined by the setting of the appropriate microcode pointer register. There are two such pointers. One is used when the system integration chip DMA logic is downloading microcode, and the other is used when the CPU is accessing the microcode port directly. Which pointer is used is determined by the state of the CPUD- MAL input signal at the start of the access. The microcode is stored in two instruction words to allow the CPU access to the memory block while the MSP is operating. With this method, there is always time reserved for new microcode to be downloaded.

Microcode can be downloaded in a forward direction only. The MSP supports microcode download while the MSP is both halted and running. The NOP start and NOP count registers are used when a portion of the microcode needs to be modified, and it is desired that the MSP remain operating while that code segment is replaced.

I. X & Y Register Storage Blocks

The X & Y register blocks 208, 209 consist of two banks of static RAM registers providing internal data storage for fast access to the MAC and ALU. The X register bank 208 can be accessed from the X internal bus only, and the Y register bank 209 can be accessed from the Y internal bus only. Each bank is 256 Words×24 bits wide. The CPU can access these register banks, but it may require one or more wait states to accomplish the access due to internal instruction executions.

The Y register bank is divided into two spaces at the point defined by the Y Circular/Linear Split Point Register. This register contains a 3-bit value which specifies the number of words of circular memory: 0, 4, 8, 16, 32, 65, 128, or 256. The lower part is addressed circularly, the upper part is addressed linearly. An 8-bit decrement counter, decremented every system cycle, moves data through the circular addressing area. The circular address is composed of the output of the decrement counter, the microcode address field and , if an indirect addressing mode is used, the contents of the index register. The linear address is composed of the microcode address field and the contents of the index register (if an indirect address mode is used). Circular or linear addressing is determined by the microcode address field. If the microcode address is less than the circular/linear split point, then circular addressing is used; otherwise linear addressing is used.

J. Temporary Registers S and T

There are two temporary registers 212, each a 24 bit register, used as temporary storage of data values. These can be accessed from either the X or the Y internal bus, or can be selected by the multiplexers at the inputs to the MAC and ALU. The registers are referred to as the T and the S registers. The data stored in the temporary registers is also output to the compare block 228 at the output of the MAC and ALU.

K. 24 Bit×24 Bit Multiplier & 56 Bit Accumulator

The MAC 206 is the most time-critical part of the MSP. The speed of the multiplier determines the minimum instruction time. A multiply and accumulate in less that the 80 ns worst case should satisfy a 25 MIPs throughput goal. This block consists of a 24 bit×24 bit high speed fixed point multiplier. The final partial-product adder has been merged with the 56-bit accumulator. It can perform signed (2s complement) multiplies in single precision, and can handle the bit shifting required for double precision multiplies. It can also invert the sign on the Y input if programmed. The X- and Y-Inputs come from the X- and Y-bus latches and multiplexers described below.

Inputs to the MAC are latched as they are accessed to insure correct results, since the multiply cycle takes two full instruction times. The MAC output is 56 total bits in width, but only the 24-bit rounded result can be written back on the X- or Y-bus. The accumulator result generates several flags for the conditional interface and status registers. The 24-bit rounded result is also fed to the compare block. The second input to the 56 bit accumulator can be either the zero value, the currently accumulated (latched) value, or the accumulated value shifted 23 bits for double precision multiplies.

Because the microcode and multiplier do not support unsigned or mixed-mode multiples, the MSB of the LSW of a double precision number is used as a sign bit and must always be zero. Therefore, the MSPs double precision multiplies are actually 24 bit×47 bit or 47 bit×47 bit.

The MAC operations execute in two 40 ns instruction cycles, and may include one register access on each of the X- and Y-buses. The MAC can perform the following operations:

| | |
|---|---|
| NOP | no operation |
| SMPY | Signed Multiply |
| SMPYMINUS | Signed Multiply, Y-Input Inverted |
| SMAC | Signed Multiply/Accumulate |
| SMACMINUS | Signed Multiply/Accumulate, Y-input Inverted |
| SMACSHIFT23 | Signed Multiply/Accumulate, double precision |
| SMACMINUSSHIFT23 | Signed Multiply/Accumulate, double precision, Y-input inverted |

The functional blocks required for the multiplier and accumulator include the following:

24 Bit×24 bit=48 bit result signed partial-product multiplier

56 Bit accumulator (merged with the multiplier)

Output multiplexer and write-back latch

L. 24 Bit ALU

The ALU 207 block provides non-standard Arithmetic-Logic-Unit functions from the MSP. It performs on a 40 ns cycle time, and can provide write-back to both the X and Y register areas. The two inputs to the ALU come from separate multiplexers. The ALU result generates several flags for the conditional interface and status registers. The output of the ALU is fed to the compare block and the X- and Y-bus write back latches. There are two latches here because the value in the accumulator might be used to generate two parts of the same number, for example a whole number and fractional portion of a phase increment value.

The ALU operations execute in one 40 ns instruction cycle, and may include one register access on each of the X- and Y-buses. The ALU can perform the following operations:

| | |
|---|---|
| NOP | no operation |
| SADD | Signed addition |
| UADD | Unsigned addition |
| SSUB | Signed subtraction (X − Y) |
| USUB | Unsigned subtraction (X − Y) |
| SADDABS | Signed addition (X + \|Y\|) |
| SSUBABS | Signed subtraction (X − \|Y\|) |
| NEGATE | Negate input value (2s complement) |
| ABS | Absolute value |
| SIGN | Sign extract |
| ENVELOPE | Calculate envelope value, delta, destination and segment table control, etc. |

-continued

| | |
|---|---|
| OSCILLATOR1 | Calculate phase angle and interpolation constant |
| OSCILLATOR2 | Calculate phase angle and interpolation constant. |
| HAMMER | Calculate phase angle and interpolation constant |
| SAMPLE | Calculate phase angle and perform loop control (16-bit integer, 8-bit fraction) |
| SAMPLE1 | Calculate phase angle and perform loop control (24-bit fraction) |
| SAMPLE2 | Calculate phase angle and perform loop control (24-bit integer) |
| INTERPOLATE | Calculate 1 − x |
| COPY | Copy operand source to accumulator X,Y |
| ASR1 | Arithmetic shift right 1 bit |
| ASL1 | Arithmetic shift left 1 bit |
| ASR4 | Arithmetic shift right 4 bits |
| ASL4 | Arithmetic shift left 4 bits |
| DITHER | Randomizes least significant bit(s) for output to DAC |
| ONEMINUSABS | Calculate 1 − \|x\| |
| LIMITPOSITIVE | Limit negative numbers to zero |

M. Special Decode Instructions

The special decode operations execute in one 40 ns instruction cycle. During a special decode instruction cycle, register accesses on the X- and Y-buses are not allowed. The special decode instructions include the following operations:

| | |
|---|---|
| INT #, <condition> | Interrupt the CPU with vector bit # if <condition> is true |
| SET FLAG, <condition> | set conditional flag if <condition> is true |
| LED, <condition> | turn on LED if <condition> is true |

N. Compare block

The compare block 228 detects when the data output of the ALU or MAC meets several conditions. These include "less that T or S (temporary register)", "greater that T or S (temporary register)", and "almost equal T or S (temporary register)". ("almost equal T or S" is defined as equal to zero within a threshold specified by T or S.)

0. Rounder

The rounder 227 uses a convergent rounding technique to round the output of the MAC to fit the 56 bit result into the 24 bit MSP word size. It also performs limiting on numbers exceeding the MAC's range. Convergent rounding is a variation of the "standard" rounding technique. Standard rounding consists of adding the constant 0×800000 to the 56-bit MAC result. When using a twos-complement data representation, this method introduces a positive bias in the roundoff error. Convergent rounding attempts to eliminate this bias. Convergent rounding initially performs standard rounding and then the result is tested to determine if bits 0–23 are zero, If this condition is true, bit 24 is cleared. The result is that if the MAC output is exactly half way between two numbers, then the result will be rounded up half the time and rounded down the rest of the time. Therefore the roundoff error averages to zero.

P. Index register

The MSP contains one index register 210 allowing indirect addressing to the four main data storage areas. The index register can be written by either the X or the Y internal bus and can be read and set by the Host processor. The Index register is 24 bits in width and can be incremented automatically.

Q. Input Registers

There are two registers, 216, 217 used to latch the X- and Y-bus data before being used as inputs to the ALU of MAC.

R. Input Shifters/Limiters

There are four shifter/limiters 218, 219, 240, 241, used to shift/limit the ALU/MAC X and Y input operands. The MAC, ALU, X- or Y-input register data is shifted/-limited according to the current microcode word. For signed operations, the shifter performs an arithmetic shift, and for unsigned operations, a logical shift is performed. The signed/unsigned status also determines the limit value to be used.

S. Input Multiplexers

There are two multiplexers 220, 221, one on each of the ALU/MAC X and Y inputs, those connected to the X-inputs select data from the MAC, ALU, T, S, or X-input register. Those connected to the Y-inputs select data from the MAC, ALU, T, S, or Y-input register. The MAC, ALU<X- and Y-input register data may also be shifted/limited as defined by the microcode.

T. MSP Register Description

This section discusses the register definitions appearing at the MSP Host interface 200. They include the internal data spaces, status registers, configuration registers, RAM and microcode ports and pointers, etc.

1. X- and Y-Registers

The X- and Y- register areas 208, 209 are first in the register map. They are memory mapped; accessed directly without the benefit of an MSP internal pointer. These registers must be accessed over the internal X- and Y-buses, so wait states may be generated to the CPU before the access can be accomplished. Wait states are not inserted on the second word read to a continuing internal word, nor to the first of two writes. The words in these areas are all 24-bits wide, so they are presented to the 16-bit host interface as two 16 bit words. For BIGENDIAN=1, the LSbit of the higher addressed word is the LSbit of the MSP's word. For BIGENDIAN=0, the LSbit of the lower addressed word is the LSbit of the MSP's word. There are 256 24-bit words in each bank, so the 2 banks occupy a total of 2048 bytes of address space.

2. HSAB Data & Map Registers

These registers are in the HSAB interfaces 202 are in two adjacent address spaces within the MSP. The lower addressed one is the high speed audio bus data memory. This internal memory is 64 words×24 bits wide. These registers must be accessed over the internal X- and Y-buses, so wait states may be generated to the CPU before the access can be accomplished. Wait states are not inserted on the second word read to a continuing internal word, nor to the first of two writes. The words in these areas are all 24-bits wide, so they are presented to the 16-bit host interface as two 16 bit words. For BIGENDIAN=1, the LSbit of the higher addressed word is the LSbit of the MSP's word. For BIGENDIAN=0, the LSbit of the lower addressed word is the LSbit of the MSP's word. There are 64 24-bit words, which occupies a total of 256 bytes of address space. The HSAB data RAM can be read and written by the CPU.

The second part of this block is the HSAB map registers. Each sixteen bit register contains the configuration bits for two HSAB channels. For each channel there are 8 bits: a usage enable bit, a direction bit, and a 6-bit address bit which maps the I/O channel to one of the 64 locations in the HSAB data RAM. The USE bit, when set to one, indicates that the MSP uses this channel. When set to zero, the MSP does not use that channel, and the state of the other bits are meaningless (don't care). The DIRECTION bit indicates, when set to zero, that this MSP is to receive data on this channel. When set to one, it indicates that data will be transmitted on this channel by this MSP. There are sixty-four 16 bit registers, for a total of 128 bytes of CPU address space. Because the HSAB controller must access the map registers during operation, wait states may be generated to the CPU before the access can be completed. They are all read/writable.

3. Delay Line/Table Position Registers

These registers provide the MSP with flexible tables and delay lines. The MSP supports any combination of delay lines and table, up to 64 in number. There are two areas in these registers. The first defines the table/delay line base offset, and whether that entry is a table or a delay line. The second part is the count of accumulated samples for that delay line. None of these registers generates wait states.

The first area, the delay line offset values, consists of sixty four 24 bit values. They are presented to the 16-bit host interface as two 16 bit words each. For BIGENDIAN=1, the LSbit of the lower addressed word is the LSbit of the MSP's word. The bit number 8 of the MSW tells the MSP RAM address calculation unit whether this entry is a delay line (1) or a table (O). When defined as a delay line, the value represents the offset from the moving head of delay line memory that is the writing point for that delay line. When defined as a table, the value represents the offset from the RAM partition value that is the start of the table. This area is sixty four 25 (24+1) bit words long, which occupies a total of 256 bytes of address space.

The second area consists of 64 16 bit registers. When the table entry is set as a delay line, this value represents the number of data values written since this register was set to zero by the CPU. This allows the MSP to emulate having had its delay lines cleared without taking the time to actually fill the RAM with data. The counter is incremented upon the delay line's site. During a delay line read, the length requested is compared to this value to determine if the stored value should be provided, or if a zero value should be returned. This counter will saturate at FFFF, so don't count on having a gated delay line of greater than 64K. When the table entry is set as a table, the count register is unused.

These registers do not produce wait-states to the CPU, and all can be read and written.

4. MSP Functional Registers

These registers control the configuration, operation, and status of the MSP chip. Some in this group of registers do not produce any waitstates to the processor, while others do. Some cannot be written, some cannot be read. Here are brief descriptions of each:

a. RAM Data Port

This is the register through which the CPU accesses the MSP's RAM area. As noted in the section previously covering the RAM interface block, the first read, and the second write to this port produces wait states until the operation is accomplished. This single-address register is in fact two registers, accessed according to the state of the CPUDMAL signal at the start of the access. To access memory through this port, the DMA or CPU RAM Start Address register must be programmed with the start address.

b. Microcode Data Port

This is the register through which microcode is downloaded. Because the microcode prefetch controller must access the microcode RAM during operation, wait states may be generated to the CPU before the access can be completed. This single-address register is in fact two registers, accessed according to the state of the CPUDMAL signal at the start of the access. Each microcode word requires five word accesses to complete. Downloading through this part requires that the DMA or CPU microcode start address register be programmed with the desired start address.

c. RAM Start Pointer (DMA)

This register sets the start point for DMA accesses to the MSP RAM. This register contains the 24-bit RAM address, and is automatically incremented as accesses progress. This register is read/write. When reading, this register contains the current 24-bit RAM address. This register affects only DMA accesses, and produces no wait states to the CPU.

d. RAM start pointer (CPU)

This register sets the start point for CPU accesses to the MSP RAM. This register contains the 24-bit RAM address, and is automatically incremented as accesses progress. This register is read/write. When reading, this register contains the current 24-bit RAM address. This register affects only direct CPU accesses, and produces no wait states to the CPU.

e. Microcode Start (DMA)

This register sets the start point for microcode accesses in the MSP. This register holds the 8-bit address of a double-instruction microcode word, and is automatically incremented as accesses progress. This register is write only. This register affects only DMA accesses, and produces no wait states to the CPU.

f. Microcode Start (CPU)

This register sets the start point for microcode accesses in the MSP, and also indicates the current microcode step number if read while single stepping. This register holds the 8-bit address of a double-instruction microcode word, and is automatically incremented as accesses progress. This register can be read and written. When read, this register contains the current 9-bit microcode step number. This register affects only direct CPU accesses, and produces no wait states to the CPU.

g. MAC Output

This register is the 56-bit result of the Multiplier-Accumulator. This value is presented to the CPU in four sixteen bit registers. They are read/writable, but only when the MSP is halted. These registers do not produce wait states to the CPU. When writing, the value in the registers is placed into the MAC output register when the last word is written; write them all in order.

h. ALU Output Register X

This register is the 24-bit result of the ALU, and is the value currently in the X bus writeback register. It is read and writable, but only when the MSP is halted. These registers do not produce any wait states to the CPU. When writing, the value is placed in the internal register when the word with the highest address is written. This register is 24-bits wide, and appears to the 16-bit host interface as a long word. For BIGENDIAN=1 the LSbit of the higher addressed word is the LSbit of the MSP's word. For BIGENDIAN=0, the LSbit of the lower addressed word is the LSbit of the MSP's word.

i. ALU Output Register Y

This register is the 24-bit result of the ALU, and is the value currently in the Y bus writeback register. It is read and writable, but only when the MSP is halted. These registers to do not produce any wait states to the CPU. When writing, the value is placed in the internal register when the word with the highest address is written. This register is 24-bits wide, and appears to the 16-bit host interface as a long word. For BIGENDIAN=1, the LSbit of the higher addressed word is the LSbit of the MSP's word. For BIGENDIAN=0, the LS bit of the lower addressed word is the LSbit of the MSP's word.

j. Temporary Register T

This register is the 24 bit value currently in the T temporary register. It is read and writable, but only when the MSP is halted. This register must be accessed over the internal X- and Y buses, so wait states may be generated to the CPU before the access can be accomplished, though this is generally not a problem when single-stepping the MSP. Wait states are not inserted on the second word read to a continuing internal word, nor to the first of two writes. When writing, the value in the registers is placed into the internal register when the word with the highest address is written. This register is 24-bits wide, so it is presented to the 1-bit host interface as a long word. For BIGENDIAN=1, the LSbit of the higher addressed word is the LSbit of the MSP's word. For BIGENDIAN=0, the LSbit of the lower addressed word is the LS bit of the MSP's word.

k. Temporary Register S

This register is the 24-bit value currently in the S temporary register. It is read and writable, but only when the MSP is halted. This register must be accessed over the Internal X- and Y-buses, so wait states may be generated to the CPU before the access can be accomplished, though this is generally not a problem when single-stepping the MSP. Wait states are not inserted on the second word read to a continuing internal word, nor to the first of two writes. When writing, the value in the registers is placed into the internal register when the word with the highest address is written. This register is 24-bits wide, so it is presented other 16-bit host interface as a long word. For BIGENDIAN=1, the LSbit of the higher addressed word is the LSbit of the MSP's word. For BIGENDIAN=0, the LS bit of the lower addressed word is the LSbit of the MSP's word.

l. Noise Register

This register is the 24-bit value currently in the pseudo-random noise generator register. It is read and writable. This register must be accessed over the internal X- or Y-bus, so wait states may be generated to the CPU before the access can be accomplished. This is generally not a problem, since the MSP is usually halted when the random number generators are seeded. Wait states are not inserted on the second word read to a continuing Internal word, nor to the first of two writes. When writing, the value in the registers is placed into the internal register when the word with the highest address is written. This register is 24-bits wide, so it is presented to the 16-bit host interface as a long word. For BIGENDIAN-1, the LSbit of the higher addressed word is the LSbit of the MSP's word. For BIGENDIAN=0, the LSbit of the lower addressed word is the LSbit of the MSP's word. The noise generator is cycled when the CPU reads from it as well as when the MSP reads it.

m. Filtered Noise Register

This register is the 24-bit value currently in the filtered noise register. It is read only. This register must be accessed over the internal X- or Y-bus, so wait states may be generated to the CPU before the access can be accomplished. Wait states are not inserted on the second word read to a continuing internal word. This register is 24-bits wide, so it is presented to the 16-bit host interface as a long word. For BIGENDIAN=1, the LSbit of the higher addressed word is the LSbit of the MSP's word. For BIGENDIAN=0, the LSbit of the lower addressed word is the LSbit of the MSP's word.

n. Index Register

This register is the 24-bit value currently in the index register. It is read and writable, but only when the MSP is halted. This register must be accessed over the internal X- and Y-buses, so wait states may be generated to the CPU before the access can be accomplished, though this is generally not a problem when single-stepping the MSP. Wait states are not inserted on the second word read to a continuing internal word, nor to the first of two writes. When writing, the value in the register is placed into the internal register when the word with the highest address is written. This register is 24-bits wide, so it is presented to the 16-bit host interfaces as a long word. For BIGENDIAN=1, the LSbit of the higher addressed word is the LSbit of the MSP's word. For BIGENDIAN=0, the LSbit of the lower addressed word is the LSbit of the MSP's word.

o. Interrupt Mask Register

This register is a 16-bit read/write register. Each bit represents which interrupt sources should be masked (O) from creating a CPU interrupt. Interrupt numbers 0–15 appear in this register. This register does not produce any wait states to the CPU. At RESET, all interrupts are masked.

p. Interrupt Mask Register 2

This register is a 16-bit read/write register. Each bit represents which Interrupt sources should be masked (O) from creating a CPU interrupt. Interrupt numbers 16–31 appear in this register. This register does not produce any wait states to the CPU, at RESET, all Interrupts are masked.

q. Interrupt Request Register 1

This register is a 16-bit read/write register. Each bit represents one Interrupt source in the MSP. When read, those Interrupt bit positions which generated an Interrupt will be high. When this register is read, all the bits are cleared. The Interrupt request bits can be cleared individually by writing a "1" to the corresponding bit in the Interrupt request registers. Interrupt numbers 0–15 appear in this register. This register does not produce any wait states to the CPU. At RESET, all Interrupts are cleared.

r. Interrupt Request Register 2

This register is a 16-bit read/write register. Each bit represents one Interrupt source in the MSP. When read, those Interrupt bit positions which generated an Interrupt will be high. When this register is read, all the bits are cleared. The Interrupt request bits can be cleared individually by writing a "1" to the corresponding bit in the Interrupt request registers. Interrupt numbers 16–31 appear in this register. This register does not produce any wait states to the CPU. At RESET, all Interrupts are cleared.

s. DRAM Circular/Linear Split Point Register

This 24-bit register indicates to the MSP where the delay line memory ends, and the table space begins. The spilt point register value contains the last location in memory used for Delay lines. This value must fit with the 2N−1 form, so it forms a mask of the bits allowable in the address. This register does not produce any wait states to the CPU. When writing, the value in the registers is placed into the Internal register when the word with the highest address is written. This register is 24-bits wide, so it is presented to the 16-bit host Interface as a long word. For BIGENDIAN=1, the LSbit of the higher addressed word is the LSbit of the MSP's word. For BIGENDIAN=0, the LSbit of the lower addressed word is the LSbit of the MSP's word. This register is read/write.

t. Y Circular/Linear Split Point Register

This register indicates to the MSP where the circularly addressed space ends, and the linearly-addressed space begins. This register does not produce any wait states to the CPU. The split point register contains a 3-bit value which specifies the number of words of circular memory. This register is read/write.

| Y Circular/Linear Split | Words of Circular Memory |
|---|---|
| 000 | 0 |
| 001 | 4 |
| 010 | 8 |
| 011 | 16 |
| 100 | 32 |
| 101 | 64 |
| 110 | 128 |
| 111 | 256 |

u. Status Register 1

This 16 bit register contains the read-only status bits of the MAC. This register does not produce any wait states to the CPU. The bits and their meanings are:

MAC RESULT EXTENDED (NOT A NUMBER): This indicates (when 1) that the current MAC result is not a usable number. That Is, the accumulator output bits 55:48 are either not all high or not all low, or do not all match the sign bit (bit 47) for a signed operation. This bit is not latched, and is only meaningful when single-stepping the MSP.

MAC RESULT ZERO: This indicates (when 1) that the MAC Result is currently Zero. This bit is not latched, and is only meaningful when single-stepping the MSP.

MAC RESULT NEGATIVE: This indicates (when 1) that the MAC Result is currently a negative number. This bit is not latched, and is only meaningful when single-stepping the MSP.

MAC RESULT CLIPPED: This bit indicates (when 1) that an EXTENDED MAC result was either written over the X- or Y-bus, or was used as an Input to the MAC or ALU. This bit is latched until the CPU reads this register.

MAC RESULT LESS THAN S: This indicates (when 1) that the MAC Result is currently less than the value in the temporary S register. This bit is not latched, and is only meaningful when single-stepping the MSP.

MAC RESULT GREATER THAN S: This indicates (when 1) that the MAC Result is currently greater than the value in the temporary S register. This bit is not latched, and is only meaningful when single-stepping the MSP.

MAC RESULT ALMOST EQUAL 0 (S): This indicates (when 1) that the MAC Result is currently equal to zero within a threshold specified by the value in the temporary S register. This bit is not latched, and is only meaningful when single-stepping the MSP.

MAC RESULT LESS THAN T: This indicates (when 1) that the MAC Result is currently less than the value in the temporary T register. This bit is not latched, and is only meaningful when single-stepping the MSP.

MAC RESULT GREATER THAN T: This indicates (when 1) that the MAC Result is currently greater than the value in the temporary T register. This bit is not latched, and is only meaningful when single-stepping the MSP.

MAC RESULT ALMOST EQUAL 0 (T): This indicates (when 1) that the MAC Result is currently equal to zero within a threshold specified by the value in the temporary T register. This bit is not latched, and is only meaningful when single-stepping the MSP.

MAC BUSY: This bit indicates (when 1) that the MAC is currently performing an operation. This bit is not latched, and is only valid when the MSP is being single stepped.

MAC ACCUMULATE OPERATION: This bit indicates (when 1) that the current MAC operation includes some operation with the accumulator besides adding zero. This bit is not latched, and is only valid when the MSP is being single stepped.

MAC MINUS OPERATION: This bit (when 1) indicates that the MAC is currently performing an operation with the Y-Input negated. This bit is not latched, and is only valid when the MSP is being single stepped.

MAC DOUBLE PRECISION OPERATION: This bit (when 1) indicates that the MAC is currently performing an operation with the accumulator shifted for double precision operations. This bit is not latched, and is only valid when the MSP is being single stepped.

v. Status Register 2

This 16 bit register contains the read-only status bits of the ALU. This register does not produce any wait states to the CPU. The bits and their meanings are:

ALU CARRY: This indicates (when 1) that the current ALU result generated a carry out of the MSbit for an addition, or a borrow into the MSbit for a subtraction. This bit is not latched, and is only valid when the MSP is being single stepped.

ALU OVERFLOW: This indicates (when 1) that the current ALU result is not a usable number due to overflow. This bit is not latched, and is only valid when the MSP is being single stepped.

ALU RESULT ZERO: This bit indicates (when 1) that the ALU Result is currently Zero. This bit is not latched, and is only meaningful when single-stepping the MSP.

ALU RESULT NEGATIVE: This indicates (when 1) that the ALU Result is currently a negative number. This bit is not latched, and is only meaningful when single-stepping the MSP.

ALU LATCHED OVERFLOW: This indicates (when 1) that the current or previous ALU result is not a usable number due to overflow. This bit is a latched version of the ALU OVERFLOW status bit, and is latched until the CPU reads this register.

ALU RESULT LESS THAN S: This indicates (when 1) that the ALU Result is currently less than the value in the temporary S register, This bit is not latched, and is only meaningful when single-stepping the MSP.

ALU RESULT GREATER THAN S: This indicates (when 1) that the ALU Result is currently greater than the value in the temporary S register. This bit is not latched, and is only meaningful when single-stepping the MSP.

ALU RESULT ALMOST EQUAL 0 (S): This indicates (when 1) that the ALU Result is currently equal to zero within a threshold specified by the value in the temporary S register. This bit is not latched, and is only meaningful when single-stepping the MSP.

ALU RESULT LESS THAN T: This indicates (when 1) that the ALU Result is currently less than the value in the temporary T register. This bit is not latched, and is only meaningful when single-stepping the MSP.

ALU RESULT GREATER THAN T: This indicates (when 1) that the ALU Result is currently greater than the value in the temporary T register. This bit is not latched, and is only meaningful when single-stepping the MSP.

ALU RESULT ALMOST EQUAL 0 (T): This indicates (when 1) that the ALU Result is currently equal to zero within a threshold specified by the value in the temporary T register. This bit is not latched, and is only meaningful when single-stepping the MSP.

MAC/ALU INPUT LIMITED: This bit indicates (when 1) that an X or Y Input was limited by the shifter/limiter at the input to the MAC/ALU operand multiplexers. This bit is latched until the CPU reads this register.

MAC OVERRUN: This indicates (when 1) that a second MAC operation was attempted before the previous MAC operation was completed. This condition will cause erroneous results for both Instructions. This bit is latched until the CPU reads this register.

HSAB ACCESS ERROR: This bit indicates (when 1) that there has been an Illegally timed access attempt made of the HSAB data RAM. This bit is latched until the CPU reads this register.

RAM ACCESS ERROR: This bit indicates (when 1) that there has been an Illegally timed access attempt made of the RAM port. This bit is latched until the CPU reads this register.

w. Configuration Register

This 16 bit register contains the bits that define the basic operating mode and configurations of the MSP. All bits are read/write, except for the STEP MSP bit which is write only. This register does not produce any wait states to the CPU. The bits and their meanings are:

RUN/HALT MSP: This bit, when set to 1 starts the MSP running. The MSP will wait until the next sync pulse before starting operation. This bit is set to zero at RESET.

STEP MSP: This bit is only valid when the RUN/-HALT bit is set to zero. This bit, when set to one will single-step the MSP one Instruction. The new microcode address will be placed into the CPU microcode address pointer register. The single-stepping procedure might take as long as two system cycle times. This bit is write only, and returns zero when read.

HSAB ENABLE: This bit, when set to 1 enables the HSAB to transmit and receive data. The MSP will wait until the next sync pulse before enabling operation. This bit is set to zero at RESET.

RAM HEIGHT 256K/IM/4M: These two bits indicate to the MSP what type of RAM is attached. The RAM must be all one type, which can be 256K×N bit chips (00), 1M×N bit chips (01) or 4M×N bit chips (I 0). These bits are read/write, and are zero after RESET.

BANK 0=16/24 bit: This read/write bit indicates the RAM bank's data width. When zero, it indicates 12 data bits are attached; when one, that there are only 8 data bits. This bit affects how the data is interpreted when reading. Twenty-four bit data is read and written normally. When reading from sixteen bit external RAM, the lower eight bits of the Internal MSP twenty-four bit word will be equal to the sign bit of the data read.

BANK 1=16/24 Bit: This read/write bit indicates the RAM bank's data width. When zero, it indicates 12 data bits are attached; when one, that there are only 8 data bits. This bit affects how the data is interpreted when reading. Twenty-four bit data is read and written normally. When reading from sixteen bit external RAM, the lower eight bits of the internal MSP twenty-four bit word will be equal to the sign bit of the data read.

BANK 2=16/24 Bit: This read/write bit indicates the RAM bank's data width. When zero, it indicates 12 data bits are attached; when one, that there are only 8 data bits. This bit affects how the data is Interpreted when reading. Twenty-four bit data is read and written normally. When reading from sixteen bit external RAM, the lower eight bits of the Internal MSP twenty-four bit word will be equal to the sign bit of the data read.

BANK 3=16/24 Bit: This read/write bit indicates the RAM bank's data width. When zero, it indicates 12 data bits are attached; when one, that there are only 8 data bits. This bit affects how the data is interpreted when reading. Twenty-four bit data is read and written normally. When reading from sixteen bit external RAM, the lower eight bits of the internal MSP twenty-four bit word will be equal to the sign bit of the data read.

BANK 4=16/24 Bit: This read/write bit indicates the RAM bank's data width. When zero, it indicates 12 data bits are attached; when one, that there are only 8 data bits. This bit affects how the data is interpreted when reading. Twenty-four bit data is read and written normally. When reading from sixteen bit external RAM, the lower eight bits of the internal MSP twenty-four bit word will be equal to the sign bit of the data read.

BANK 5=16/24 bit: This read/write bit indicates the RAM bank's data width. When zero, it indicates 12 data bits are attached; when one, that there are only 8 data bits. This bit affects how the data is interpreted when reading. Twenty-four bit data is read and written normally. When reading from sixteen bit external RAM, the lower eight bits of the internal MSP twenty-four bit word will be equal to the sign bit of the data read.

BANK 6=16/24 bit: This read/write bit indicates the RAM bank's data width. When zero, it indicates 12 data bits are attached; when one, that there are only 8 data bits. This bit affects how the data is interpreted when reading. Twenty-four bit data is read and written normally. When reading from sixteen bit external RAM, the lower eight bits of the internal MSP twenty-four bit word will be equal to the sign bit of the data read.

BANK 7=16/24 Bit: This read/write bit indicates the RAM bank's data width. When zero, it indicates 12 data bits are attached; when one, that there are only 8 data bits. This bit affects how the data is interpreted when reading, twenty-four bit data is read and written normally. When reading from sixteen bit external RAM, the lower eight bits of the internal MSP twenty-four bit word will be equal to the sign bit of the data read.

x. Interrupt Control Register This 16 bit register provides control of the MSP's conditional and Interrupt operations. The bits and their meanings are:

ENABLE INTERRUPTS: This bit, when written as a one, allows any pending interrupts or future interrupts to alert the CPU through the hardware interrupt request signal. When cleared, no interrupts are generated. In any case, interrupts can be accumulated in the interrupt pending registers. This bit is read/write, and is set to zero at reset.

CLEAR ALL INTERRUPTS: This write only bit, when written as a 1, will clear all pending interrupt requests from the interrupt registers and the interrupt request mechanism. When written with a zero, this bit has no effect, This bit, when read, returns zero.

CONDITIONAL STATE, CPU: This bit, when read, indicates the current state of the CPU condition flog. When written, it sets the CPU condition to true when written as a one, and false when written as a zero. This bit is set to zero at reset.

CONDITIONAL STATE: This read-only bit indicates the current state of the If-then-else flag mechanism, explained previously (FIG. 6B).

LED CPU OVERRIDE: This read/write bit, when written as a 1, causes the CPU to override the internal MSP LED setting. The LED output state then is determined by the state of the LED ON, CPU bit described below. When the LED CPU OVERRIDE bit is written as a 0, the LED output is determined by the internal MSP setting. This bit is set to zero at reset.

LED ON, CPU: This bit, when read, indicates the current state of the software LED bit. When written, it sets the LED bit to true when written as a one, and false when written as a zero. This bit is set to zero at reset.

LED ON: This read only bit, indicates the current state of the LED output.

CLEAR DRAM DECREMENT COUNTER: This bit, when written with a one clears the delay line area's decrement counter. When written with a zero, it has not effect. This bit is write only, and returns a zero when read.

CLEAR Y DECREMENT COUNTER: This bit, when written with a one clears the Y-memory area's decrement counter. When written with a zero, it has not effect. This bit is write only, and returns a zero when read.

y. ALU Configuration Register

This 16 bit register contains the bits that define the operating mode of the MSP's ALU. All bits are read/write. This register does not produce any wait states to the CPU. The bits and their meanings are:

OSCILLATOR1 TABLE SIZE 256/512/1024/2048: These two bits indicate the table length to be used for the OSCILLATOR1 instruction. Four table lengths are allowed: 256 words (00), 512 words (01), 1024 words (10) or 2048 words (11).

OSCILLATOR2 TABLE SIZE 256/512/1024/2048: These two bits indicate the table length to be used for the OSCILLATOR2 instruction. Four table lengths are allowed: 256 words (00), 512 words (01), 1024 words (10) or 2048 words (11).

HAMMER TABLE SIZE 256/512/1024/2048: These two bits indicate the table length to be used for the HAMMER instruction. Four table lengths are allowed: 256 words (00), 512 words (01), 1024 words (10) or 2048 words (11).

DITHER SELECT: These four bits determine the bits to be used by the DITHER instruction,

| DITHER SELECT | Bit #'s to Dither |
|---|---|
| 0000 | 0 |
| 0001 | 1..0 |
| 0010 | 2..0 |
| 0011 | 3..0 |
| 0100 | 4..0 |
| 0101 | 5..0 |
| 0110 | 6..0 |
| 0111 | 7..0 |
| 1000 | 8..0 |
| 1001 | 9..0 |
| 1010 | 10..0 |
| 1011 | 11..0 |
| 1100 | 12..0 |
| 1101 | 13..0 |

-continued

| DITHER SELECT | Bit #'s to Dither |
|---|---|
| 1110 | 14..0 |
| 1111 | 15..0 |

z. NOP Start Register

This 9-bit read/write register contains the address of the first microcode instruction which is to be ignored and replaced by a NOP. If the value in the NOP Count register is equal to zero, then the NOP function is disabled and the value in this register is meaningless. This register does not produce any wait states to the CPU.

aa. NOP Count Register

This 10-bit read/write register contains the number of microcode instructions which are to be ignored and replaced by NOP procedures. If the value in this register is equal to zero, then the NOP function is disabled. This register does not produce any wait states to the CPU.

bb. DRAM Decrement Count Register

This 24-bit read-only register contains the current value of the DRAM decrement counter. This register is valid only when the MSP is halted. This register does not produce any wait states to the CPU. This register is 24-bits wide, and appears to the 16-bit host interface as a long word. For BIGENDIAN=1, the LSbit of the higher addressed word is the LSbit of the MSP's word. For BIGENDIAN=0, the LSbit of the lower addressed word is the LSbit of the MSP's word.

cc. Y-RAM Decrement Count Register

This 8-bit read-only register contains the current value of the Y RAM decrement counter. This register is valid only when the MSP is halted. This register does not produce any wait states to the CPU.

dd. Test Configuration Register

This 16 bit register provides control of the MSP's test mode operation. These bits are valid only If the TSTMODE Input pin is high. When this pin is low, test mode is disabled and these bits are meaningless. All bits are zero after RESET, The bits and their meanings are:

- MICROCODE RAM BIST PASSED: This bit, when one indicates that the microcode RAM built-in self-test completed successfully.
- MICROCODE RAM BIST COMPLETED: This bit, when one indicates that the microcode RAM built-in self-test completed.
- MICROCODE RAM BIST ENABLED: A zero-to-one transition of this bit initiates the microcode RAM built-in self-test.
- MULTIPLEXED TEST OUTPUT SELECT: These five bits select one of 32 Internal nodes to be multiplexed to the TSTMUXOUT pin.
- COUNTERS TEST ENABLE: This bit, when one enables the MSP counter test mode.
- RAM DATA SELECT: These two bits select either the X, Y, or INTERNAL bus to be multiplexed to the RAMDATA output pins when the RAM DATA ENABLE bit is high.
- RAM DATA ENABLE: This bit enables the RAMDATA pins to provide observability to additional internal data bits.

V. Voice Allocation Procedures (FIGS. 7-20)

A DSP system resource allocation scheme is described that allows various compute and memory resources (not necessarily delimited by hardware boundaries) to be assigned to arbitrary algorithms and activated in real time without disrupting currently active algorithms in the same system. The primary purpose for such a system is to enable dynamic voice allocation in a DSP based electronic music synthesizer between voices requiring differing DSP algorithms.

Given the hardware environment described with reference to FIGS. 2 through 6, an understanding of dynamic voice allocation according to the present invention can be gained. Generally, dynamic voice allocation involves an understanding of the resource requirements of voice programs, the resources available in the host and music synthesis processing modules to execute those algorithms, and the processes involved in activating processing of the selected voice programs. To provide this understanding, a general discussion of the requirements of voice programs, steps needed to activate the voice programs, and the techniques used to make these steps fast enough for real time systems are provided.

In this discussion of voice allocation details, the following definitions are used:

- Algorithm—a method for processing signals that performs a specific task or function. When the algorithm executes a voice, it is referred to as a voice program.
- DSP—Digital signal processing or Digital signal processor. This refers either to the task of processing digital signals or the hardware chip doing the processing used in the present application for producing sound data.
- Host—the main CPU that controls the system and performs sub-audio rate of the DSP processing.
- Dynamic Voice Allocation—the redistribution of voice processing resources according to need.
- Voice—an instance of an algorithm for a very specific task of either producing signals or processing signals. In this discussion, a voice program is any algorithm needing processing resources to execute a selected voice.
- Effect—a voice that processes rather than generates audio signals.
- Note—a collection of voices triggered by the keyboard, MIDI, note event or other note source.

A. Algorithm Resource Requirements

Each DSP algorithm in the system may have the following resource requirements:

- MSP (music signal processor DSP) resources for audio rate processing:
- DSP Instructions.
- DSP memory:
  - Internal registers.
  - Delay line memory.
  - Lookup table memory.
  - PCM data memory.
- Host CPU resources for non-audio rate processing.
  - Host instructions.
  - Host memory:
    - Local data memory (referred to as P-stack data).
    - Global data memory (referred to as Mailbox data).
    - Lookup table memory.

Input/output resources.
- Audio rate inter-DSP signal communication channels.
- Audio rate input and output signal conversion channels.

B. Resource Groups

In the preferred system, the resources are allocated in nearly orthogonal groups organized so that specific resources with similar attributes are grouped together as one resource type, and as few of the attributes of the resources in the group are shared by any other group. The purpose for this is to simply reduce the dimensions of the resource allocator, and to maximize resource availability.

For example, the relative amounts of DSP instructions, registers, and delay lines used by each algorithm in a group of different algorithms is relatively constant from algorithm to algorithm, and the total quantity of the resources scales with the number of algorithms present. Conversely, the quantity of lookup tables required by these algorithms is not correlated to the number of algorithms present, but rather the similarities between the algorithms. If all the algorithms were the same, the number of shared tables would be at a minimum, and some lookup tables are more likely than others to be shared by several algorithms.

The attributes of the resources determine the groupings. These attributes include:
- Physical location or limitations.
- Relationship to an instance of an algorithm (e.g., is it shared or algorithm specific?).
- Relationship to the architecture of an algorithm (e.g., how shared or specific is it?).
- Relationship to the state of the algorithm (e.g., in its life cycle).

The resource groups organize the resources described above according to their attributes as follows:
- Audio rate processing (DSP system) resources:
  - MSP resource units (MRU's) include space for DSP instructions, internal registers, and delay lines. Each MRU includes a specified amount and location in MSP instruction memory, register memory and delay line memory.
  - Shared system table space.
  - Shared user table space.
  - PCM table space.
- Sub-audio rate processing (Host CPU system) resources.
  - P-stack memory (processing stack memory) includes host CPU instructions and local data.
  - Mailbox memory.
  - Lookup table memory.
- Audio I/O resources:
  - HSAB summation buses.
  - HSAB distribution buses.
  - DAC and ADC channels.

In addition to the above resource groups, there are a number of additional resources groups that are related to the host CPU processes that perform the setup, allocation, and initialization of the DSP algorithms.

C. Algorithm Activation Processing

Activation of an algorithm involves allocating and initializing the resources. The primary states of an algorithm are:
- Selection for use
- Pre-initialization setup
- Resource allocation
- Resource initialization
- Algorithm activation
- Algorithm use
- Algorithm deactivation
- Resource deallocation These general states are broken down into sub-states for each resource. The resource states really dictate the actual state sequences and order of processing. This is necessary since it organizes the processing into regions of time when the processing can be performed without having a detrimental impact on the real time behavior of the system.

The hardware capabilities and memory organization of the system define the durations of the processing in each resources' states. There are really only two states-time domains: non-real time, and real time.

There is a crossover of these two domains, since some resources require the allocation-initialization phase in the non-real time domain, while other resources are capable of the allocation-initialization-activation phases in the real time domain. This is the essence of the problem: identifying what techniques are required to make a resource capable of real time allocation-initialization.

The non real time domain is called "setbuild", while the real time domain is named according to the various software system components ("voice allocation", "controller processing", "voice update", "MIDI", etc.).

D. Algorithm Sets

Deterministic resource allocation is made possible by identifying the algorithms that can share resources without requiring non-real time resource reallocation. The resources that are allocated at setbuild time are:
- Host and MSP lookup table memory.
- PCM memory.
- DAC and ADC channels.
- Algorithm resources for algorithms that are not dynamically allocated (for example, effects and modulation controller algorithms).
- Voice allocation resources (initialization templates, control structures, etc.).

These resources are not dynamically allocated for one of two reasons: it is not possible in the system to initialize the resources in real time, or the algorithms needing the resources are required at all times.

Whether an algorithm is allowed in a set with other algorithms depends on the quantities of these resources available in the system. Since these resources are not dynamically allocated, they must be available for every member of the set at all times. The algorithms within a set are guaranteed to have whatever resources are required when they need to run. The resource states described below apply to all the algorithms of the set.

E. Resource States

This section describes the state transitions for algorithm resources.

1. MRU's (MSP Resource Units)

The MSP microcode (μcode)instructions, internal registers, and circular delay lines are grouped together since they share similar attributes (they're all located in MSP, their use is specific to each algorithm, and they all get allocated and initialized at the same time). Algorithms are currently allocated MRU's in contiguous fixed sized blocks within an MSP depending on the requirements of the algorithm: i.e. each algorithm gets only as many MRU's as it needs, allowing several algorithms to use the MRU's available within an MSP. Algorithms should not span MSP boundaries in this system, since this would require additional HSAB channels (depending on its position, and how many algorithm pieces needed connecting) and would make a correlation between the physical position of an algorithm and the HSAB resource requirements it has.

a. MSP Instructions

MSP instructions for an algorithm are generated by the algorithm compiler and are processed as follows:

Setbuild:
- Locate μcode object code in host memory.
- Make a copy of μcode in the template μcode area in isolated memory for each possible position (per segmentation of MSP μcode memory MRU's).
- Link these images to resources whose physical positions are known at the this time (delay lines, registers, shared tables, etc.), this is known as "relocating the ucode."

Voice allocation:
- Determine target MRU(s).
- Copy μcode template for MRU(s) to download buffer in isolated memory.
- Perform final link to other resources being allocated at this time (HSAB buses).
- Disable target MSP instruction code slot (NOP the code segment).
- Copy downloaded buffer to target MSP instruction code slot (DMA ucode download level to MSP).
- At voice startup time, enable target MSP instruction code slot (disable NOP of code segment).

b. MSP Data Registers

MSP data registers are allocated by the algorithm compiler and assigned to the μcode as needed. The μcode processing described above details the linkage of the registers within the MRUs. The initial data values of the registers are processed as follows:

Setbuild:
- Locate constant parameters in host memory.
- Create table of constant init values in template data area in isolated memory.

Voice allocation:
- Copy constant init data template to MSP register download buffer.
- Perform time-zero initializations of host-rate to audio-rate signal communications (run initialization control strings on the host, and write outputs to the MSP register download buffer).
- Copy register download buffer to MSP register using DMA.

c. MSP Delay Lines

MSP delay lines are allocated by the algorithm compiler and assigned to the μcode as needed. The μcode processing described above details the linkage of the delay lines within the MRUs. Delay lines are processed as follows:

Setbuild:
- Locate delay line resource requirements for μcode.
- Create delay line component of DRAM configuration register initialization templates in template area. There is one configuration for each relocated code template.

Voice allocation:
- Copy DRAM register initialization template for target MRU block into the target MSP.
- Initialize delay lines to al zero values (performed by hardware using delay line length registers).

2. MSP lookup tables

MSP lookup tables are duplicated in each MSP's table lookup memory to allow symmetric allocation of algorithms into any MSP. Tables are downloaded to all MSPs simultaneously with the assistance of a special DMA channel in the SIC chip. This dedicated hardware shortens the table download time considerably. MSP tables are processed as follows:

Setbuild:
- Locate lookup tables or table definitions.
- Create or copy the tables into the table download buffer in isolated memory.
- Copy the download buffer to each MSP's lookup table memory (done by dedicated hardware that DMAs the data to all MSPs simultaneously).
- Create lookup table component of DRAM configuration register initialization templates in the template area. There is one configuration template for each relocated ucode template.

Voice Allocation:
- Copy DRAM register initialization template for target MRU block into the target MSP.
- Initialize delay lines to all zero values (performed by hardware using delay line length registers).

3. PCM Data

PCM data is treated similarly to MSP lookup tables. The difference between lookup tables and PCM data is where the data is stored. PCM data is loaded into special PCM memory currently available on only one MSP. This restriction is a cost saving measure. Algorithms that require PCM data can only be allocated to the MSP that has it. Additionally, PCM data is not stored in the host's memory, it is loaded directly off the permanent storage media into the PCM data memory. The only processing for the PCM data is as follows:

Setbuild:
- Create PCM component of DRAM configuration register initialization templates in template area. There is one configuration template for each relocated ucode template.

Voice allocation:
- Copy DRAM register initialization template for target MRU clock into the target MSP.

4. Host Instructions

All non-audio rate processing is performed on the host CPU using DSP subroutines that implement the DSP processing blocks available to the algorithm designer. These processing blocks are essentially DSP instructions, and the host CPU instructions are lists of these processing blocks. These lists are called "control strings" and are implemented as lists of data blocks containing the operation to perform, any local data and constants, and information for where input and output data are stored. These data blocks are called "P-stacks" which is short for parameter stacks. The processing for these is described below.

Host control string P-stacks are processed as follows:

Setbuild:
- Locate control string definitions. Expand control string definitions into control string templates in the template area in non-isolated host memory.

Link control strings to all preallocated resources (host mailboxes for statically allocated algorithms, host lookup tables, etc.).

Voice allocation:

Copy control string templates into host memory allocated for the algorithm.

Link algorithm control strings to required resources (host mailboxes, MSP registers, MSP interrupts, etc.).

Perform time-zero initializations of control string data using global and voice allocator data.

At voice startup time, start processing real time update control strings (continuous host algorithm processing).

5. Host Mailboxes

Data communication between host DSP processes is performed using "mailboxes." Mailboxes are currently located in a region of memory that is more quickly accessed than normal host memory. Since the mailbox memory region is limited, mailboxes are allocated as a (possibly discontiguous) set of fixed size blocks. This allocation strategy has a deterministic success characteristic not available with variably sized contiguous block allocation schemes. Mailbox processing is performed as follows:

Setbuild:

Create mailbox linkage table in the template area. This linkage table will be filled in when the mailboxes are allocated at voice allocation time.

Voice allocation:

Fill in mailbox linkage table with addresses of allocated mailbox blocks.

Using mailbox linkage table, link mailboxes to control strings.

6. Host Lookup Tables

Host lookup tables are identical to DSP lookup tables except where they are stored. Host lookup tables are stored in host memory. Host lookup tables are processed as follows:

Setbuild:

Locate lookup tables or table definitions.

Create or copy the tables into the host table area.

Link lookup tables to host control string templates.

7. HSAB

All audio rate signal communication is performed by the high speed audio bus (HSAB) that interconnects the MSPs and the digital/analog interfaces. The HSAB currently provides 128 simultaneous write-once-read-many-inter-MSP communication channels per sample. In order to allow symmetric allocation of an algorithm into any MSP, the outputs of dynamically allocated algorithms are connected to the input of statically allocated algorithms using symmetrical "summation buses" created using the HSAB and additional DSP processing added to the algorithms.

Summation buses are allocated as a block of HSAB channels, one channel per MSP, and some MRUs to provide the processing resources required for the summation of all the HSAB channels from each MSP. Each algorithm that contributes to the summation bus is appended with the necessary DSP code to perform the local summation of any other algorithms present in the same MSP onto the MSP's channel of the summation bus.

Alternatively, these summations may be performed in hardware using bitwise addition from MSP to MSP.

HSAB bus access is controlled using HSAB map registers in each MSP. These registers map the HSAB channels to internal MSP I/O registers, and allow HSAB channels to be reassigned to different I/O registers without disrupting existing channel assignments. This is currently necessary since there are more HSAB channels than there are MSP I/O registers. HSAB channels are processed as follows:

Setbuild:

Create an HSAB channel to MSP I/O register linkage table template in the template area, one per algorithm. The linkage table identifies the logical channels used by the algorithm when it is connected to other algorithms in the system.

Fill in the linkage table with any preallocated HSAB channels (preallocated algorithm interconnections, DAC and/or ADC channels, etc.).

Voice allocation:

Copy the linkage table template to a work area.

Fill in the linkage table with any new allocated HSAB channels.

Download the linkage table to the HSAB configuration map registers in the target MSP.

F. Dynamic Voice Allocation Model

Figure 7:
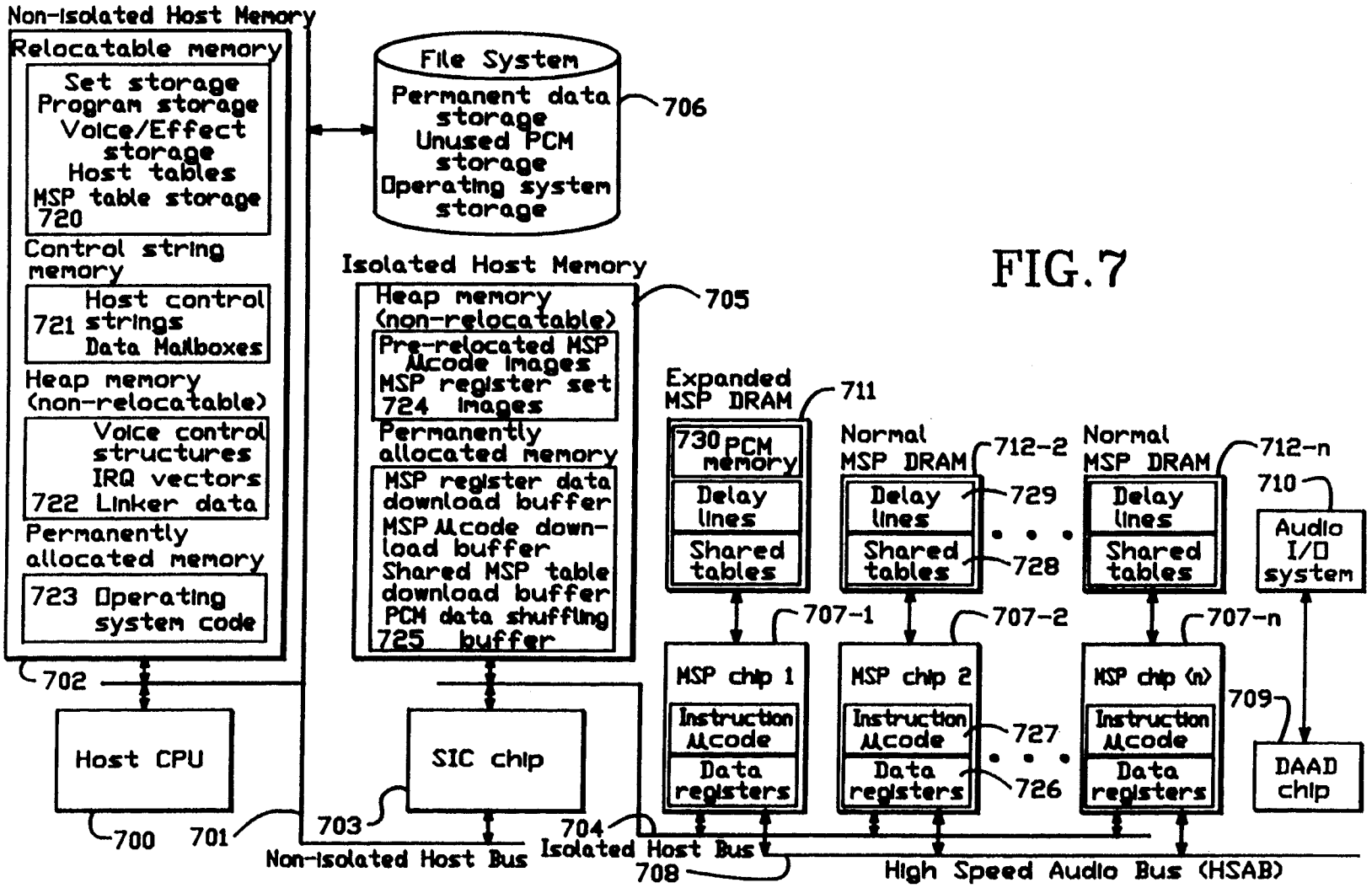
FIG. 7 provides memory and hardware model of the dynamic voice allocation system according the present invention.

FIGS. 7 through 20 illustrate the operation of the preferred dynamic voice allocation system according to the present invention. FIG. 7 provides a memory and hardware model for the dynamic voice allocation system according to a preferred embodiment. As described above, the system includes a host CPU 700 coupled to a non-isolated host bus 701. The non-isolated host bus 701 is coupled to non-isolated host memory 702 and a system integration chip 703 (SIC). The SIC chip is coupled to an isolated host bus 704 and a isolated host memory 705.

A file system memory 706 is coupled to the non-isolated host bus 701 implemented with non-volatile storage such as E-PROM, floppy disks, and/or hard disks.

An array of MSP chips, including MSP chip 1 through MSP chip n given reference numbers 707-1 through 707-n in the figure, are coupled to the isolated host bus 704.

A high speed audio bus 708 is coupled also to the MSP chips 707-1 through 707-n. A digital-to-analog and analog-to-digital interface chip 709 is coupled to the high speed audio bus 708 and to an audio I/O system 710.

MSP memory is coupled to each of the MSP chips 707-1 through 707-n. There is an expanded MSP memory 711 coupled to the first MSP chip 707-1. MSP memory modules 712-2 through 712-n are coupled to corresponding MSP chips 707-2 through 707-n.

The non-isolated host memory 707 includes four memory areas referred to as relocatable memory 720, control string memory 721, heap memory (non-relocatable) 722, and permanently allocated memory 723. The relocatable memory includes area for storage of a set of voice programs or sets of voice programs, general program storage, voice and effect storage, host tables, and MSP tables. The control string memory 721 stores host control strings and data mailboxes. The heap memory 722 stores voice control structures, interrupt vectors, and linker data. The permanently allocated memory 723 stores operating system code.

The file system memory 706 provides for permanent data storage, unused PCM data storage, and operating system storage.

The isolated host memory 705 includes a heap memory area 724 and a permanently allocated memory area 725. The heap memory area is non-relocatable and stores pre-relocated MSP microcode images and MSP register set images. The permanently allocated memory 725 provides an MSP register data download buffer, an MSP microcode download buffer, shared MSP table download buffer and PCM data shuffling buffer. As described above, each MSP chip includes memory for a set of data registers, e.g. 726, and a set of microcode instructions 727. DRAM coupled to the MSP chips includes area for shared tables 728 and delay lines 729. In the expanded DRAM 711, PCM memory 730 is provided for use by MSP chip 707-1.

Both the isolated and non-isolated host buses are accessible by the host at any time. However, the isolated bus can be used independently of the non-isolated bus when not accessed by the host. This allows the SIC chip to perform DMA to and from the MSPs while the host is running code and accessing data in non-isolated memory 702.

The MSP register data download buffer in the permanently allocated memory 725 of the isolated host memory 705, as well as the other download buffers, are used to support DMA transfers from the isolated host memory 705 into the MSP areas. Host writes to the MSPs during host control initialization processing, which is done while the microcode is being DMA'd to the MSP are diverted to the buffer which is initialized with the MSP register image. This is done for two reasons: 1) the buffer is faster to access than the MSP registers, so the microcode DMA is less interrupted, and 2) all MSP register values can be downloaded at once using the SIC DMA resources, thus freeing the host for other things. Thus, voice programs being executed by an MSP which receive writes to the register area from the host, may be slightly interrupted during download of other voice programs into the MSP region. However the register data is captured in the register data download buffer and DMA'd into the MSP as soon as the microcode download is completed to minimize the disruption.

The MSP data registers including general register bank X, general register bank Y, delay line configuration registers, and HSAB configuration registers among others, are described in detail above with reference to the description of the MSP chip in FIG. 6.

PCM data is loaded directly from the disk file 706 into the PCM data memory 730. This makes the set build faster for such using PCM, and it relieves the host memory from having to store it. There is a data buffer in isolated host memory for shuffling the PCM data to maximize space availability. Only PCM data sets that are needed by the sounds in memory are loaded.

Each MSP has the same table data in the shared tables area 728 of its local DRAM. The SIC chip provides a capability to DMA the same data into several MSPs at once. This allows all the shared table data to be downloaded with one single operation instead of one for each MSP.

Figure 8:
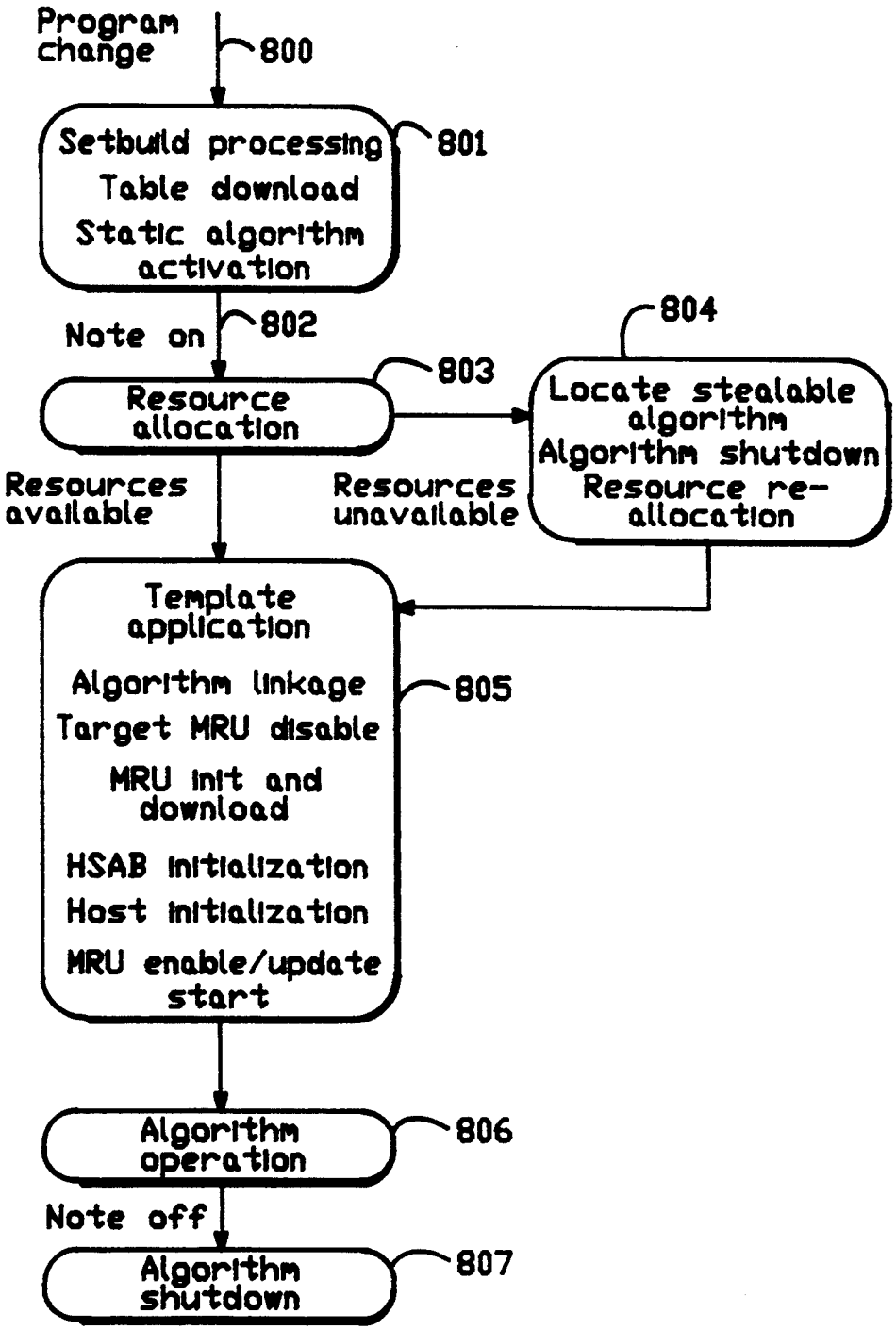
FIG. 8 is an overview block diagram of the voice allocation processing sequence according to the present invention.

The overall operation of the dynamic voice allocation using the system of FIG. 7 can be seen in FIG. 8. In response to a signal indicating program change at line 800, a first processing block performs set build processing, table download and static algorithm activation (block 801). The note is turned on by line 802 and a resource allocation test is performed (block 803). If the resources are unavailable, then the algorithm locates a stealable algorithm in the MSP area, shuts down the stealable algorithm and reallocates the resources to the activated algorithm (block 804). If at block 803 the resources are available, then template application, algorithm linkage, target MRU disable actions are taken as necessary, the target MRU initialization and download are performed, the HSAB is initialized, host strings are initialized, and the MRU update and enable start processing are accomplished (block 805). Next, algorithm operations occurs (block 806) until note off at which time the algorithm is shut down (block 807). For dynamic real time voice allocation, the time between a note on signal at line 802 and algorithm activation in block 806, must be imperceptible to the user of the music synthesizer.

A more detailed description of the algorithms used to accomplish the voice allocation is provided with reference to FIGS. 9 through 20.

Figure 9:
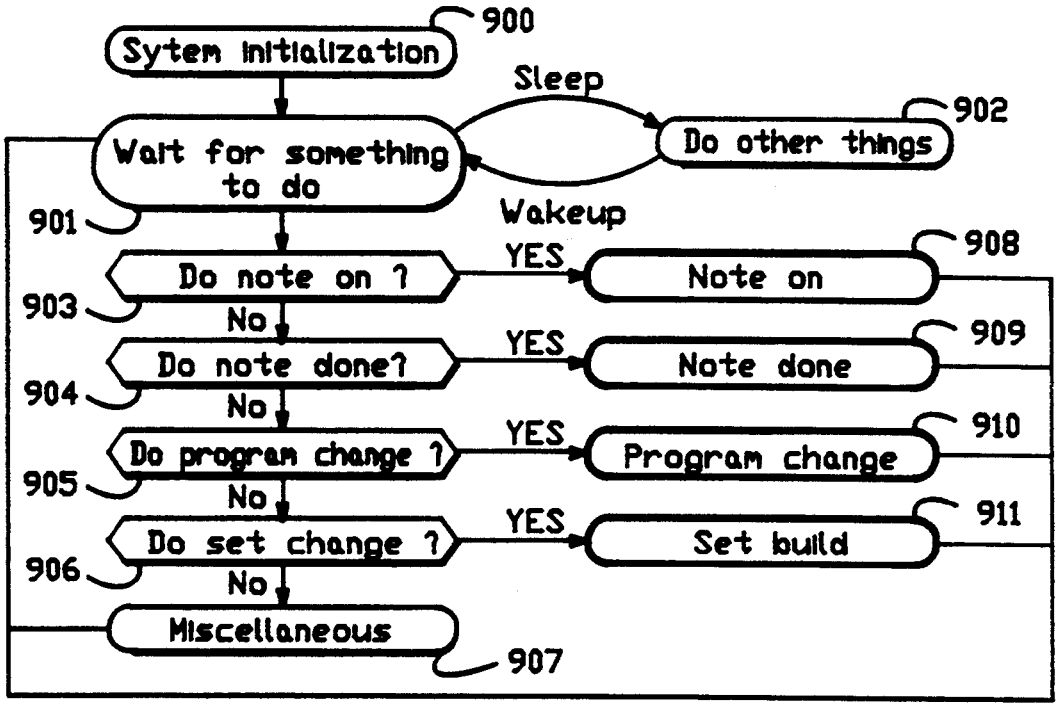
FIG. 9 is a flow chart for the JOB DISPATCHER for use in the system of FIG. 7.

FIG. 9 illustrates the flow chart for the basic JOB DISPATCHER for the synthesizer of FIG. 7. When the system is turned on, a system initialization routine is executed (block 900). After initialization, the system enters a wait loop (block 901). If nothing happens within a specified amount of time, the synthesizer will enter a sleep state in which the host CPU is allowed to do other things (block 902). When called upon to execute the music synthesis, the system wakes up and is capable of responding to four types of input signals. The first signal is a do-note-on command (block 903). The next is a do-note-done command (block 904). The next is a do-program command (block 905). The next is a do-set-change command (block 906). Finally, if none of the commands is received, the routine enters a miscellaneous execution block (block 907). At the miscellaneous block, the algorithm loops back to the wait loop 901.

Figure 10:
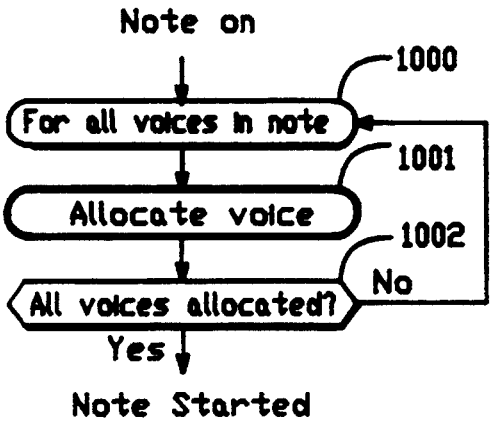
FIG. 10 is a flow chart for the NOTE ON routine called by the JOB DISPATCHER of FIG. 9.

If in block 903, a note-on signal was received, then the algorithm branches to the NOTE-ON routine (block 908) which is shown in FIG. 10. If the do-note-done command was received, then the algorithm branches to the NOTE-DONE routine (block 909) shown in FIG. 11. If the program change command was received, then the algorithm branches to the PROGRAM CHANGE routine (block 910) shown in FIG. 12. Finally, if the algorithm receives a set-change command, then the loop branches to the SET BUILD routine (block 911) shown in FIG. 13.

The do-other-things block 902 indicates task-switching, or multi-threading the current task by going back to the task dispatcher. For multi-threaded tasks, the miscellaneous block 907 in the dispatcher includes pickup points for wherever a wait-state resumes.

FIG. 10 illustrates the NOTE ON routine. This routine involves identifying all voices in the note (block 1000), allocating a first voice in the note (block 1001) using the routine shown in FIG. 14, and then determining whether all voices in the note have been allocated (1002). If all the voices have not been allocated, then the algorithm loops back to block 1000. If all voices have been allocated, then the note is started.

Figure 11:
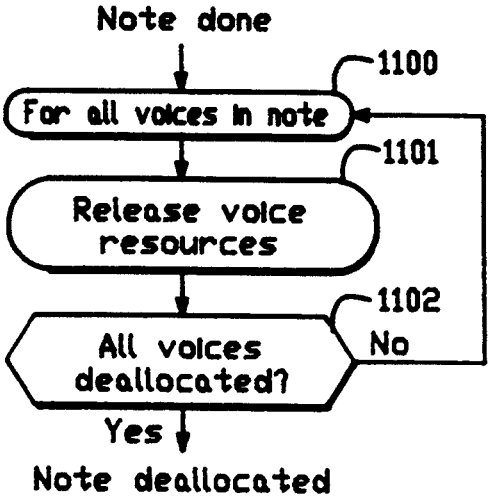
FIG. 11 is a flow chart for the NOTE DONE sub-routine called by the JOB DISPATCHER of FIG. 9.

The NOTE DONE routine corresponding to block 909 at FIG. 9, is shown in FIG. 11. This involves identifying all the voices in the note (block 1100), releasing the voice resources (block 1101), and determining whether the resources for all voices have been deallocated (block 1102). If all voices have not been deallocated, then the algorithm loops back to block 1100. If they have been deallocated, then the note is deallocated.

Figure 12:
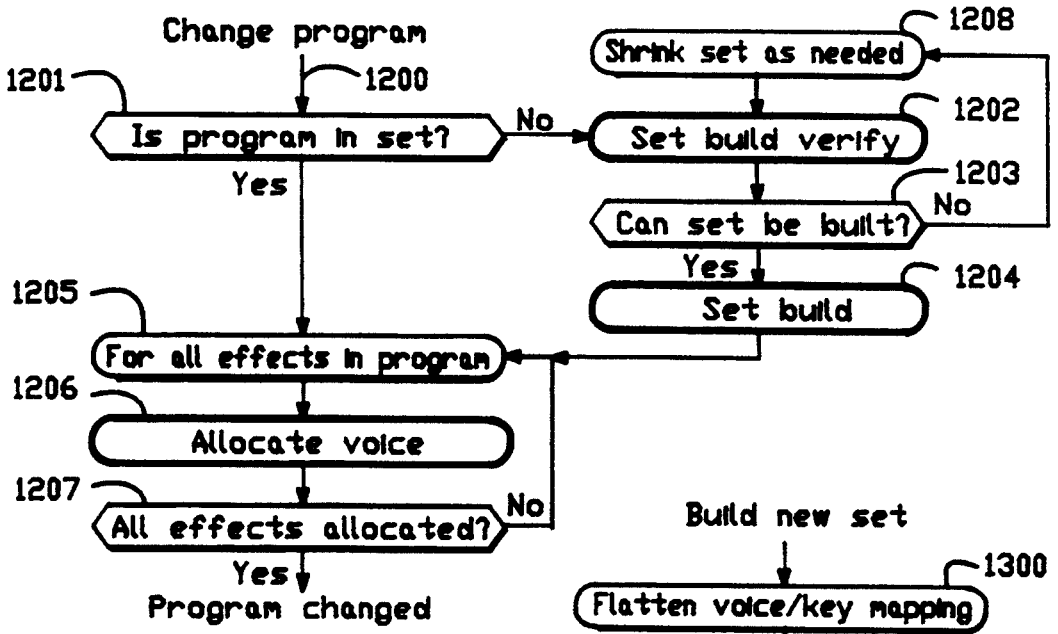
FIG. 12 is a flow chart for the PROGRAM CHANGE sub-routine called by the JOB DISPATCHER of FIG. 9.

FIG. 12 illustrates the PROGRAM CHANGE routine corresponding to block 910 of FIG. 9. First, the PROGRAM CHANGE routine is called at line 1200. The algorithm determines whether the program selected is in the active set (block 1201). If it is not in the set, then the SET BUILD VERIFY routine is executed (block 1202—FIG. 15). After SET BUILD VERIFY, the algorithm determines whether the set including the selected program can be built (block 1203). If it cannot be built, then the algorithm loops to block 1208 where the set is modified as needed. It then loops through the SET BUILD VERIFY block 1202 and the can-set-be-built block 1203. If the set can be built at block 1203, then a SET BUILD routine is executed (block 1204—FIG. 13).

If the program was in the set at block 1201 or after the SET BUILD routine in block 1204, all effects in the program are identified in block 1205. After identifying all the effects, the ALLOCATE VOICE routine is executed (block 1206—FIG. 14). After the ALLOCATE VOICE routine, a test is executed to determine whether all identified effects have been allocated (block 1207). If they have not been allocated, then the algorithm loops back to block 1205. If they have, then the program has been successfully changed in the MSP.

Figure 13:
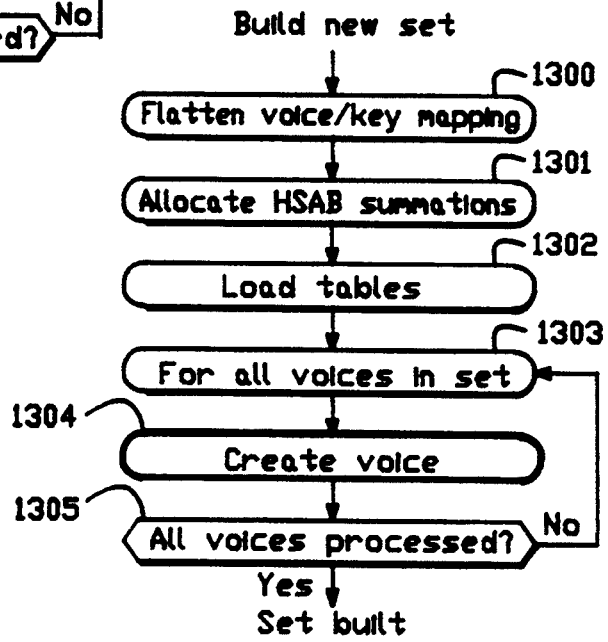
FIG. 13 is a flow chart for the SET BUILD sub-routine called by the JOB DISPATCHER routine of FIG. 9.

FIG. 13 illustrates the SET BUILD routine corresponding to block 911 of FIG. 9. In response to a command requiring a new set, such as block 1204 of FIG. 12, a mapping of the voice and key on the input device is created (block 1300). Next, all HSAB summations are allocated (block 1301) for the set. Then, the tables for the set are loaded into the MSP shared table memory (block 1302). Then the SET BUILD algorithm goes into a loop for all voices in the set (block 1303). For all voices in the set, a CREATE VOICE routine is executed (block 1304—FIG. 16). Next, the algorithm determines whether all voices have been processed in the set (block 1305). If they have not all been processed then the algorithm moves back to block 1303. If they have been, then the set is built.

Figure 14:
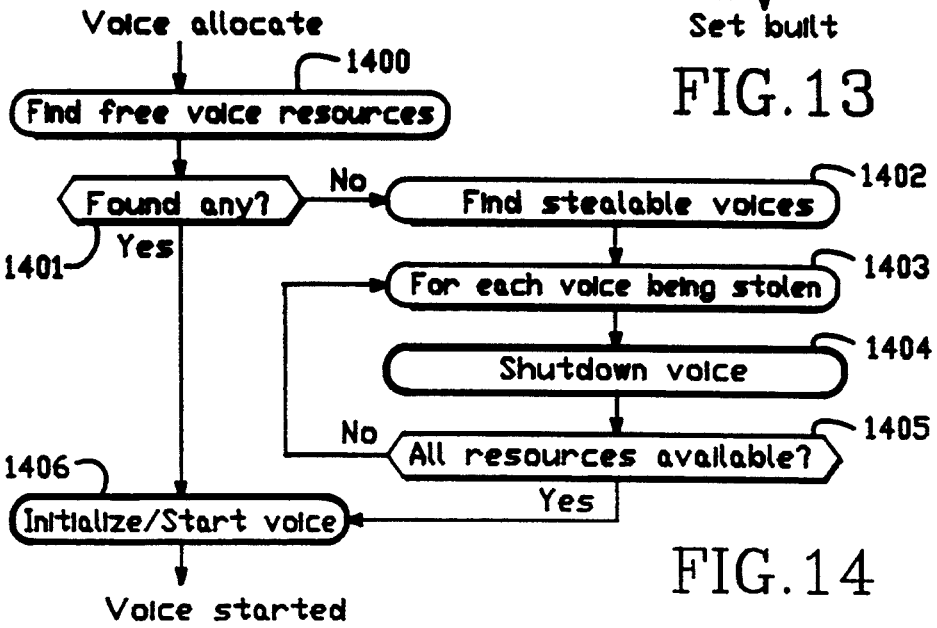
FIG. 14 is a flow chart for the ALLOCATE VOICE routine called by the NOTE ON routine of FIG. 10.

FIG. 14 illustrates the ALLOCATE VOICE routine which is called in block 1001 at FIG. 10 and block 1206 at FIG. 12, When the ALLOCATE VOICE routine is called, the algorithm first looks for free voice resources (block 1400), The algorithm then tests whether any free resources have been found (block 1401). If they have not been found, then the host finds stealable voices from the active group (block 1402). Next, for each voice being stolen, a loop is entered (block 1403). After block 1403, the stolen voices are shutdown by calling a SHUTDOWN VOICE routine (block 1404). After shutting down a voice, the algorithm tests whether sufficient resources are available (block 1405). If they are not, then another stealable voice is shutdown by looping back to block 1403. If they are available, or if free resources were found in block 1401, then the INITIALIZE/START VOICE routine is executed (block 1406—FIG. 18).

Figure 15:
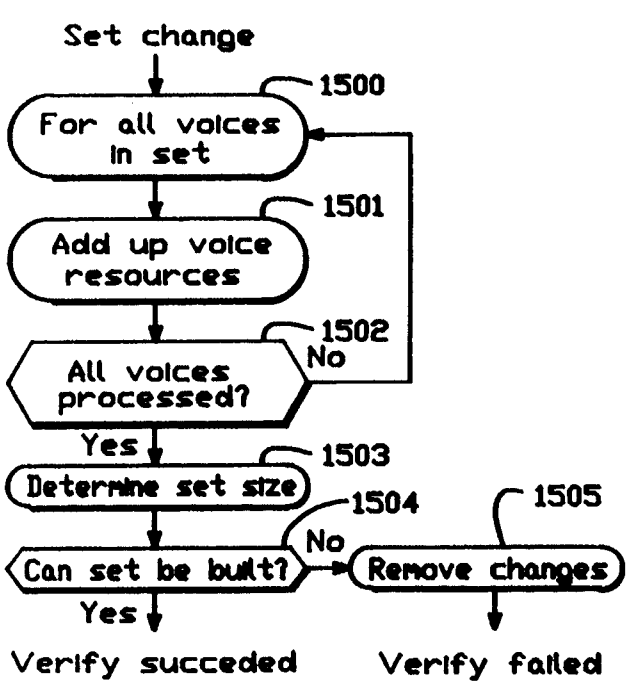
FIG. 15 is a flow chart for the SET BUILD VERIFY sub-routine called by the PROGRAM CHANGE routine of FIG. 12.

FIG. 15 illustrates the SET BUILD VERIFY routine which is called at block 1202 of FIG. 12. This routine verifies that a program may be added to a set. The algorithm first enters a loop for all voices in the set (block 1500). The loop adds up the voice resources for each voice in the set (block 1501) and determines whether all voices are processed (block 1502). If they have not, then it loops back to block 1500. After all the voices have been processed, the algorithm determines the set size (block 1503). Based on this information, it determines whether the set can be built using the resources of the system (block 1504). If the set cannot be built, then all changes are removed and the verify has failed (block 1505). If the set can be built, then the verify has succeeded, and the SET BUILD routine may be executed.

Figure 16:
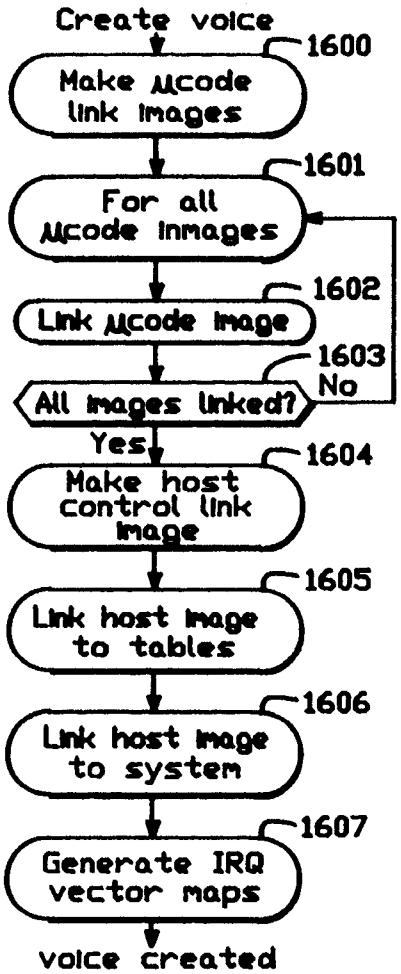
FIG. 16 is the flow chart for CREATE VOICE sub-routine called in the SET BUILD routine of FIG. 13.

FIG. 16 illustrates the CREATE VOICE routine which is called at block 1304 of FIG. 13. This algorithm composes a voice program for a particular key map and other parameters involved in the system. When it is called, it first makes microcode link images (block 1600). Next, a loop is entered for all the microcode images in the voice (block 1601 ). For each microcode image, the microcode image is linked to the instance of the voice (block 1602). Next, it determines whether all images are linked (block 1603). If not, the algorithm loops back to block 1601. If all images had been linked at block 1603, then host control link images are created. (block 1604). The host image is linked to the tables (block 1605). The host image is linked to the system parameters (block 1606) and the interrupt vector maps are generated (block 1607). After these steps are accomplished, the voices have been created.

Figure 17:
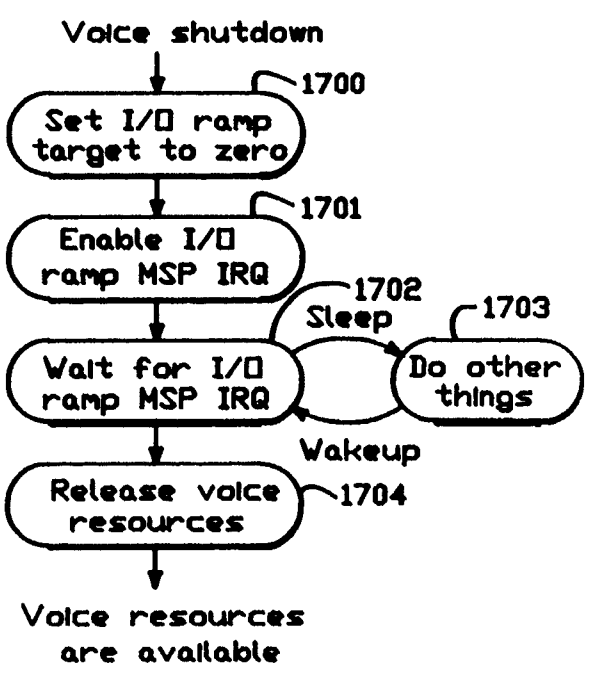
FIG. 17 is a flow chart for SHUT DOWN VOICE sub-routine called by the ALLOCATE VOICE sub-routine of FIG. 14.

FIG. 17 illustrates the SHUTDOWN VOICE routine which is called at block 1404 of FIG. 14. When a voice is being stolen or replaced by a selected voice, the SHUTDOWN VOICE routine first sets an I/O ramp target to zero (block 1700). Next it enables the I/O ramp interrupt channel in the MSP (block 1701). The algorithm then waits for the I/O ramp MSP interrupt (block 1702). While it waits, the routine may enter a sleep state and do other things (block 1703). When the interrupt is received, the voice resources are released (block 704). At this time, the voice resources for the shutdown voice are available.

Figure 18:
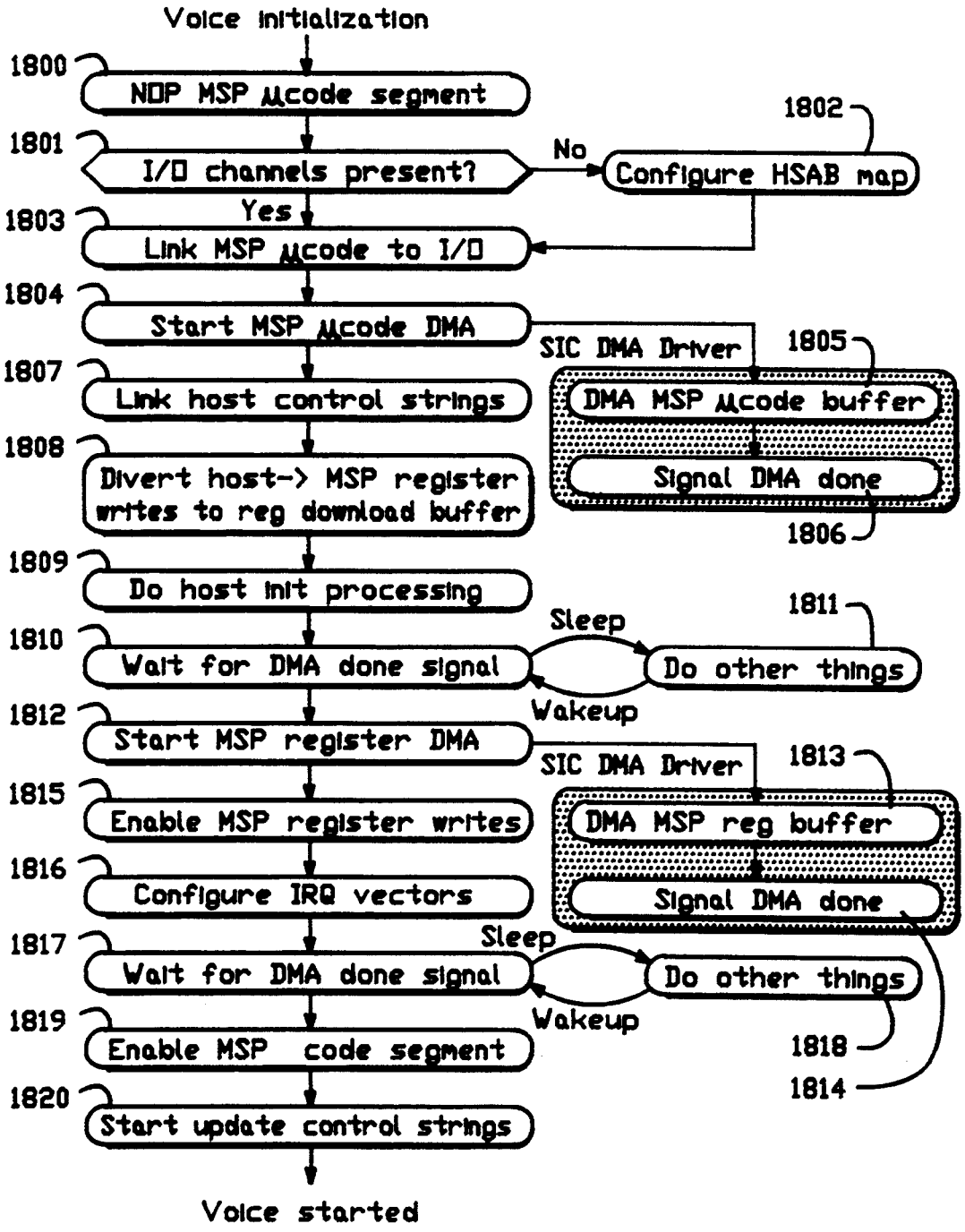
FIG. 18 is a flow chart for INIT/START UP VOICE sub-routine called by the ALLOCATE VOICE sub-routine of FIG. 14.

FIG. 18 illustrates the INITIALIZE/STARTUP VOICE routine which is called at block 1406 of FIG. 14. This routine provides for transferring a voice program in the set to the group of active voice programs coupled to the MSP in the MSP array. For the resources found for the voice to be allocated, the routine initialization is begun at block 1800 where the MSP microcode segment is temporarily masked with the NOP instruction. Next, the algorithm determines whether the algorithm I/O channels are present in the MSP's HSAB map (block 1801). If there are not channels present, then the HSAB map is configured for the voice (block 1802). If the channels are present, then the MSP microcode is linked to the I/O channels (block 1803). Next, the MSP microcode DMA is begun (block 1804). The DMA driver in the SIC chip DMAs the MSP microcode buffer from the isolated host memory (block 1805) and signals when the DMA is done (1806).

The host links host control strings to the voice (block 1807). All host to MSP register writes for such parameters are diverted to the register download buffer in the next block (block 1808). Next, host initialization processing, to generate parameters, such as coefficients, I/O allocation register values, and the like in response to the real time input signals, is executed in parallel with the DMA operation (block 1809). The host then waits for the DMA done signal at block 1810, to be received from block 1806. While waiting, the host may do other things, as indicated at block 1811. After the DMA done signal is received, MSP register DMA is begun for diverted MSP register writes (block 1812). This causes the SIC chip DMA driver to DMA the MSP register buffer (block 1813) and signal when the DMA is done (block 1814). In parallel, the host enables MSP register writes directly to the MSP (block 1815), configures the interrupt vectors (block 1816) and waits for the DMA done signal at block 1817, which is generated by block 1814. While waiting, the host may do other things, as indicated by block 1818. After receipt of the done signal, the host enables the MSP microcode segment (block 1819) and starts the update control strings in the host (block 1820). After these steps have been accomplished, the voice has been started.

Figure 19:
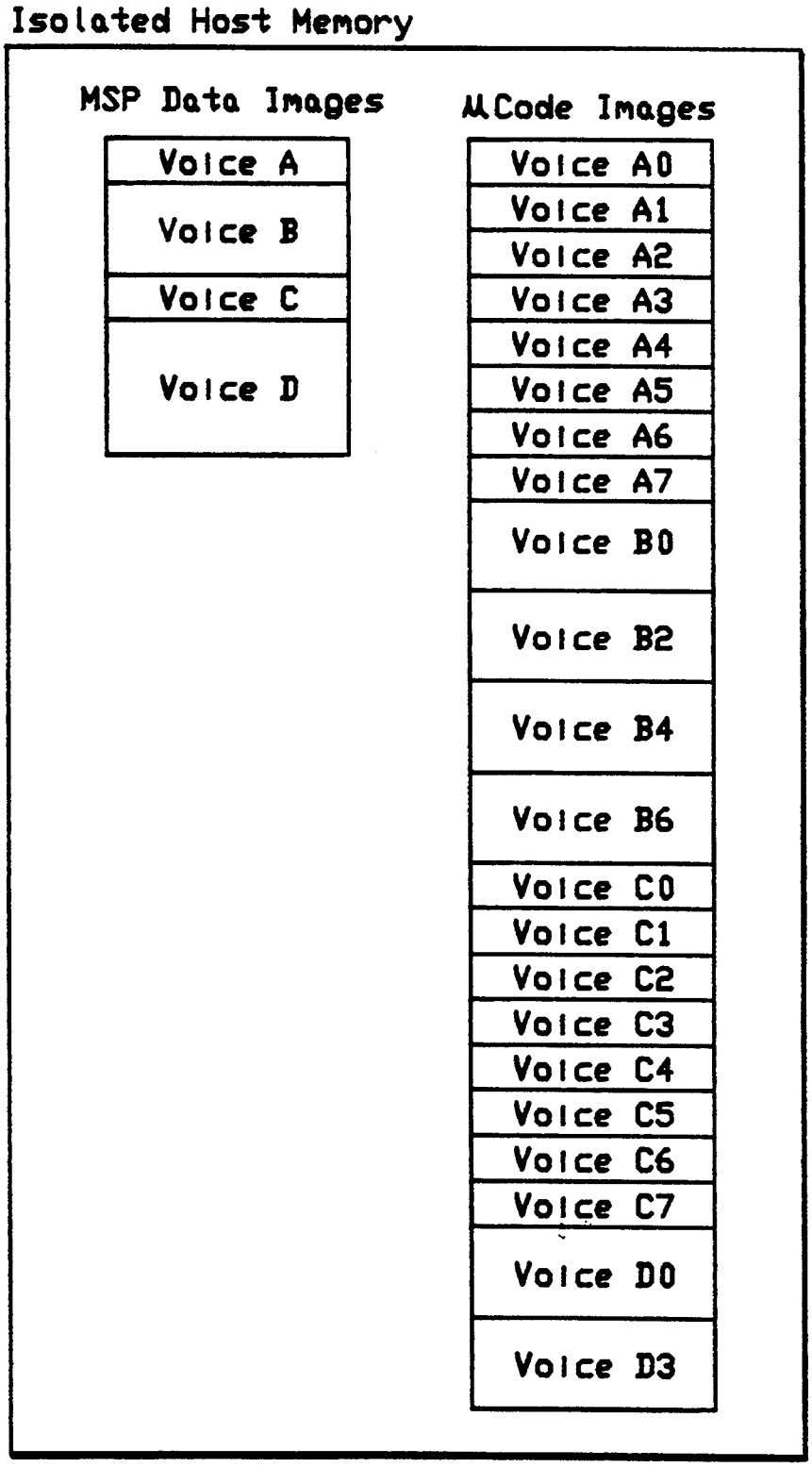
FIG. 19 illustrates voice program images in the isolated host memory for the system of FIG. 7.

FIG. 19 illustrates the MSP data images and microcode images which are stored in the isolated host memory. For instance, in the create voice routine of FIG. 16, microcode link images are stored in the isolated DRAM. One image is made for each possible position of the microcode in the MSP.

Thus, for a system having voices A, B, C, and D, which must be dynamically allocated, a number of images are stored as shown in FIG. 19. Voice A is stored in 8 images referred to as voice A0 through A7. Voice B is stored in 4 images referred to as voice B0, B2, B4, and B6. Voice C is stored in 8 images referred to as voices C0 through C7 and voice D is stored in 2 images referred to as voice D0 and D3. The data images for each of the voices are also stored in the isolated voice memory. However, because the location of the data is predetermined, only one image of the data for the voice needs to be stored as indicated in FIG. 19.

The creation of microcode images is done by linking a copy of the microcode to its associated MRU resources (instructions, registers, delay-lines, interrupts) for a specific starting instruction number in the MSP. Since the selected starting positions and size of a voice affect the number of images required, the time it takes to determine what voices can be stolen, and how much buffer memory is required for the images, not every possible starting position is considered.

Figure 20:
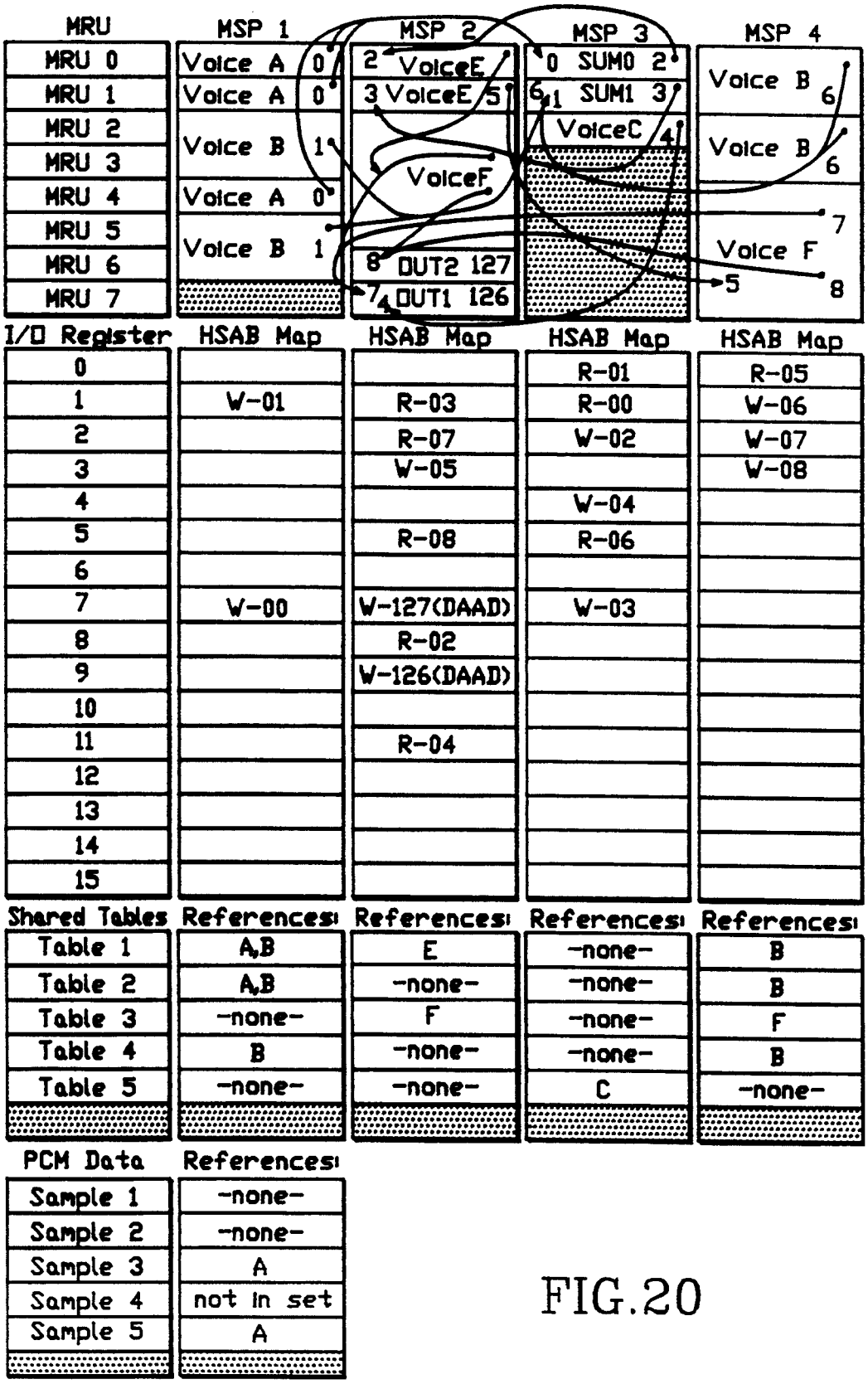
FIG. 20 illustrates the voice program images for a group of a voice programs stored in the MSP memory for the system of FIG. 7.

FIG. 20 provides a mapping of the MSP MRUs 0–7 for a 4 MSP system executing 6 voices including the dynamically allocatable voices A through D shown in FIG. 19, and static voices E and F. Also, the mapping of the I/O registers to the HSAB, the mapping of shared tables, and the mapping of the PCM data are shown. This diagram shows a 4 MSP system with 8 MSP resource unit (MRUs) per chip. The system described with reference to FIG. 7 includes 9 MSPs with 32 MRUs available to any given voice. The example provided in FIG. 20 is expandable in a straightforward manner to the 9 MSP system, since MRU availability is symmetrical except where PCM memory is required at the MSP coupled to the expanded DRAM.

In the example shown in FIG. 20, voice A has three instances at MRU 0, MRU 1 and MRU 4 of MSP 1. Voice B has three instances as well at MRUs 5 and 6 of MSP 1, MRUs 0 and 1 of MSP 4, and MRUs 2 and 3 of MSP 4. Voice C has a single instance at MRU 2 of MSP 3. Voice D is not allocated. Voice E has two instances in MRU 0 and MRU 1 respectively of MSP 2. Voice F also has two instances in MRUs 2 through 5 of MSP 2 and MRUs 4 through 7 of MSP 4. Two HSAB summing outputs are also assigned MRUs 6 and 7 of MSP 2.

The I/O register mapping is shown with arbitrary register mappings to illustrate that there is no requirement that registers correlate with channels. This allows registers to be allocated as needed. Similarly, channels can be dynamically allocated if they are not already present.

The shared table memory includes five memories. References to Tables 1 and 2 of the shared table memory are made by voice A. References to tables 1, 2 and 4 are made by voice B. References to Table 1 are made by Voice E. References to Table 3 are made by voice F. References to Table 5 are made by voice C.

The PCM data memory has five samples. Voice A makes references to sample 3 and to sample 5.

The HSAB summation algorithms, SUM 0 and SUM 1, are located in MSP 3. The output routines for writing to the audio output system are executed by MRUs 6 and 7 of MSP 2.

In the HSAB map, it can be seen that the MSP 1 writes to HSAB channels 0 and 1 using arbitrary I/O registers. The MSP 2 reads from HSAB channels 2, 3, 4, 7 and 8 and writes to registers 5, 127 and 126 again using arbitrary mappings. MSP 3 reads from register 0, 1 and 6 and writes to registers 2, 3 and 4. MSP 4 reads from register 5 and writes to register 6, 7 and 8.

The arrows in the MRU mapping are provided to illustrate an example of data flow. As can be seen, the three instances of voice A in MSP 1 write to HSAB channel 0 which is read by the summation routine at MSP 3 in MRU 0. The output of the summation routine in MRU 0 of MSP 3 is then written back to voice E at MRU 0 of MSP 2. Also, voice B at MSP 1 writes to the summation routine SUM 1 at MRU 1 at MSP 3. Other sources of data to the SUM routine include the other three instances of voice B including the instances at MRUs 5 and 6 of MSP 1, MRUs 0 and 1 of MSP 4 and MRU 5, 2 and 3 of MSP 4. The result of this summation is written by the SUM 1 routine to voice E at MRU 1 of MSP 2. The first instance of voice E at MRU 0 writes its result data to voice F at MRUs 2 through 5 of MSP 2. The second instance of voice E writes its results to the second instance of voice F in MRUs 4 through 7 of MSP 4. The first instance of voice F in MSP 2 writes two sets of results to output routines, OUT 1 and OUT 2, which write to the audio output system. Also, the second instance of voice F in MSP 4 writes its results to the output routines out 1 and out 2.

The transfers from the first instance of voice E at MRU 0 and MSP 2 to the first instance of voice F in MSP 2 do not need to use I/O channels. Similarly, the transfer from voice F in MSP 2 to the output routines in MSP 2 do not use the I/O registers.

IV. Conclusion

The DSP based synthesizer system according to the present invention provides features that enable dynamic voice allocation. The system involves predetermination of the set of the possible voices that will require real time allocation in order to build a set of voice programs for dynamic allocation. This speeds voice activation because resource availability can be assumed for the set since it has already been verified that the voices resource requirements can be met by the system.

The system also features symmetric look-uptable availability across the plurality of MSPs. This increases chances of finding space for voices during allocation, since a voice program can go in any MSP without considering whether its tables are loaded or not. System resource dimensions that must be considered in determining resource requirements are reduced to ease voice selection. Also, this allows preloading of tables which speeds up activation of note voices. The system also provides the ability to allocate several different algorithms in a single MSP. By utilizing various algorithms sizes within available space, more voices can be run simultaneously and the resources used more efficiently.

Further, the system is able to selectively disable sections of MSP instruction code using the NOP function. Sections of an MSP can be reloaded with new voices without shutting down the chip or disrupting currently running voices. The internal MSP register bus availability is increased when code sections are disabled, making the transfer of initialization data to the MSP faster.

Further, symmetric HSAB channel availability is provided. This increases the chances of finding space for voices during allocation, since a voice can go in any MSP without considering whether an HSAB channel is available or not. This also has the effect of reducing system resource dimensions required for consideration during resource requirement determination. Also, this feature allows effects and note voices to be treated identically as a group of processing blocks connected by a bunch of virtual wires.

The system also provides for HSAB channel to I/O register mapping without disrupting other channels on the bus. This allows MSP chip space to be conserved, by requiring fewer I/O registers per chip. It also increases the maximum inner connection complexity possible by allowing a virtual channel allocation scheme to be used since I/O register number to HSAB channel number mapping is uncorrelated.

The system also includes isolated memory data and address buses, with separate dual address, host/MSP memory DMA. This feature allows simultaneous host voice initialization processing during MSP microcode and data transfers. This may also be referred to as pipelining the initialization process.

Overall, efficient host processing methods also contribute to fast setup and initialization of both host rate voice processing routines and MSP algorithms.

Voice stealing methods for identifying voices to be replaced by a selective voice in a set may be implemented using fuzzy logic algorithms that consider several dimensions of potential voice resources to select the least audibly intrusive resources to steal for new voices. Also, algorithm I/O audio signal control ramps may be used to allow voices to be changed or stolen without introducing discontinuities which result in clicks or pops in the audio output into the digital signals. It also allows effects to be introduced or modified gradually, allowing smooth transitions in sonic environments.

Thus, a DSP system allocation scheme has been provided that allows various compute and memory resources, not necessarily delimited by hardware boundaries, to be assigned to arbitrary algorithms and activated in real time without disrupting currently active algorithms in the same system. The system is particularly suited to dynamic voice allocation in DSP base electronic music synthesizers on which allocate voices requiring differing DSP algorithms in real time.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

We claim:

1. An audio signal processor comprising:

an input to supply real time input signals indicating selected voices;

voice program memory to store voice programs for respective voices, the voice programs comprising sequences of instructions for generation of the respective voices;

sound processing resources, coupled to the voice program memory and the input, responsive to real time input signals which execute a group of the voice programs in the voice program memory to generate selected voices in real time; and voice allocation resources, coupled with the input and the voice program memory, which dynamically allocate a voice program for a selected voice to the group in response to the real time input signals.

2. The audio signal processor of claim 1, wherein the voice allocation resources include:

circuitry to replace a particular voice program in the group with a voice program for a selected voice in response to the real time input signals.

3. The audio signal processor of claim 1, wherein the voice program memory includes:

a first memory to store a plurality of voice programs; and a second memory, coupled with the sound processing resources and the first memory, to store the group of voice programs for execution by the sound processing resources.

4. The audio signal processor of claim 3, wherein the voice allocation resources include:

circuitry, coupled with the first and second memories of the voice program memory, to transfer at least a component of a selected voice program from the first memory to the second memory in real time.

5. The audio signal processor of claim 1, wherein the sound processing resources include:

at least one signal processor, coupled to the voice program memory, for executing voice programs to generate sound data representing the selected voices; and an audio output, coupled with the at least one signal processor, which produces audio signals in response to the sound data.

6. The audio signal processor of claim 5, wherein the voice program memory includes:

a first memory to store a plurality of voice programs, the voice programs including instructions for execution by the at least one signal processor;

an instruction memory, coupled to the at least one signal processor and the first memory, to store instructions for the group of voice programs.

7. The audio signal processor of claim 6, wherein the voice allocation resources include:

circuitry to replace a particular voice program in the group with a voice program for a selected voice in response to the real time input signals, including logic to temporarily mask instruction storage locations storing instructions for the particular voice program in the instruction memory from execution by the at least one signal processor without effecting execution of instructions for other voice programs in the group, and circuitry to transfer instructions for the selected voice program to the temporarily masked instruction storage locations.

8. The audio signal processor of claim 5, wherein the voice program memory includes:

a first memory to store a plurality of voice programs, the voice programs including delay lines; and a delay line memory, coupled to the at least one signal processor and the first memory, to store delay lines for the group of voice programs.

9. The audio signal processor of claim 8, wherein the voice allocation resources include:

circuitry, coupled with the delay line memory, to disable a delay line of the particular voice program in the delay line memory and set up a delay line for the selected voice program in the delay line memory in real time.

10. The audio signal processor of claim 5, wherein the voice program memory includes:

a first memory to store a plurality of voice programs, the voice programs including instructions and coefficients for execution by the at least one signal processor;

an instruction memory, coupled to the at least one signal processor and the first memory, to store instructions for the group of voice programs; and a coefficient memory, coupled to the at least one signal processor and the first memory, to store coefficients for the group of voice programs.

11. The audio signal processor of claim 5, wherein the voice program memory includes:

a first memory to store a plurality of voice programs, the voice programs including input/output parameters specifying connections among other voice programs in the group; and a input/output parameter memory, coupled to the at least one signal processor and the first memory, to store input/output parameters for the group of voice programs.

12. The audio signal processor of claim 5, wherein the voice program memory includes:

a first memory to store a plurality of voice programs, the voice programs including instructions, input/output parameters specifying connections among the group of voice programs, coefficients, tables and delay lines;

an instruction memory, coupled to the at least one signal processor and the first memory, to store instructions for the group of voice programs;

a input/output parameter memory, coupled to the at least one signal processor and the first memory, to store input/output parameters for the group of voice programs;

a delay line memory, coupled to the at least one signal processor and the first memory, to store delay lines for the group of voice programs;

a coefficient memory, coupled to the at least one signal processor and the first memory, to store coefficients for the group of voice programs; and a table memory, coupled to the at least one signal processor and the first memory, to store table data for the group of voice programs.

13. The audio signal processor of claim 12, wherein the voice allocation resources include:

circuitry, coupled with the first memory, the instruction memory and the delay line memory, to transfer instructions, input/output parameters, coefficients and delay line parameters of a selected voice program from the first memory to the instruction memory, input/output parameter memory, coefficient memory and the delay line memory, respectively, in real time.

14. The audio signal processor of claim 13, wherein the voice allocation resources include:

circuitry to replace a particular voice program in the group with a voice program for a selected voice in response to the real time input signals, including logic to temporarily mask instruction storage locations storing instructions for the particular voice program in the instruction memory from execution by the at least one signal processor without effecting execution of instructions for other voice programs in the group, and circuitry to transfer instructions for the selected voice program to the temporarily masked instruction storage locations.

15. The audio signal processor of claim 14, wherein the voice allocation resources further include:

circuitry, coupled with the delay line memory, to clear a delay line of the particular voice program in the delay line memory and set up a delay line for the selected voice program in the delay line memory in response to the delay line parameters in real time.

16. The audio signal processor of claim 1, wherein the input includes a music keyboard.

17. The audio signal processor of claim 1, wherein the input includes a MIDI interface.

18. The audio signal processor of claim 1, wherein the voice allocation resources include logic to partition the sound processing resources into a plurality of voice program resource groups, and to selectively disable particular resource groups without interfering with voice programs using other resource groups in the plurality, and to allocate the selected voice program to a disabled voice program resource group in real time.

19. An audio signal processor comprising:

an input to supply real time input signals indicating selected voices;

a host processing system coupled to the input and, including a source of voice programs which comprise sequences of instructions for generation of corresponding voices;

voice program memory, coupled with the host processing system, for storing a group of voice programs;

at least one signal processor, coupled to the voice program memory and the input, for executing sequences of instructions in voice programs in the group for selected voices in response to the real time input data to generate sound data representing the selected voices;

voice allocation resources, coupled with the input, the host processing system and the voice program memory, which dynamically allocate a voice program for a selected voice from the source of voice programs in the host processing system to the group stored in the voice program memory in response to the real time input signals; and an audio output, coupled with the at least one signal processor, which produces audio signals in response to the sound data.

20. The audio signal processor of claim 19, wherein the voice allocation resources include:

circuitry to replace a particular voice program in the group with a voice program for a selected voice in response to the real time input signals.

21. The audio signal processor of claim 19, wherein the voice program memory includes:

a first memory to store a plurality of voice programs, the voice programs including instructions for execution by the at least one signal processor;

an instruction memory, coupled to the at least one signal processor and the first memory, to store instructions for the group of voice programs.

22. The audio signal processor of claim 21, wherein the voice allocation resources include:

circuitry to replace a particular voice program in the group with a voice program for a selected voice in response to the real time input signals, including logic to temporarily mask instruction storage locations storing instructions for the particular voice program in the instruction memory from execution by the at least one signal processor without effecting execution of instructions for other voice programs in the group, and circuitry to transfer instructions for the selected voice program to the temporarily masked instruction storage locations.

23. The audio signal processor of claim 19, wherein the voice program memory includes:

a first memory to store a plurality of voice programs, the voice programs including delay lines; and a delay line memory, coupled to the at least one signal processor and the first memory, to store delay lines for the group of voice programs.

24. The audio signal processor of claim 23, wherein the voice allocation resources further include:

logic, coupled with the delay line memory, to disable a delay line of the particular voice program in the delay line memory and set up a delay line for the selected voice program in the delay line memory in real time.

25. The audio signal processor of claim 19, wherein the voice program memory includes:

a first memory to store a plurality of voice programs, the voice programs including instructions and coefficients for execution by the at least one signal processor;

an instruction memory, coupled to the at least one signal processor and the first memory, to store instructions for the group of voice programs; and a coefficient memory, coupled to the at least one signal processor and the first memory, to store coefficients for the group of voice programs.

26. The audio signal processor of claim 19, wherein the voice program memory includes:

a first memory to store a plurality of voice programs, the voice programs including input/output parameters specifying connections among other voice programs in the group; and a input/output parameter memory, coupled to the at least one signal processor and the first memory, to store input/output parameters for the group of voice programs.

27. The audio signal processor of claim 19, wherein the voice program memory includes:

a first memory to store a plurality of voice programs, the voice programs including instructions, input/output parameters specifying connections among the group of voice programs, coefficients, tables and delay lines;

an instruction memory, coupled to the at least one signal processor and the first memory, to store instructions for the group of voice programs;

a input/output parameter memory, coupled to the at least one signal processor and the first memory, to store input/output parameters for the group of voice programs;

a delay line memory, coupled to the at least one signal processor and the first memory, to store delay lines for the group of voice programs;

a coefficient memory, coupled to the at least one signal processor and the first memory, to store coefficients for the group of voice programs; and a table memory, coupled to the at least one signal processor and the first memory, to store table data for the group of voice programs.

28. The audio signal processor of claim 27, wherein the voice allocation resources include:

circuitry, coupled with the first memory, the instruction memory and the delay line memory, to transfer instructions, input/output parameters, coefficients and delay line parameters of a selected voice program from the first memory to the instruction memory, input/output parameter memory, coefficient memory and the delay line memory, respectively, in real time.

29. The audio signal processor of claim 27, wherein the voice allocation resources include:

circuitry to replace a particular voice program in the group with a voice program for a selected voice in response to the real time input signals, including logic to temporarily mask instruction storage locations storing instructions for the particular voice program in the instruction memory from execution by the at least one signal processor without effecting execution of instructions for other voice programs in the group, and to allocate instructions for the selected voice program to the temporarily masked instruction storage locations.

30. The audio signal processor of claim 29, wherein the circuitry to replace a particular voice program further includes:

logic, coupled with the delay line memory, to clear a delay line of the particular voice program in the delay line memory and set up a delay line for the selected voice program in the delay line memory in response to the delay line parameters in real time.

31. The audio signal processor of claim 19, wherein the input includes a music keyboard.

32. The audio signal processor of claim 19, wherein the input includes a MIDI interface.

33. The audio signal processor of claim 19, wherein the host processing system includes a processor, a processor bus coupled to the processor, and a first memory coupled to the processor bus; and wherein the voice program memory includes:

a second memory isolated from the processor bus; and circuitry, coupled to the processor bus and the second memory, to route host reads and writes to the second memory, and to transfer voice programs from the second memory to the plurality of signal processors independently of the processor.

34. The audio signal processor of claim 33, wherein the data processor includes resources responsive to the real time input signal to compute parameters used by the selected voice programs in parallel with the transferring of voice programs from the second memory.

35. The audio signal processor of claim 19, wherein the voice allocation resources include logic to partition resources of the at least one signal processor into a plurality of voice program resource groups, to selectively disable particular voice programs resource groups without interfering with other voice programs resource groups in the plurality, and to allocate the selected voice program to a disabled voice program resource group in real time.

36. An audio signal processor comprising:

an input to supply real time input signals indicating selected voices;

a host processing system coupled to the input and, including a source of voice programs which comprise sequences of instructions for generation of corresponding voices;

storage means, coupled with the host processing system, for storing a group of voice programs;

a plurality of signal processors, coupled to the storage means and the input means, to execute voice programs in the group for selected voices in response to the real time input data to generate sound data representing the selected voices;

means, coupled with the input means, the host processing system and the storage means, for dynamically allocating a voice program for a selected voice from the the source of voice programs in the host processing system to the group stored in the storage means in response to the real time input signals;

an audio data bus, coupled to the plurality of signal processors, to communicate sound data among the plurality of signal processors; and an audio output, coupled with the audio data bus, to produce audio signals in response to the sound data on the bus.

37. The audio signal processor of claim 36, wherein the means for dynamically allocating includes:

means for replacing a particular voice program in the group with a voice program for a selected voice in response to the real time input signals.

38. The audio signal processor of claim 36, wherein the storage means includes:

a first memory to store a plurality of voice programs, the voice programs including instructions for execution by at least one signal processor; and an instruction memory, coupled to the plurality of signal processors and the first memory, to store instructions for the group of voice programs.

39. The audio signal processor of claim 38, wherein the means for dynamically allocating includes:

means for replacing a particular voice program in the group with a voice program for a selected voice in response to the real time input signals, including means for temporarily masking instruction storage locations storing instructions for the particular voice program in the instruction memory from execution by the at least one signal processor without effecting execution of instructions for other voice programs in the group, and means for transferring instructions for the selected voice program to the temporarily masked instruction storage locations.

40. The audio signal processor of claim 36, wherein the storage means includes:

a first memory to store a plurality of voice programs, the voice programs including delay lines; and a delay line memory, coupled to at least one signal processor and the first memory, to store delay lines for the group of voice programs.

41. The audio signal processor of claim 40, wherein the means for dynamically allocating further includes:

means, coupled with the delay line memory, for disabling a delay line of the particular voice program in the delay line memory and setting up a delay line for the selected voice program in the delay line memory in real time.

42. The audio signal processor of claim 36, wherein the storage means includes:

a first memory to store a plurality of voice programs, the voice programs including instructions and coefficients for execution by at least one signal processor;

an instruction memory, coupled to the at least one signal processor and the first memory, to store instructions for the group of voice programs; and a coefficient memory, coupled to the at least one signal processor and the first memory, to store coefficients for the group of voice programs.

43. The audio signal processor of claim 36, wherein the storage means includes:

a first memory to store a plurality of voice programs, the voice programs including input/output parameters specifying connections among other voice programs in the group; and a input/output parameter memory, coupled to the at least one signal processor and the first memory, to store input/output parameters for the group of voice programs.

44. The audio signal processor of claim 36, wherein the source of voice programs in the host processing system includes:

a first memory to store a plurality of voice programs, the voice programs including sequences of instructions, input/output parameters specifying connections among the group of voice programs, coefficients, tables and delay lines; and the storage means includes a plurality of memory modules coupled to corresponding signal processors in the plurality of signal processors; each memory module comprising:

an instruction memory, coupled to the corresponding signal processor and the first memory, to store sequences of instructions for the group of voice programs;

a input/output parameter memory, coupled to the corresponding signal processor and the first memory, to store input/output parameters for the group of voice programs;

a delay line memory, coupled to the corresponding signal processor and the first memory, to store delay lines for the group of voice programs;

a coefficient memory, coupled to the corresponding signal processor and the first memory, to store coefficients for the group of voice programs; and a table memory, coupled to the corresponding signal processor and the first memory, to store table data for the group of voice programs.

45. The audio signal processor of claim 44, wherein the means for dynamically allocating includes:

means, coupled with the first memory and the plurality of memory modules, for transferring instructions, input/output parameters specifying connections among the group of voice programs, coefficients, and delay line parameters of a selected voice program from the first memory to selected memory modules in real time.

46. The audio signal processor of claim 45, wherein the means for dynamically allocating includes:

means for replacing a particular voice program in the group with a voice program for a selected voice in response to the real time input signals, including means for temporarily masking instruction storage locations storing instructions for the particular voice program in the instruction memory of the selected module from execution by the corresponding signal processor without effecting execution of instructions for other voice programs in the group, and means for transferring instructions for the selected voice program to the temporarily masked instruction storage locations.

47. The audio signal processor of claim 46, wherein the means for replacing further includes:

means, coupled with the plurality of memory modules, for clearing a delay line of the particular voice program in the delay line memory of the selected memory module and setting up a delay line for the selected voice program in the delay line memory in response to the delay line parameters in real time.

48. The audio signal processor of claim 44, wherein the host processing system includes means for composing a set of voice programs for real time execution; and the source of voice programs includes a set memory to store the set of voice programs; and the means for dynamically allocating includes means for transferring table data for the set of voice programs to the table memories in the plurality of memory modules.

49. The audio signal processor of claim 36, wherein the host processing system includes means for composing a set of voice programs for real time execution; and the source of voice programs includes a set memory to store the set of voice programs.

50. The audio signal processor of claim 49, wherein the voice programs in the set of voice programs include sequences of instructions, input/output parameters specifying connections among the group of voice programs, coefficients, tables and delay lines; and the storage means includes a plurality of memory modules coupled to corresponding signal processors in the plurality of signal processors; each memory module comprising:

an instruction memory, coupled to the corresponding signal processor and the first memory, to store sequences of instructions for the group of voice programs;

a input/output parameter memory, coupled to the corresponding signal processor and the first memory, to store input/output parameters for the group of voice programs;

a delay line memory, coupled to the corresponding signal processor and the first memory, to store delay lines for the group of voice programs;

a coefficient memory, coupled to the corresponding signal processor and the first memory, to store coefficients for the group of voice programs; and a table memory, coupled to the corresponding signal processor and the first memory, to store table data for the group of voice programs.

51. The audio signal processor of claim 50, wherein at least one of the voice programs in the set includes sound sample data, further including a sample store in at least one of the memory modules to store sound sample data for the group of voice programs.

52. The audio signal processor of claim 36, wherein the input includes a music keyboard.

53. The audio signal processor of claim 36, wherein the input includes a MIDI interface.

54. The audio signal processor of claim 36, wherein the host processing system includes a processor, a processor bus coupled to the processor, and a first memory coupled to the processor bus; and wherein the storage means includes:

a second memory isolated from the processor bus; and means, coupled to the processor bus and the second memory, for routing host reads and writes to the second memory, and for transferring voice programs from the second memory to the plurality of signal processors independently of the processor.

55. The audio signal processor of claim 36, wherein the host processing system includes means responsive to the real time input signal for computing parameters used by the selected voice programs in parallel with the transferring of voice programs from the second memory.

56. The audio signal processor of claim 36, wherein the means for dynamically allocating includes means for partitioning resources of the plurality of signal processors into a plurality of voice program resource groups, and means for selectively disabling particular resource groups without interfering with voice programs using other resource groups in the plurality, and allocating the selected voice program to a disabled voice program resource group in real time.

* * * * *